US009299291B2

(12) United States Patent
Maeyama et al.

(10) Patent No.: US 9,299,291 B2
(45) Date of Patent: Mar. 29, 2016

(54) DISPLAY UNIT, DRIVING METHOD AND ELECTRONIC APPARATUS

(71) Applicant: JOLED Inc., Tokyo (JP)

(72) Inventors: Koichi Maeyama, Kanagawa (JP); Teppei Isobe, Kanagawa (JP); Yohei Funatsu, Kanagawa (JP); Daisuke Miki, Tokyo (JP)

(73) Assignee: JOLED Inc., Tokyo (JP)

( * ) Notice: Subject to any disclaimer, the term of this patent is extended or adjusted under 35 U.S.C. 154(b) by 0 days.

(21) Appl. No.: 14/541,733

(22) Filed: Nov. 14, 2014

(65) Prior Publication Data

US 2015/0187277 A1 Jul. 2, 2015

(30) Foreign Application Priority Data

Dec. 27, 2013 (JP) ..... 2013-270872

(51) Int. Cl.

*G09G 5/02* (2006.01)
*G09G 3/32* (2006.01)
*G09G 3/36* (2006.01)

(52) U.S. Cl.

CPC ..... *G09G 3/3291* (2013.01); *G09G 3/3225* (2013.01); *G09G 3/3688* (2013.01); *G09G 2300/0842* (2013.01); *G09G 2310/027* (2013.01); *G09G 2310/08* (2013.01); *G09G 2320/0242* (2013.01); *G09G 2320/041* (2013.01); *G09G 2320/043* (2013.01); *G09G 2320/046* (2013.01); *G09G 2320/103* (2013.01); *G09G 2340/06* (2013.01); *G09G 2360/144* (2013.01); *G09G 2360/16* (2013.01)

(58) Field of Classification Search

CPC . G09G 3/2003; G09G 3/3291; G09G 3/3688; G09G 2310/027; G09G 2320/041; G09G 2320/103; G09G 2340/0457; G09G 2360/16
See application file for complete search history.

(56) References Cited

U.S. PATENT DOCUMENTS

2006/0170628 A1* 8/2006 Yamashita ..... G09G 3/3233 345/76
2008/0198103 A1* 8/2008 Toyomura ..... G09G 3/3233 345/77
2010/0117998 A1* 5/2010 Yamashita ..... G09G 3/3233 345/204
2010/0118002 A1* 5/2010 Yamashita ..... G09G 3/3233 345/205
2011/0141084 A1* 6/2011 Kishi ..... G09G 3/2003 345/211
2012/0062545 A1* 3/2012 Kim ..... G09G 3/3233 345/212
2012/0162177 A1* 6/2012 Lee ..... G09G 3/3258 345/211
2014/0035797 A1* 2/2014 Jinta ..... G09G 3/30 345/77

(Continued)

FOREIGN PATENT DOCUMENTS

JP 2008-033066 A 2/2008
JP 2011-141539 7/2011
JP 2013-137532 7/2013

*Primary Examiner* — Joe H Cheng
(74) *Attorney, Agent, or Firm* — Michael Best & Friedrich LLP

(57) ABSTRACT

A display unit includes: a display section including a plurality of unit pixels; and a drive section configured to perform a first drive, a second drive, and a third drive on each of the unit pixels in this order, in which each of the first drive and the second drive includes an initialization drive, a writing drive of a pixel voltage, and a light emission drive based on the pixel voltage written by the writing drive, a part of a series of the initialization drive, the writing drive, and the light emission drive differs between the first drive and the second drive, and the third drive includes a light emission drive based on the pixel voltage written by the writing drive in the second drive.

30 Claims, 51 Drawing Sheets

(56) References Cited

U.S. PATENT DOCUMENTS

2014/0118409 A1* 5/2014 Jun ..... G09G 5/02 345/690

2015/0049130 A1* 2/2015 Kanda ..... G09G 3/3233 345/690

2015/0243205 A1* 8/2015 Yamashita ..... G09G 3/3233 345/76

* cited by examiner

DISPLAY UNIT, DRIVING METHOD AND ELECTRONIC APPARATUS

CROSS REFERENCE TO RELATED APPLICATIONS

This application claims the benefit of Japanese Priority Patent Application JP 2013-270872 filed Dec. 27, 2013, the entire contents which are incorporated herein by reference.

BACKGROUND

The present disclosure relates to a display unit including a current drive type display device, a method of driving such a display unit, and an electronic apparatus including such a display unit.

Recently, in the field of display units configured to display an image, display units (organic EL (Electro Luminescence) display units) using, as light-emitting devices, current drive type optical devices with light emission luminance changeable according to a value of a current flowing therethrough, for example, organic EL devices have been developed for commercialization. Unlike liquid crystal devices and the like, the organic EL devices are self-luminous devices; therefore, in the organic EL devices, a light source (a backlight) is not necessary. Accordingly, the organic EL display units have characteristics such as higher image visibility, lower power consumption, and higher response speed of a device, compared to liquid crystal display units needing a light source.

In such display units, technologies to further reduce power consumption have been developed. For example, in Japanese Unexamined Patent Application Publication Nos. 2013-137532, 2008-33066, and 2011-141539, there are disclosed display units configured to stop rewriting of a pixel voltage to a sub-pixel, for example, when a still image is displayed.

SUMMARY

Typically, in display units, a reduction in power consumption is desired. In particular, in display units used for portable electronic apparatuses, a further reduction in power consumption is desired to achieve a longer battery run time. On the other hand, in the display units, high image quality is desired; therefore, power consumption is expected to be reduced while reducing deterioration in image quality.

It is desirable to provide a display unit capable of reducing power consumption while reducing deterioration in image quality, a driving method, and an electronic apparatus.

According to an embodiment of the present disclosure, there is provided a display unit including: a display section including a plurality of unit pixels; and a drive section configured to perform a first drive, a second drive, and a third drive on each of the unit pixels in this order, in which each of the first drive and the second drive includes an initialization drive, a writing drive of a pixel voltage, and a light emission drive based on the pixel voltage written by the writing drive, a part of a series of the initialization drive, the writing drive, and the light emission drive differs between the first drive and the second drive, and the third drive includes a light emission drive based on the pixel voltage written by the writing drive in the second drive.

According to an embodiment of the present disclosure, there is provided a driving method including: preparing a plurality of unit pixels; and performing a first drive, a second drive, and a third drive on each of the plurality of unit pixels in this order, in which each of the first drive and the second drive includes an initialization drive, a writing drive of a pixel voltage, and a light emission drive based on the pixel voltage written by the writing drive, a part of a series of the initialization drive, the writing drive, and the light emission drive differs between the first drive and the second drive, and the third drive includes a light emission drive based on the pixel voltage written by the writing drive in the second drive.

According to an embodiment of the present disclosure, there is provided an electronic apparatus provided with a display unit and a control section configured to perform operation control on the display unit, the display unit including: a display section including a plurality of unit pixels; and a drive section configured to perform a first drive, a second drive, and a third drive on each of the unit pixels in this order, in which each of the first drive and the second drive includes an initialization drive, a writing drive of a pixel voltage, and a light emission drive based on the pixel voltage written by the writing drive, a part of a series of the initialization drive, the writing drive, and the light emission drive differs between the first drive and the second drive, and the third drive includes a light emission drive based on the pixel voltage written by the writing drive in the second drive. The electronic apparatus may correspond to, for example, a television, en electronic book, a smartphone, a digital camera, a notebook personal computer, a video camera, a head-mounted display, or the like.

In the display unit, the driving method, and the electronic apparatus according to the embodiments of the present disclosure, the first drive, the second drive, and the third drive are performed on each of the unit pixels in this order. At this time, a drive is so performed as to allow a part of the series of the initialization drive, the writing drive, and the light emission drive to differ between the first drive and the second drive.

In the display unit, the driving method, and the electronic apparatus according to the embodiments of the present disclosure, a part of the series of the initialization drive, the writing drive, and the light emission drive differs between the first drive and the second drive; therefore, while deterioration in image quality is reduced, power consumption is allowed to be reduced. It is to be noted that effects of the embodiments of the present disclosure are not limited to effects described here, and may include any effect described in this description.

It is to be understood that both the foregoing general description and the following detailed description are exemplary, and are intended to provide further explanation of the technology as claimed.

BRIEF DESCRIPTION OF THE DRAWINGS

The accompanying drawings are included to provide a further understanding of the technology, and are incorporated in and constitute a part of this specification. The drawings illustrate embodiments and, together with the specification, serve to explain the principles of the technology.

FIG. 65 is an explanatory diagram illustrating a configuration example of a module including the display unit according to any of the embodiments and the like.

FIG. 66 is a perspective view illustrating an appearance of Application Example 1 of the display unit according to any of the embodiments and the like.

FIG. 67 is a perspective view illustrating an appearance of Application Example 2 of the display unit according to any of the embodiments and the like.

DETAILED DESCRIPTION

Some embodiments of the present disclosure will be described in detail below referring to the accompanying drawings. It is to be noted that description will be given in the following order.

1. First Embodiment
2. Second Embodiment
3. Application Examples (1. First Embodiment)

[Configuration Example]

Figure 1:
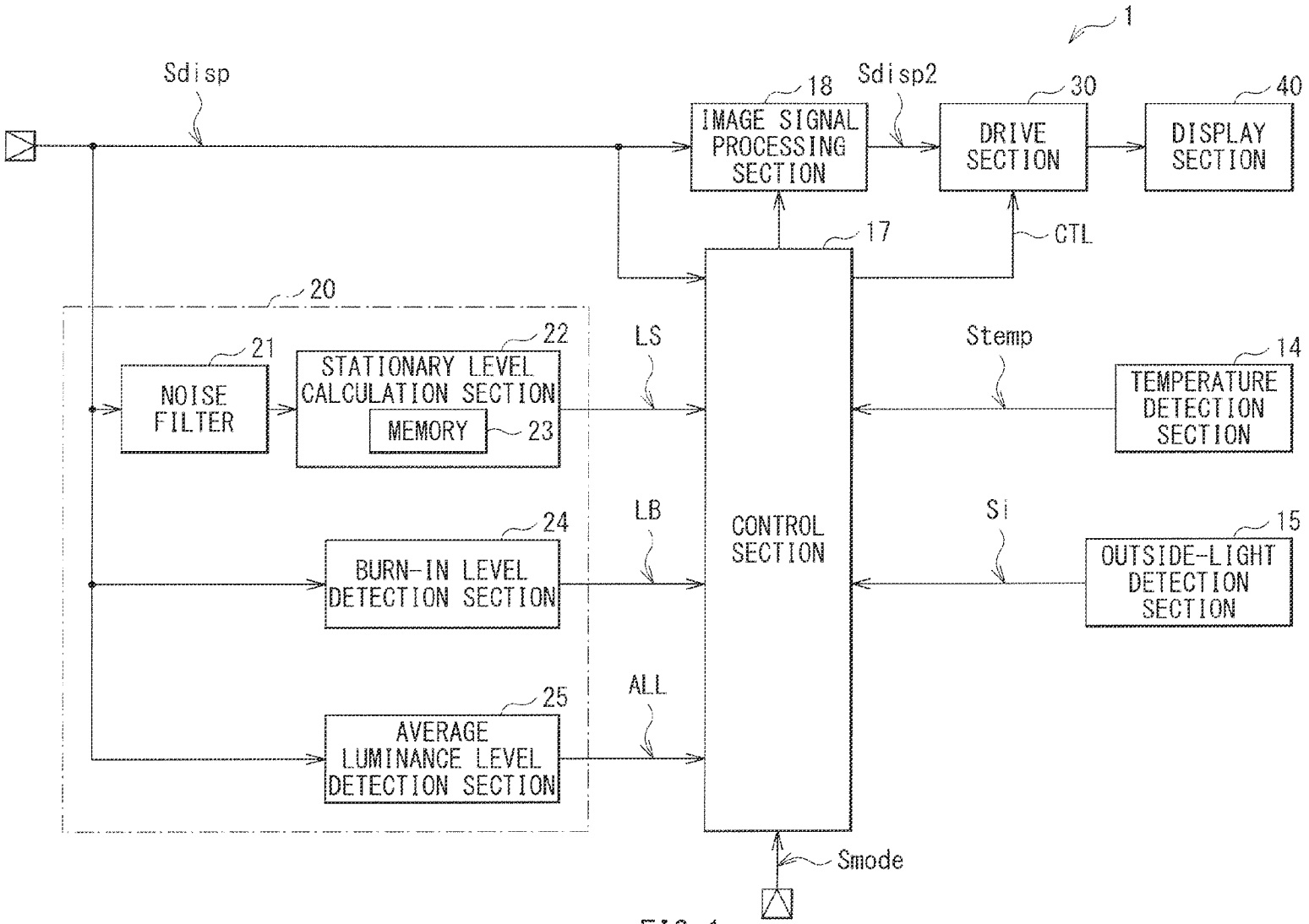
FIG. 1 is a block diagram illustrating a configuration example of a display unit according to a first embodiment of the present disclosure.

FIG. 1 illustrates a configuration example of a display unit according to a first embodiment. A display unit 1 is an active matrix display unit using organic EL devices. It is to be noted that a driving method according to an embodiment of the present disclosure is embodied by this embodiment, and will be also described below.

The display unit 1 is configured to display an image, based on an image signal Sdisp. In this example, the image signal Sdisp includes red (R) luminance information IR, green (G) luminance information IG, and blue (B) luminance information IB. The display unit 1 includes a display section 40, a drive section 30, a detection section 20, a temperature detection section 14, an outside-light detection section 15, a control section 17, and an image signal processing section 18.

Figure 2:
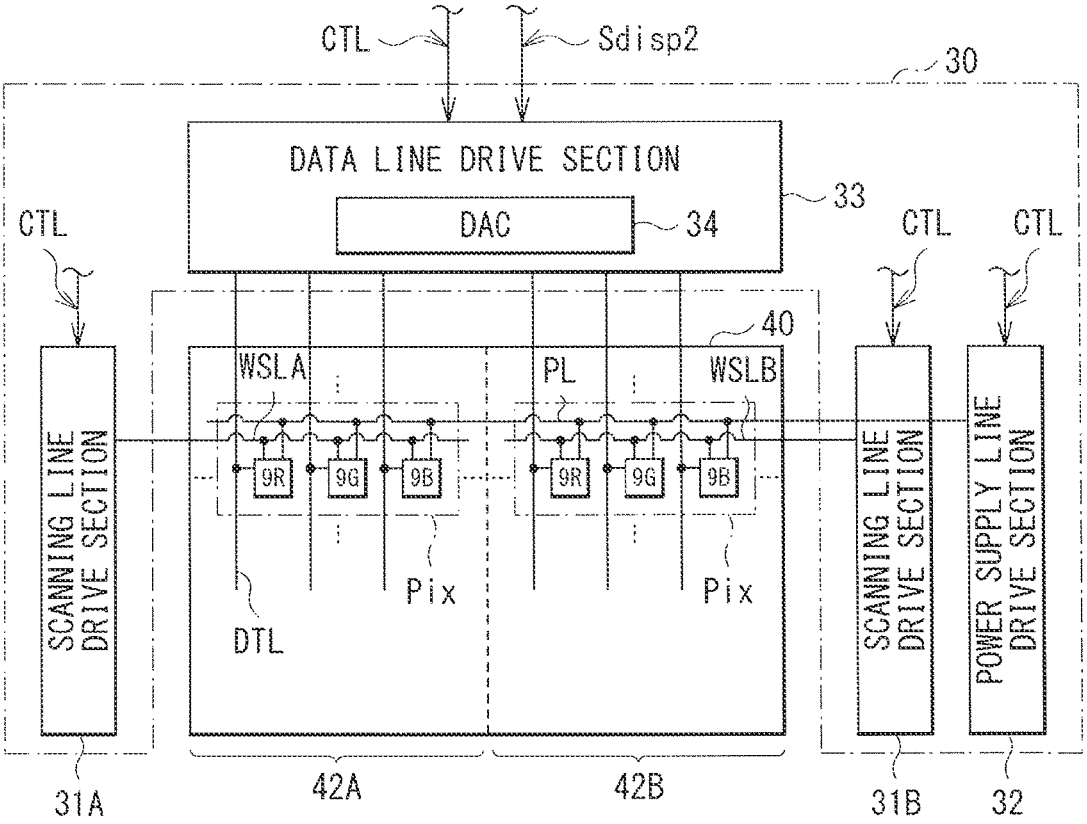
FIG. 2 is a block diagram illustrating a configuration example of a drive section and a display section illustrated in FIG. 1.

FIG. 2 illustrates a configuration example of the display section 40 and the drive section 30. The display section 40 includes a plurality of pixels Pix arranged in a matrix form. Each of the pixels Pix includes a red (R) sub-pixel 9R, a green (G) sub-pixel 9G, and a blue (B) sub-pixel 9B. It is to be noted that hereinafter any one of the sub-pixels 9R, 9G, and 9B is referred to as "sub-pixel 9" as appropriate. A display region of the display section 40 is partitioned into two regions 42A and 42B along a row direction (a horizontal direction). In this example, the region 42A is a left-half region of the display section 40 and the region 42B is a right-half region of the display section 40. The display section 40 includes a plurality of scanning lines WSLA extending along the row direction in the region 42A, a plurality of scanning lines WSLB extending along the row direction in the region 42B, a plurality of power supply lines PL extending along the row direction in the regions 42A and 42B, and a plurality of data lines DTL extending along a column direction (a vertical direction). First ends of the scanning lines WSLA, WSLB, the power supply lines PL, and the data lines DTL are connected to the drive section 30. The regions 42A and 42B of the display section 40 are further partitioned into a plurality of segment regions RD.

Figure 3:
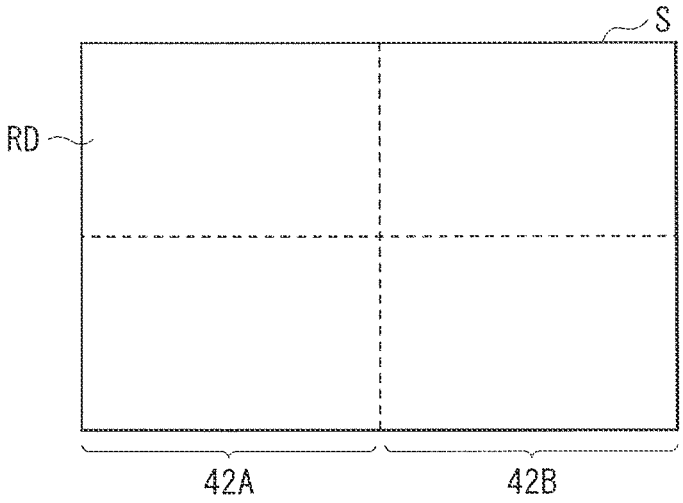
FIG. 3 is an explanatory diagram illustrating segment regions in the display section illustrated in FIG. 2.

FIG. 3 illustrates the segment regions RD of the display section 40. In this example, four segment regions RD are provided in a display region S of the display section 40. More specifically, in this example, two segment regions RD are provided in a top half and a bottom half of the region 42A of the display section 40, and two segment regions RD are provided in a top half and a bottom half of the region 42B of the display section 40 in a similar manner. As will be described later, the drive section 30 is allowed to selectively perform a writing drive on each of the segment regions RD.

Figure 4:
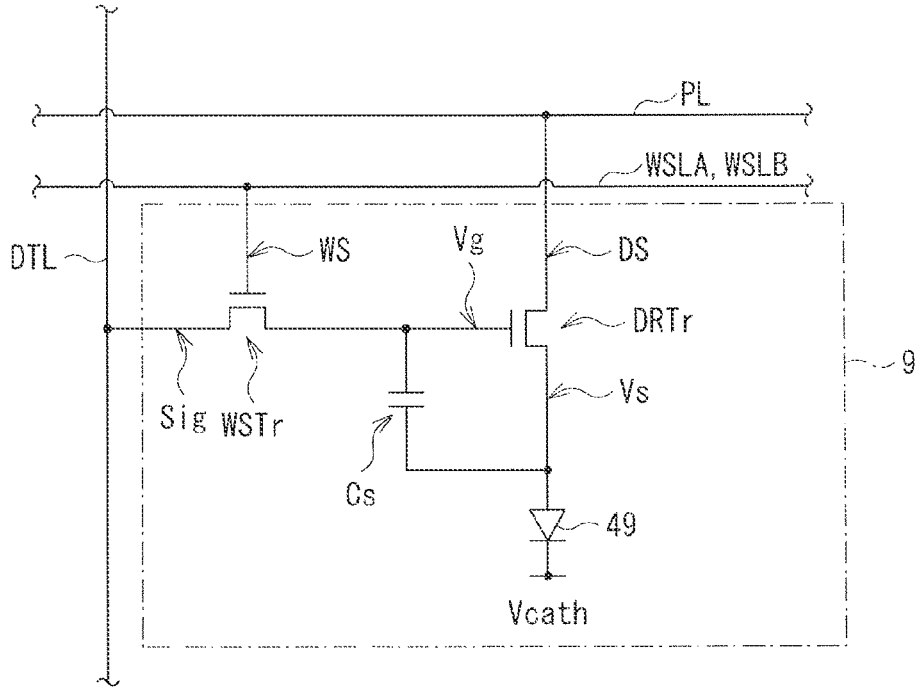
FIG. 4 is a circuit diagram illustrating a configuration example of a sub-pixel illustrated in FIG. 2.

FIG. 4 illustrates an example of a circuit configuration of the sub-pixel 9. The sub-pixel 9 includes a writing transistor WSTr, a driving transistor DRTr, a light-emitting device 49, and a capacitor device Cs. In other words, in this example, the sub-pixel 9 has a so-called "2Tr1C" configuration configured with use of two transistors (the writing transistor WSTr and the driving transistor DRTr) and one capacitor device Cs.

Each of the writing transistor WSTr and the driving transistor DRTr may be configured of an N-channel MOS (Metal Oxide Semiconductor) type TFT (Thin Film Transistor). In the writing transistor WSTr, a gate thereof is connected to the scanning line WSLA or the scanning line WSLB, a source thereof is connected to the data line DTL, and a drain thereof is connected to a gate of the driving transistor DRTr and a first end of the capacitor device Cs. In the driving transistor DRTr, the gate thereof is connected to the drain of the writing transistor WSTr and the first end of the capacitor device Cs, a drain thereof is connected to the power supply line PL, and a source thereof is connected to a second end of the capacitor device Cs and an anode of the light-emitting device 49.

The first end of the capacitor device Cs is connected to the gate of the driving transistor DRTr, and the like, and the second end of the capacitor device Cs is connected to the source of the driving transistor DRTr and the like. The light-emitting device 49 is a light-emitting device configured with use of an organic EL device, and the anode of the light-emitting device 49 is connected to the source of the driving transistor DRTr and the second end of the capacitor device Cs, and a cathode voltage Vcath is supplied from the drive section 30 to a cathode of the light-emitting device 49. It is to be noted that, in this example, the light-emitting device 49 is configured with use of the organic EL device; however, the light-emitting device 49 is not limited thereto, and may be configured with use of any current drive type light-emitting device.

By this configuration, when the writing transistor WSTr is turned on, a writing operation is performed in the sub-pixel 9, and a potential difference according to a pixel voltage Vsig (that will be described later) between both ends of the capacitor device Cs is set. Then, the driving transistor DRTr allows a drive current according to the potential difference between both ends of the capacitor device Cs to flow through the light-emitting device 49. Thus, the light-emitting device 49 emits light with luminance according to the pixel voltage Vsig.

The drive section 30 is configured to drive the display section 40, based on an image signal Sdisp2 supplied from the image signal processing section 18 and a control signal CTL supplied from the control section 17. The drive section 30 is allowed to selectively perform the writing drive on each of the segment regions RD. The drive section 30 may be integrally formed with the display section 40 or may be formed as, for example, an integral circuit (a chip) separately from the display section 40. The drive section 30 includes scanning line drive sections 31A and 31B, a power supply line drive section 32, and a data line drive section 33.

The scanning line drive section 31A is configured to sequentially select the sub-pixels 9 in the region 42A by sequentially applying a scanning signal WS to the plurality of scanning lines WSLA, based on the control signal CTL supplied from the control section 17. As with the scanning line drive section 31A, the scanning line drive section 31B is configured to sequentially select the sub-pixels 9 in the region 42B by sequentially applying the scanning signal WS to the plurality of scanning lines WSLB, based on the control signal CTL supplied from the control section 17.

The power supply line drive section 32 is configured to control a light emission operation and a light extinction operation of the sub-pixels 9 by sequentially applying a power supply signal DS to the plurality of power supply lines PL, based on the control signal CTL supplied from the control section 17. In this example, the power supply signal DS is changed among three voltages Vccp, Vext, and Vini. As will be described later, the voltage Vccp is a voltage used to flow a current through the driving transistor DRTr, thereby allowing the light-emitting device 49 to emit light, and is a higher voltage than the voltages Vext and Vini. The voltage Vext is a voltage used to allow the light-emitting device 49 to stop emitting light, and is a higher voltage than the voltage Vini. The voltage Vini is a voltage used to initialize the sub-pixel 9.

The data line drive section 33 is configured to generate a signal Sig, based on the image signal Sdisp2 supplied from the image signal processing section 18 and the control signal CTL supplied from the control section 17 and apply the signal Sig to each of the data lines DTL. The data line drive section 33 includes a DAC (Digital-to-Analog Converter) 34. The DAC 34 is configured to generate a pixel voltage Vsig (an analog voltage) indicating light emission luminance of each of the sub-pixels 9, based on the luminance information IR, IG, and IB (digital codes) included in the image signal Sdisp2. Then, the data line drive section 33 is configured to generate the signal Sig by alternately providing the pixel voltage Vsig and a voltage Vofs used to perform Vth correction that will be described later.

By this configuration, as will be described later, the drive section 30 initializes the sub-pixels 9, performs correction (Vth correction and μ (mobility) correction) for reduction in an influence of device variation of the driving transistor DRTr on image quality, and performs writing of the pixel voltage Vsig.

The detection section 20 illustrated in FIG. 1 is configured to generate a stationary level LS, a burn-in level LB, and an average luminance level ALL, based on the image signal Sdisp. The detection section 20 includes a noise filter 21, a stationary level calculation section 22, a burn-in level detection section 24, and an average luminance level detection section 25.

The noise filter 21 is configured to remove noise of the luminance information IR, IG, and IB included in the image signal Sdisp. The stationary level calculation section 22 determines a motion amount of an image, based on the luminance information IR, IG, and IB from which noise is removed by the noise filter 21 to calculate the stationary level LS, based on the motion amount. The stationary level LS becomes higher when an image indicated by the image signal Sdisp is a still image, and becomes lower when the image indicated by the image signal Sdisp is a moving image. In this example, the stationary level calculation section 22 includes a memory 23. In this example, the memory 23 is a frame memory, and is configured to hold the luminance information IR, IG, and IB, from which noise is removed by the noise filter 21, for one frame image. The stationary level calculation section 22 compares the luminance information IR, IG, and IB for one frame image supplied from the noise filter 21 with the luminance information IR, IG, and IB for one frame image stored in the memory 23 to determine the motion amount of the image, and calculates the stationary level LS, based on the motion amount. The stationary level LS may include a large number of stages (for example, 256 stages) or a small number of stages (for example, 4 stages). At this time, the stationary level calculation section 22 calculates the stationary level LS in each of the plurality of segment regions RD. Then, the stationary level calculation section 22 supplies the stationary level LS in each of the segment regions RD to the control section 17.

It is to be noted that the noise filter 21 may not be provided in a case where noise causes little trouble. Moreover, in a case where an influence of noise remains even though the noise filter 21 is provided, and the motion amount is not sufficiently low even though an image is a still image, for example, a threshold value may be set for the motion amount, and it may be determined that the image is a still image when the motion amount is equal to or smaller than the threshold value. Further, in this example, the memory 23 is provided to the stationary level calculation section 22; however, the stationary level LS may be obtained by a simpler method without providing the memory 23. More specifically, for example, each of the segment regions RD may be further partitioned into a plurality of sub-regions, and an average level of the information IR, IG, and IB in each of the sub-regions may be determined to obtain the stationary level LD, based on time change in the average level. Therefore, power consumption and cost is allowed to be reduced.

The burn-in level detection section 24 is configured to detect the burn-in level LB, based on the image signal Sdisp. The burn-in level LB becomes higher when a possibility of occurrence of burn-in is high and becomes lower when the possibility is low. More specifically, for example, the burn-in level detection section 24 may judge that the higher the values of the luminance information IR, IG, and IB are, the higher the possibility of occurrence of burn-in is. Then, the burn-in level detection section 24 supplies the detected burn-in level LB to the control section 17.

The average luminance level detection section 25 is configured to detect the average luminance level ALL of each frame image, based on the image signal Sdisp. Then, the average luminance level detection section 25 supplies the detected average luminance level ALL to the control section 17.

The temperature detection section 14 is configured to detect a temperature (a panel temperature) of the display section 40. Then, the temperature detection section 14 supplies information about the detected temperature (temperature information Stemp) to the control section 17. The outside-light detection section 15 is configured to detect brightness (outside-light illuminance) of an environment where the display unit 1 is placed. Then, the outside-light detection section 15 supplies information about the detected outside-light illuminance (outside-light information Si) to the control section 17.

The control section 17 is configured to control the image signal processing section 18 and the drive section 30, based on the image signal Sdisp, the stationary level LS, the burn-in level LB, the average luminance level ALL, the temperature information Stemp, the outside-light information Si, and mode information Smode.

More specifically, the control section 17 has a function of controlling whether or not to perform the writing drive on each of the segment regions RD of the display section 40, based on the stationary level LS and the luminance information IR, IG, and IB included in the image signal Sdisp.

Figure 5:
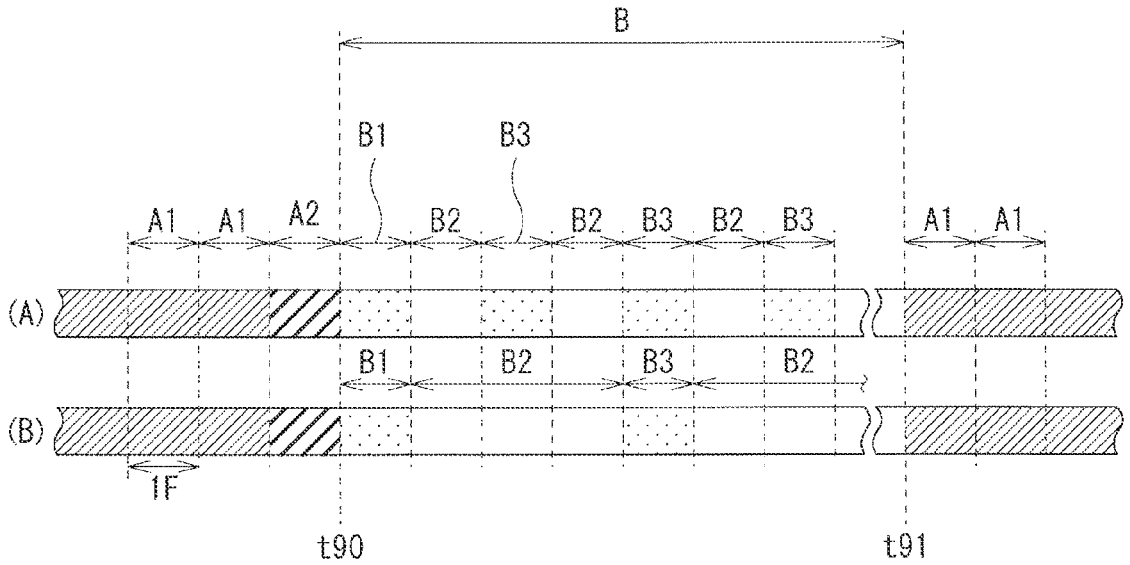
FIG. 5 is a schematic view illustrating an operation example of the sub-pixel illustrated in FIG. 2.

FIG. 5 schematically illustrates an operation in the sub-pixel 9, where a part (A) illustrates a case where the stationary level LS is moderate and a part (B) illustrates a case where the stationary level LS is high. In this example, the stationary level LS is sufficiently low before a timing t90 and after a timing t91, and the stationary level LS has a moderate value (refer to the part (A) in FIG. 5) or a high value (refer to the part (B) in FIG. 5) in a period from the timing t90 to the timing t91.

In a case where the stationary level LS of one segment region RD is sufficiently low, the sub-pixels 9 belonging to the segment region RD perform a normal operation A1 in each frame period. In this case, in the normal operation A1, a light emission operation is performed after a writing operation is performed. In other words, in a case where the stationary level LS is sufficiently low, motion of an image in the segment region RD is large; therefore, the sub-pixels 9 perform the writing operation in each frame period. Then, in one frame period immediately before the timing t90 at which the stationary level LS is changed to the moderate value (refer to the part (A) in FIG. 5) or the high value (refer to the part (B) in FIG. 5), the sub-pixels 9 perform a normal operation A2. In this case, in the normal operation A2, as with the normal operation A1, the light emission operation is performed after the writing operation is performed; however, as will be described later, a waveform of the power supply signal DS in the normal operation A2 is different from that in the normal operation A1.

Moreover, in a case where the stationary level LS of one segment region RD is moderate (refer to the part (B) in FIG. 5), the sub-pixels 9 belonging to the segment region RD perform an intermittent writing operation B. In the intermittent writing operation B, the sub-pixels 9 perform a writing operation (a before-stop operation B1) in a first frame period, and then intermittently perform a writing operation (a refresh operation B3). As will be described later, in the before-stop operation B1 and the refresh operation B3, after a writing operation is performed with use of a lower pixel voltage Vsig than that in the normal operations A1 and A2, a light emission operation is performed at a large light-emission duty ratio DUTY. Moreover, as will be described later, in the writing stop operation B2, a light emission operation is performed at a light-emission duty ratio DUTY substantially equal to that in the before-stop operation B1 and the refresh operation B3 without performing the writing operation. In this example, the sub-pixels 9 alternately repeat the writing operation (the before-stop operation B1 or the refresh operation B3) and the writing stop operation B2 for one frame period. In other words, in this example, a writing stop frame number NF is "1". More specifically, in a case where the stationary level LS is moderate, motion of an image in the segment region RD is moderate; therefore, the sub-pixels 9 intermittently perform the writing operation.

Moreover, in a case where the stationary level LS of one segment region RD is high (refer to the part (B) in FIG. 5), the sub-pixels 9 belonging to the segment region RD perform the intermittent writing operation B. In the intermittent writing operation B, the sub-pixels 9 alternately repeat the writing operation (the before-stop operation B1 or the refresh operation B3) and the writing stop operation B2 for three frame periods. In other words, in this example, the writing stop frame number NF is "3". More specifically, in a case where the stationary level LS is high, motion of an image in the segment region RD is small; therefore, the sub-pixels 9 further increase the writing stop frame number NF, and intermittently perform the writing operation.

The control section 17 dynamically sets the writing stop frame number NF in each of the segment regions RD, based on the stationary level LS. Then, the control section 17 supplies the control signal CTL to the drive section 30, and controls the drive section 30 to allow the drive section 30 to perform the intermittent writing operation B, based on the writing stop frame number NF.

Figure 6:
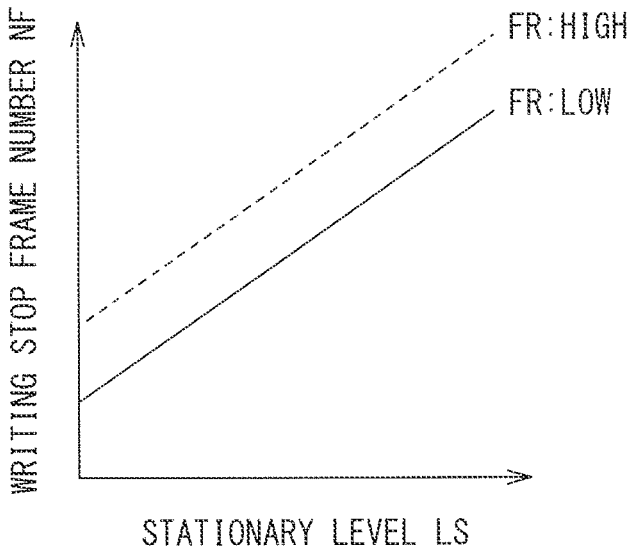
FIG. 6 is an explanatory diagram illustrating an operation example of a control section illustrated in FIG. 1.

FIG. 6 illustrates an operation of setting the writing stop frame number NF, based on the stationary level LS. In this example, the higher the stationary level LS is, the more the control section 17 increases the writing stop frame number NF. In other words, the higher the stationary level LS is, the smaller the motion of an image is; therefore, even if the frequency of the writing operation is reduced, image quality is less likely to be deteriorated. Moreover, in this example, the higher a frame rate FR is, the more the control section 17 increases the writing stop frame number NF. In other words, in a case where the frame rate FR is high, the motion becomes smooth, and a possibility of occurrence of jerkiness is allowed to be reduced; therefore, even if the frequency of the writing operation is reduced, image quality is less likely to be deteriorated. The control section 17 sets the writing stop frame number NF, based on the stationary level LS and the frame rate FR in such a manner. Therefore, in the display unit 1, while a possibility of deterioration in image quality is reduced, power consumption is allowed to be reduced.

Figure 7:
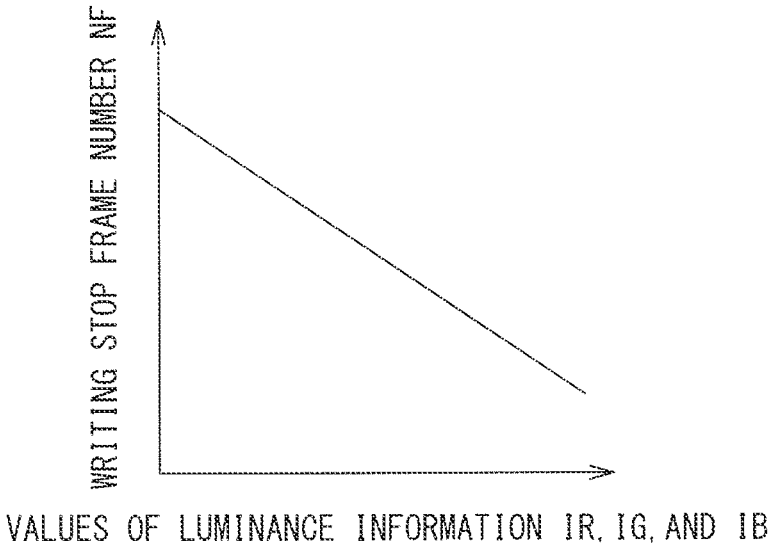
FIG. 7 is an explanatory diagram illustrating another operation example of the control section illustrated in FIG. 1.

FIG. 7 illustrates an operation of setting the writing stop frame number NF, based on the luminance information IR, IG, and IB. In this example, the larger the values of the luminance information IR, IG, and IB are, the more the control section 17 decreases the writing stop frame number NF. In other words, typically, in the sub-pixel 9, after the pixel voltage Vsig is written, for example, a potential difference between both ends of the capacitor device Cs is reduced by leakage from the capacitor device Cs or the like. The larger the pixel voltage Vsig is, the more an influence of the leakage is pronounced, and in a case where the writing stop frame number NF is large, luminance is gradually reduced, and image quality may be deteriorated accordingly. Therefore, in the control section 17, the larger the values of the luminance information IR, IG, and IB are (i.e., the higher the pixel voltage Vsig is), the more reduction in luminance is allowed to be reduced by decreasing the writing stop frame number NF, and the more the possibility of deterioration in image quality is allowed to be reduced.

The control section 17 sets the writing stop frame number NF in each of the segment regions RD of the display section 40 in such a manner. Then, the drive section 30 selectively performs the writing drive on each of the segment regions RD. Therefore, in the display unit 1, while the possibility of deterioration in image quality is reduced, power consumption is allowed to be reduced.

Moreover, the control section 17 has a function of instructing the image signal processing section 18 to decrease the values of the luminance information IR, IG, and IB and instructing the drive section 30 through the control signal CTL to extend a light emission period of the sub-pixel 9 when the intermittent writing operation B is performed.

Figure 8:
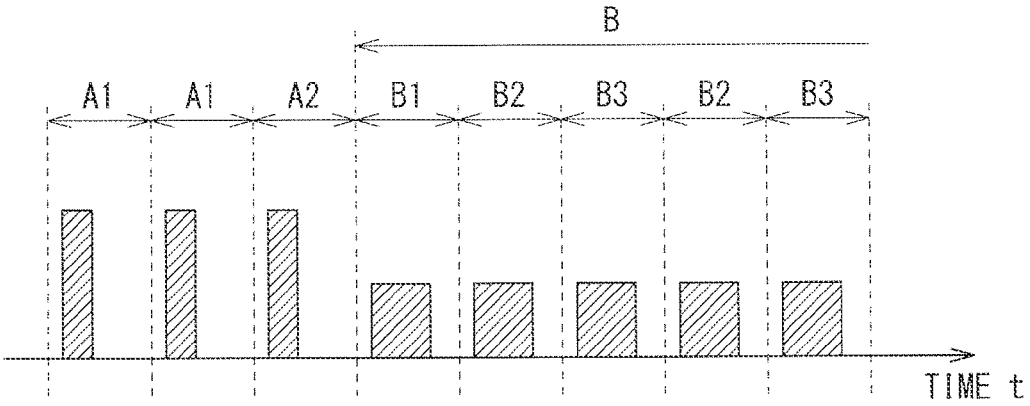
FIG. 8 is an explanatory diagram illustrating another operation example of the control section illustrated in FIG. 1.

FIG. 8 illustrates a light emission operation in one sub-pixel 9 of the display unit 1, where a vertical axis indicates luminance of the sub-pixel 9, and a horizontal axis indicates time t. In a case where the intermittent writing operation B is performed, compared to a case where the normal operations A1 and A2 are performed, luminance is lower, and the light-emission duty ratio DUTY is larger. In this case, the light-emission duty ratio DUTY indicates a time rate of the light emission period in one frame period. More specifically, the image signal processing section 18 decreases the values of the luminance information IR, IG, and IB included in the image signal Sdisp, based on an instruction from the control section 17 to output the decreased values of the luminance information IR, IG, and IB as an image signal Sdisp2, and the power supply line drive section 32 of the drive section 30 extends the light emission period, based on the control signal CTL. Thus, in the display unit 1, while an average value of luminance per frame period is maintained, the pixel voltage Vsig is allowed to be decreased; therefore, deterioration in image quality due to leakage from the capacitor device Cs or the like is allowed to be reduced.

It is to be noted that, in this example, the control section 17 instructs the image signal processing section 18 to decrease the values of the luminance information IR, IG, and IB; however, this embodiment is not limited thereto. Alternatively, for example, the control section 17 may instruct the data line drive section 33 to decrease the pixel voltage Vsig by changing a reference voltage of the DAC 34.

Moreover, the control section 17 also has a function of setting the light-emission duty ratio DUTY in a case where the intermittent writing operation B is performed, based on the writing stop frame number NF, the burn-in level LB, the temperature information Stemp, and the outside-light information Si and giving an instruction to the drive section 40 through the control signal CTL.

Figure 9:
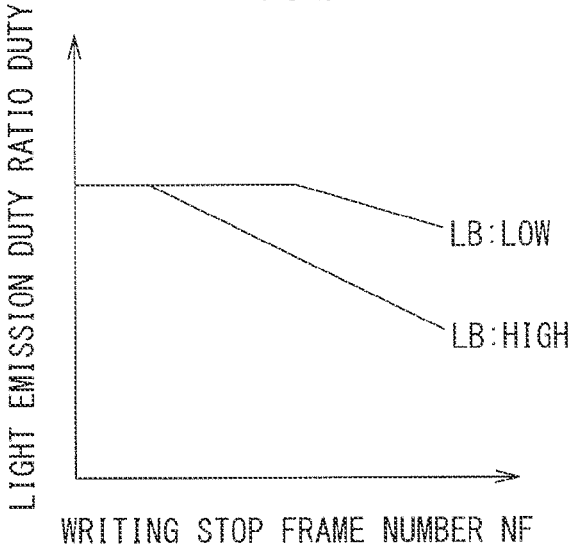
FIG. 9 is an explanatory diagram illustrating another operation example of the control section illustrated in FIG. 1.

FIG. 9 illustrates a relationship between the writing stop frame number NF and the burn-in level LB, and the light-emission duty ratio DUTY. In this example, the control section 17 keeps the light-emission duty ration DUTY constant in a case where the writing stop frame number NF is lower than a predetermined number, and in a case where the writing stop frame number is larger than the predetermined number, the larger the wiring stop frame number NF is, the more the control section 17 decreases the light-emission duty ratio DUTY. In other words, the larger the writing stop frame number NF is, the higher the stationary level LS becomes, and the more likely burn-in is to occur; therefore, the control section 17 sets the light-emission duty ratio DUTY to a small value. Moreover, in this example, as the burn-in level LB increases, the control section 17 allows the light-emission duty ratio DUTY to start changing at a smaller writing stop frame number NF, and increases the degree of change in the light-emission duty ratio DUTY. In other words, the higher the burn-in level LB is, the more likely burn-in is to occur; therefore, the control section 17 sets the light-emission duty ratio DUTY to a small value. Therefore, in the display unit 1, a possibility of occurrence of burn-in is allowed to be reduced by repeatedly displaying a same image.

Figure 10:
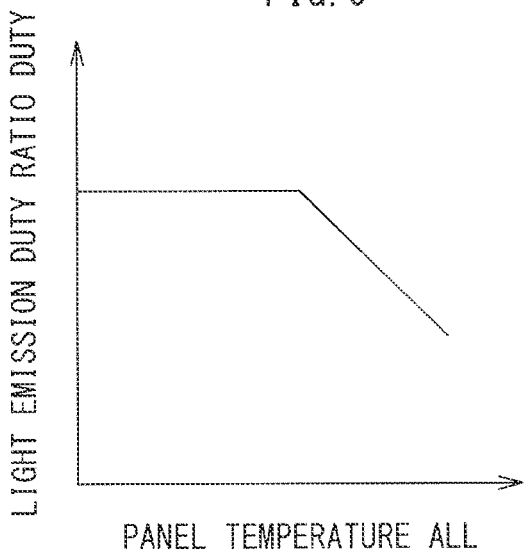
FIG. 10 is an explanatory diagram illustrating another operation example of the control section illustrated in FIG. 1.

FIG. 10 illustrates a relationship between the average luminance level ALL and the light-emission duty ratio DUTY. In this example, the control section 17 keeps the light-emission duty ratio DUTY constant in a case where the average luminance level ALL is lower than a predetermined level, and in a case where the average luminance level ALL is higher than the predetermined level, the higher the average luminance level ALL is, the more the control section 17 decreases the light-emission duty ratio DUTY. In other words, an image with a high average luminance level ALL may impose a burden to eyes of a user. Therefore, in a case where the average luminance level ALL is high, the control section 17 so operates as to decrease the light-emission duty ratio DUTY, thereby decreasing an average value of luminance per frame period. Thus, in the display unit 1, the burden on the eyes of the user is allowed to be reduced.

Figure 11:
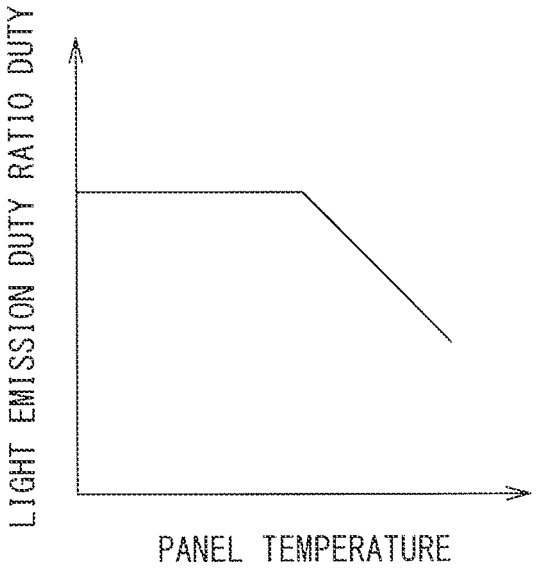
FIG. 11 is an explanatory diagram illustrating another operation example of the control section illustrated in FIG. 1.

FIG. 11 illustrates a relationship between the panel temperature indicated by the temperature information Stemp and the light-emission duty ratio DUTY. In this example, in a case where the panel temperature is lower than a predetermined temperature, the control section 17 keeps the light-emission duty ratio DUTY constant, and in a case where the panel temperature is higher than the predetermined temperature, the higher the panel temperature is, the more the control section 17 decreases the light-emission duty ratio DUTY. Therefore, in the display unit 1, an increase in the panel temperature is allowed to be reduced.

Figure 12:
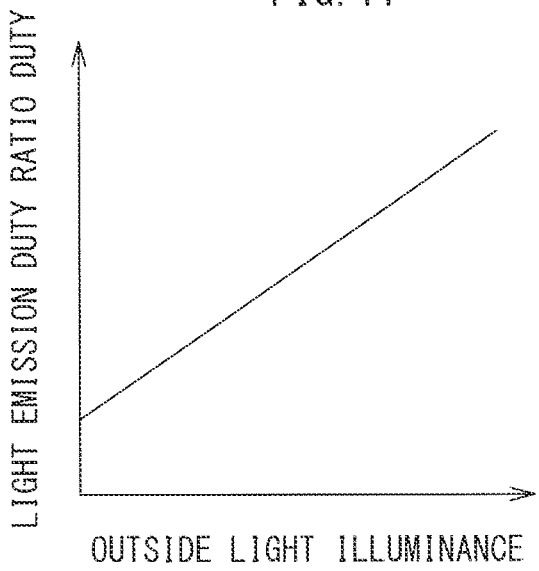
FIG. 12 is an explanatory diagram illustrating another operation example of the control section illustrated in FIG. 1.

FIG. 12 illustrates a relationship between outside-light illuminance indicated by the outside-light information Si and the light-emission duty ratio DUTY. In this example, the higher the outside-light illuminance is, the more the control section 17 increases the light-emission duty ratio DUTY. In other words, in a case where the outside-light illuminance is high, it may be difficult for the user to view a display image. Therefore, in a case where the outside-light illuminance is high, the control section 17 increases the light-emission duty ratio DUTY to increase the average value of luminance per frame period. Thus, in the display unit 1, in a bright environment, visibility is allowed to be enhanced by performing display with high luminance, and in a dark environment, power consumption is allowed to be reduced by performing display with low luminance.

Moreover, the control section 17 also has a function of setting an operation of the display unit 1, based on operation mode information Smode. The operation mode information Smode indicates an operation mode of the display unit 1. The operation mode information Smode is supplied from a system of an electronic apparatus to which the display unit 1 is applied, and, for example, the operation mode information Smode is set, based on setting of power consumption of the electronic apparatus and an application. Examples of the operation mode may include a normal mode and a plurality of low power consumption modes (smallest, small, middle, and the like). The control section 17 sets the writing stop frame number NF, based on the operation mode information Smode. More specifically, the control section 17 so sets the writing stop frame number NF as to increase the writing stop frame number NF in order of the normal mode, a low power consumption mode (middle), a low power consumption mode (small), and a low power consumption mode (smallest). Moreover, the control section 17 sets the light-emission duty ratio DUTY in the normal operation A1 and A2 and the light-emission duty ration DUTY in the intermittent writing operation B, based on the operation mode information Smode. Therefore, in the display unit 1, setting of power consumption and setting of image quality are allowed to be performed more freely, based on setting of power consumption of the electronic apparatus and the application.

The image signal processing section 18 is configured to perform predetermined image signal processing on the image signal Sdisp, based on an instruction from the control section 17 and output a result of the processing as the image signal Sdisp2. More specifically, as described above, the image signal processing section 18 has a function of decreasing the values of the luminance information IR, IG, and IB included in the image signal Sdisp and outputting the decreased values of the luminance information IR, IG, and IB as the image signal Sdisp2 when the intermittent writing operation B is performed.

Moreover, as will be described later, the image signal processing section 18 also has a function of gradually setting the values of the luminance information IR, IG, and IB included in the image signal Sdisp to a low value in the refresh operation B3 and performing processing (so-called orbit processing) in which a frame image is gradually moved in the display region of the display section 40.

It is to be noted that, in this example, in the refresh operation B3, the image signal processing section 18 gradually sets the values of the luminance information IR, IG, and IB to a low value; however, this embodiment is not limited thereto. Alternatively, for example, the pixel voltage Vsig may be gradually decreased by changing the reference voltage of the DAC 34 of the data line drive section 33.

The sub-pixel 9 corresponds to a specific example of "unit pixel" in an embodiment of the present disclosure. A drive allowing the sub-pixel 9 to perform the normal operation A1 corresponds to a specific example of "first drive" in an embodiment of the present disclosure. A drive allowing the sub-pixel 9 to perform the before-stop operation B1 corresponds to a specific example of "second drive" in an embodiment of the present disclosure. A drive allowing the sub-pixel 9 to perform the writing stop operation B2 corresponds to a specific example of "third drive" in an embodiment of the present disclosure. A drive allowing the sub-pixel 9 to perform the refresh operation B3 corresponds to a specific example of "fourth drive" in an embodiment of the present disclosure. The driving transistor DRTr corresponds to a specific example of "first transistor" in an embodiment of the present disclosure. The writing transistor WSTr corresponds to a specific example of "second transistor" in an embodiment of the present disclosure. The voltage Vini corresponds to a specific example of "first voltage" in an embodiment of the present disclosure.

[Operation and Functions]

Next, an operation and functions of the display unit 1 according to this embodiment will be described below.

(Outline of Entire Operation)

First, an outline of an entire operation of the display unit 1 will be described below referring to FIG. 1 and the like. The detection section 20 generates the stationary level LS, the burn-in level LB, and the average luminance level ALL, based on the image signal Sdisp. The temperature detection section 14 detects the temperature (the panel temperature) of the display section 40. The outside-light detection section 15 detects brightness (outside-light illuminance) of an environment where the display unit 1 is placed. The control section 17 controls the image signal processing section 18 and the drive section 30, based on the image signal Sdisp, the stationary level LS, the burn-in level LB, the average luminance level ALL, the temperature information Stemp, the outside-light information Si, and the mode information Smode. More specifically, when the intermittent writing operation B is performed, the control section 17 instructs the image signal processing section 18 to decrease the values of the luminance information IR, IG, and IB, and instructs the drive section 30 through the control signal CTL to extend the light emission period. Moreover, the control section 17 sets the writing stop frame number NF in each of the segment regions RD, based on the stationary level LS and the luminance information IR, IG, and IB. Further, the control section 17 sets the light-emission duty ratio DUTY in a case where the intermittent writing operation B is performed, based on the writing stop frame number NF, the burn-in level LB, the temperature information Stemp, and the outside-light information Si, and instructs the drive section 30 through the control signal CTL. The image signal processing section 18 performs the predetermined image signal processing on the image signal Sdisp, based on an instruction from the control section 17, and outputs a result of the processing as the image signal Sdisp2. The drive section 30 drives the display section 40, based on the image signal Sdisp2 supplied from the image signal processing section 18 and the control signal CTL supplied from the control section 17. The display section 40 displays an image, based on a drive by the drive section 30.

(Specific Operation)

A specific operation of the sub-pixel 9 will be described below. First, the normal operation A1 will be described, and then the writing stop operation B2 will be described. It is to be noted that the normal operation A2, the before-stop operation B1, and the refresh operation B3 are similar to the normal operation A1, and will not be described.

Figure 13:
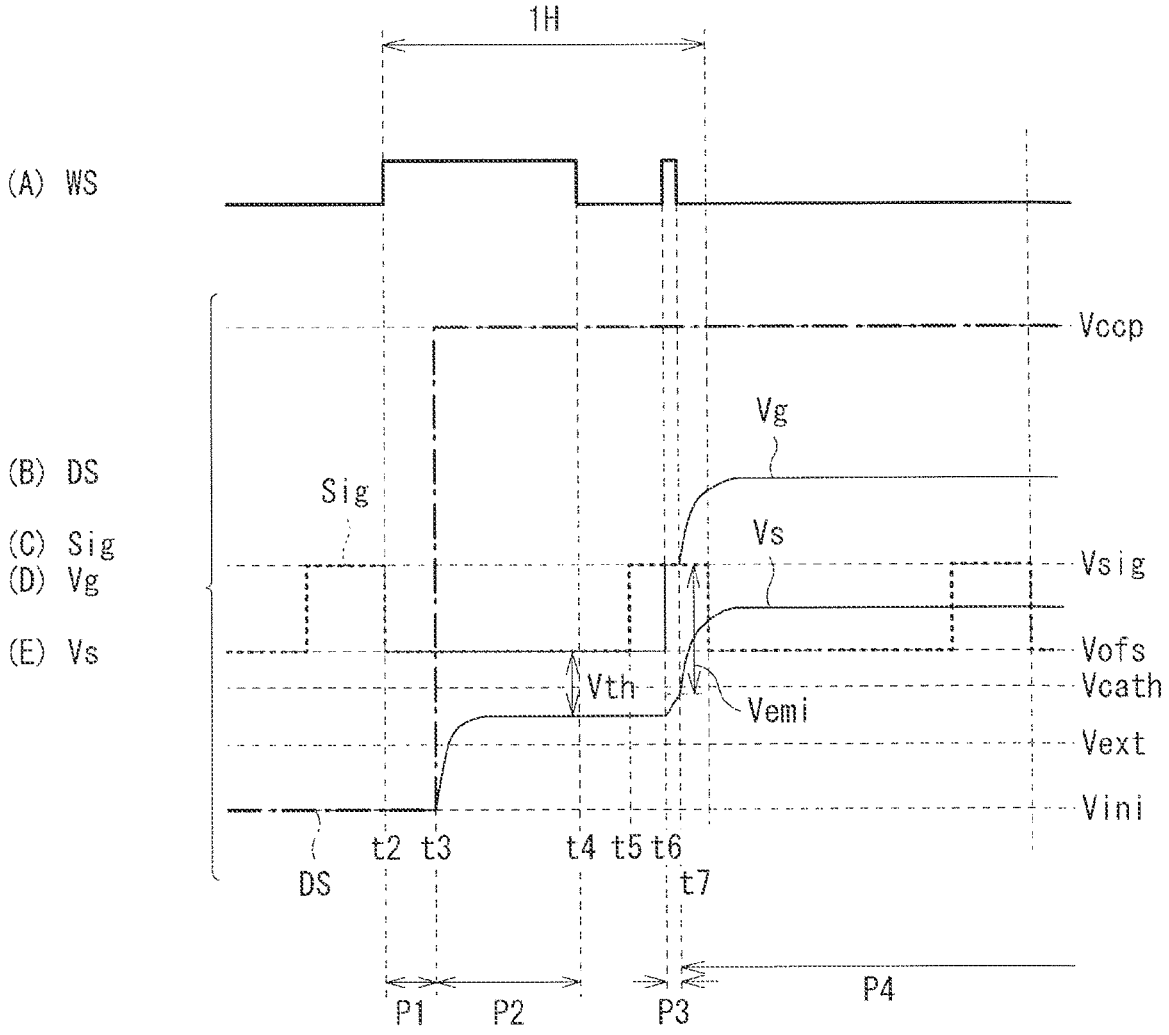
FIG. 13 is a timing waveform diagram illustrating an operation example of the sub-pixel illustrated in FIG. 2.

FIG. 13 illustrates a timing chart of the normal operation A1 of the sub-pixel 9. This chart illustrates an operation example of a display drive on one target sub-pixel 9. In FIG. 13, a part (A) indicates a waveform of the scanning signal WS, a part (B) indicates a waveform of the power supply signal DS, a part (C) indicates a waveform of the signal Sig, a part (D) indicates a waveform of a gate voltage Vg of the driving transistor DRTr, and a part (E) indicates a waveform of a source voltage Vs of the driving transistor DRTr. In the parts (B) to (E) in FIG. 13, respective waveforms are illustrated with use of a same voltage axis.

The drive section 30 performs initialization of the sub-pixel 9 in one horizontal period (1 H) (an initialization period P1), performs Vth correction (a Vth correction period P2) to reduce the influence of device variation of the driving transistor DRTr exerted on image quality, and performs μ (mobility) correction (a writing•μ correction period P3) different from the Vth correction while performing writing of the pixel voltage Vsig on the sub-pixel 9. Then, after that, the light-emitting device 49 of the sub-pixel 9 emits light with luminance according to the written pixel voltage Vsig (a light emission period P4). A specific description about this operation will be given below.

First, the power supply line drive section 32 sets the power supply signal DS to a voltage Vini before the initialization period P1 (refer to the part (B) in FIG. 13). Accordingly, the driving transistor DRTr is turned to an ON state, and the source voltage Vs of the driving transistor DRTr is set to the voltage Vini (refer to the part (E) in FIG. 13).

Next, the drive section 30 initializes the sub-pixel 9 in a period from a timing t2 to a timing t3 (the initialization period P1). More specifically, at the timing t2, the data line drive section 33 sets the signal Sig to a voltage Vofs (refer to the part (C) in FIG. 13), and the scanning line drive sections 31A and 31B change the voltage of the scanning signal WS from a low level to a high level (the part (A) in FIG. 13). Accordingly, the writing transistor WSTr is turned to an ON state, and the gate voltage Vg of the driving transistor DRTr is set to the voltage Vofs (refer to the part (D) in FIG. 13). Thus, a gate-source voltage Vgs (=Vofs−Vini) of the driving transistor DRTr is set to a larger voltage than a threshold voltage Vth of the driving transistor DRTr to initialize the sub-pixel 9.

Next, the drive section 30 performs Vth correction in a period from the timing t3 to a timing t4 (the Vth correction period P2). More specifically, the power supply line drive section 32 changes the power supply signal DS from the voltage Vini to the voltage Vccp at the timing t3 (refer to the part (B) in FIG. 13). Accordingly, the driving transistor DRTr operates in a saturation region, and a current Ids flows from the drain to the source to increase the source voltage Vs (refer to the part (E) in FIG. 13). At this time, in this example, since the source voltage Vs is lower than a voltage Vcath of a cathode of the light-emitting device 49, the light-emitting device 49 keeps a reverse vias state, and a current does not flow through the light-emitting device 49. Thus, the gate-source voltage Vgs is decreased by increasing the source Vs in such a manner; therefore, the current Ids is decreased. The current Ids is converged toward "0" (zero) by this reverse feedback operation. In other words, the gate-source voltage Vgs of the driving transistor DRTr is so converged as to be equal to the threshold voltage Vth of the driving transistor DRTr (Vgs=Vth).

Next, the scanning line drive sections 31A and 31B change the voltage of the scanning signal WS from the high level to the low level at the timing t4 (refer to the part (A) in FIG. 13). Accordingly, the writing transistor WSTr is turned to an OFF state. Then, the data line drive section 33 sets the signal Sig to the pixel voltage Vsig at a timing t5 (refer to the part (C) in FIG. 13).

Next, the drive section 30 performs μ correction while performing writing of the pixel voltage Vsig on the sub-pixel 9 in a period from a timing t6 to a timing t7 (the writing•μ correction period P3). More specifically, the scanning line drive sections 31A and 31B change the voltage of the scanning signal WS from the low level to the high level at the timing t6 (refer to the part (A) in FIG. 13). Accordingly, the writing transistor WSTr is turned to the ON state, and the gate voltage Vg of the driving transistor DRTr increases from the voltage Vofs to the pixel voltage Vsig (refer to the part (D) in FIG. 13). At this time, the gate-source voltage Vgs of the driving transistor DRTr becomes larger than the threshold voltage Vth (Vgs>Vth), and the current Ids flows from the drain to the source; therefore, the source voltage Vs of the driving transistor DRTr is increased (refer to the part (E) in FIG. 13). By such a negative feedback operation, the influence of device variation of the driving transistor DRTr is reduced (μ correction), and the gate-source voltage Vgs of the driving transistor DRTr is set to a voltage Vemi according to the pixel voltage Vsig. It is to be noted that such a μ correction method is described in, for example, Japanese Unexamined Patent Application Publication No. 2006-215213.

Next, the drive section 30 allows the sub-pixel 9 to emit light in a period from the timing t7 onward (the light emission period P4). More specifically, at the timing t7, the scanning line drive sections 31A and 31B change the voltage of the scanning signal WS from the high level to the low level (refer to the part (A) in FIG. 13). Accordingly, the writing transistor WSTr is turned to the OFF state, and the gate of the driving transistor DRTr is turned to a floating state; therefore, a voltage between terminals of the capacitor device Cs, i.e., the gate-source voltage Vgs of the driving transistor DRTr is maintained from this timing onward. Then, as the current Ids flows through the driving transistor DRTr, the source voltage Vs of the driving transistor DRTr increases (refer to the part (E) in FIG. 13), and the gate voltage Vg of the driving transistor DRTr increases accordingly (refer to the part (D) in FIG. 13). Then, when the source voltage Vs of the driving transistor DRTr becomes higher than the sum (Vel+Vcath) of the threshold voltage Vel and the voltage Vcath of the light-emitting device 49, a current flows between the anode and the cathode of the light-emitting device 49 to allow the light-emitting device 49 to emit light. In other words, the source voltage Vs is increased only by an amount according to device variation of the light-emitting device 49 to allow the light-emitting device 49 to emit light.

After that, the drive section 30 changes the power supply signal DS from a voltage Vccp to the voltage Vini after a lapse of a period corresponding to the light-emission duty ratio DUTY to finish the light emission period P4. It is to be noted that, in the normal operation A1, the light emission period P4 is finished by changing the power supply signal DS from the voltage Vccp to the voltage Vini in such a manner; however, in the normal operation A2, the before-stop operation B1, and the refresh operation B3, the light emission period P4 is finished by changing the power supply signal DS from the voltage Vccp to the voltage Vext.

Figure 14:
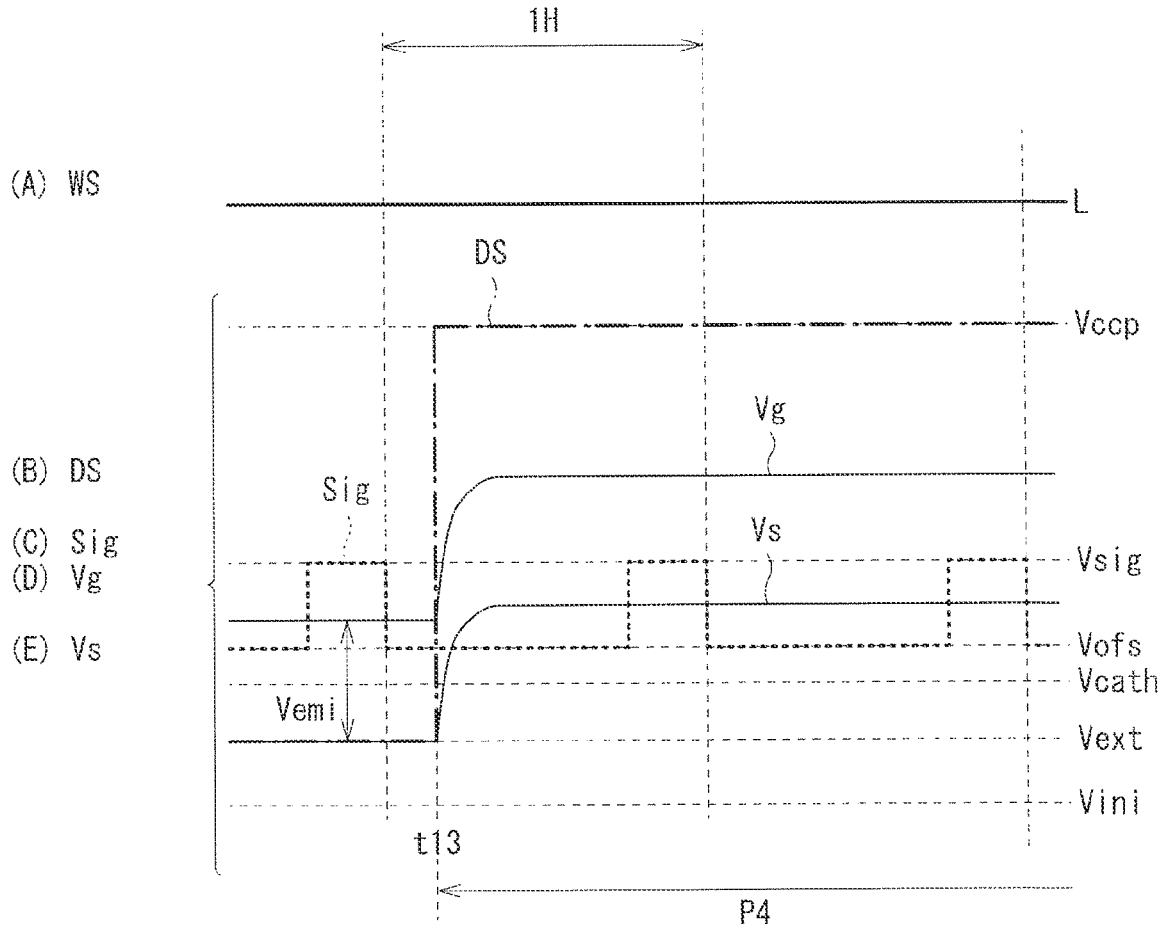
FIG. 14 is a timing waveform diagram illustrating another operation example of the sub-pixel illustrated in FIG. 2.

FIG. 14 illustrates a timing chart of the writing stop operation B2 of the sub-pixel 9, where a part (A) indicates a waveform of the scanning signal WS, a part (B) indicates a waveform of the power supply signal DS, a part (C) indicates a waveform of the signal Sig, a part (D) indicates a waveform of the gate voltage Vg of the driving transistor DRTr, and a part (E) indicates a waveform of the source voltage Vs of the driving transistor DRTr.

In the writing stop operation B2, the voltage of the scanning signal WS is constantly at the low level. Therefore, since the writing transistor WSTr is thereby maintained in the OFF state, the gate-source voltage Vgs of the driving transistor DRTr is maintained at the voltage Vemi set in the writing•μ correction period P3. It is to be noted that, in this description, for the sake of convenience, leakage from the capacitor device Cs is not considered.

First, the power supply line drive section 32 sets the power supply signal DS to the voltage Vext (refer to the part (B) in FIG. 14). Accordingly, the driving transistor DRTr is turned to the ON state, and the source voltage Vs of the driving transistor DRTr is set to the voltage Vext (refer to the part (E) in FIG. 14).

Then, the drive section 30 allows the sub-pixel 9 to emit light in a period from a timing t13 onward (the light emission period P4). More specifically, the power supply line drive section 32 changes the power supply signal DS from the voltage Vext to the voltage Vccp at the timing t13 (refer to the part (B) in FIG. 14). Accordingly, the driving transistor DRTr operates in the saturation region, the current Ids flows from the drain to the source, and the source voltage Vs of the driving transistor DRTr increases (refer to the part (E) in FIG. 14), and the gate voltage Vg of the driving transistor DRTr increases accordingly (refer to the part (D) in FIG. 14). Then, when the source voltage Vs of the driving transistor DRTr becomes higher than the sum (Vel+Vcath) of the threshold voltage Vel and the voltage Vcath of the light-emitting device 49, a current flows between the anode and the cathode of the light-emitting device 49 to allow the light-emitting device 49 to emit light. In other words, the source voltage Vs is increased only by an amount corresponding to the device variation of the light-emitting device 49 to allow the light-emitting device 49 to emit light.

After that, the drive section 30 changes the power supply signal DS from the voltage Vccp to the voltage Vext after a lapse of the period corresponding to the light-emission duty ratio DUTY to finish the light emission period P4.

Next, a specific operation of the drive section 30 will be described below.

Figure 15:
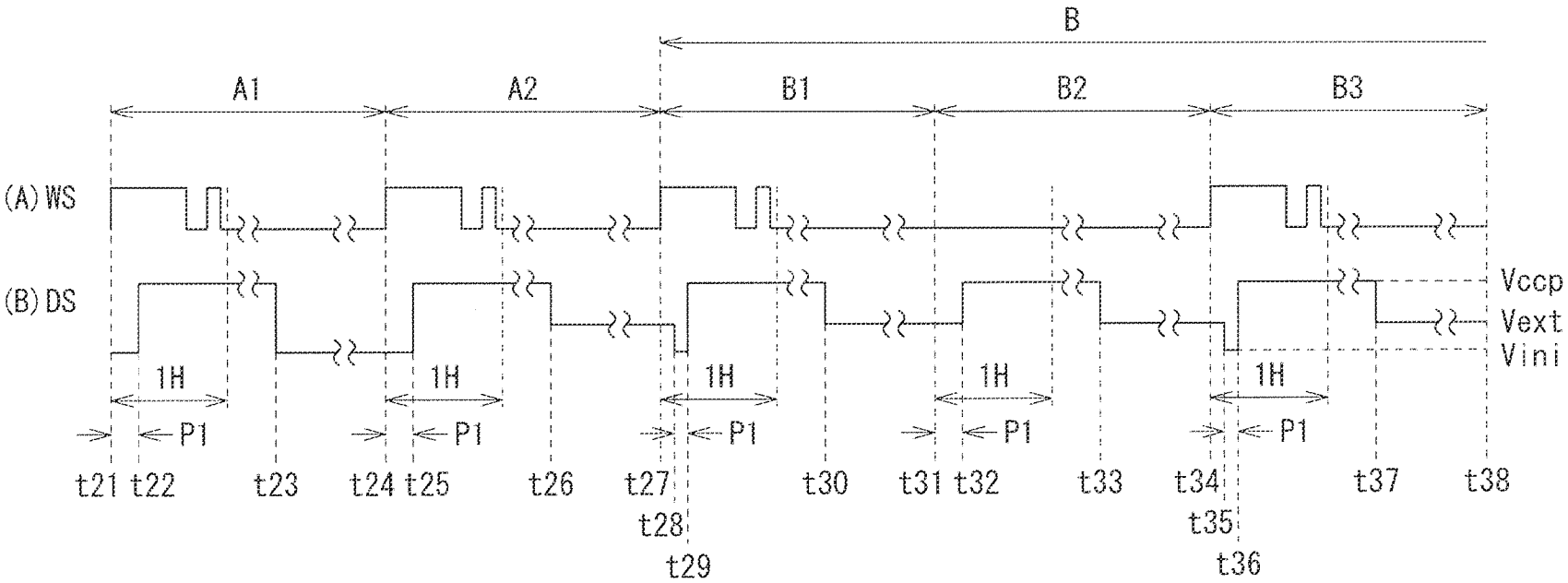
FIG. 15 is a timing waveform diagram illustrating an operation example of the drive section illustrated in FIG. 2.

FIG. 15 illustrates a timing chart of a driving operation of the drive section 30, where a part (A) indicates a waveform of the scanning signal WS, and a part (B) indicates a waveform of the power supply signal DS. In this example, the sub-pixel 9 performs the normal operations A1 and A2 before a timing t27, and performs the intermittent writing operation B in a period from the timing t27 onward. In this case, time lengths of a period from a timing t21 to a timing 24, a period from the timing t24 to the timing 27, a period from the timing t27 to a timing 31, and a period from the timing t31 to a timing t34, and a period from the timing t34 to a timing 38 are equal to that of time T of one frame period.

First, in the period from the timing t21 to the timing t24, the sub-pixel 9 performs the normal operation A1. More specifically, first, as with the case in FIG. 13, the drive section 30 generates the scanning signal WS in one horizontal period from the timing t21 onward (refer to the part (A) in FIG. 15), and at the timing t22 in the one horizontal period, the power supply signal DS is changed from the voltage Vini to the voltage Vccp (refer to the part (B) in FIG. 15). Accordingly, as with the case in FIG. 13, the sub-pixel 9 performs the initialization operation in a period from the timing t21 to the timing 22 (the initialization period P1), and after that, the sub-pixel 9 performs the Vth correction, the writing operation, the μ correction, and a light emission operation. Then, the drive section 30 changes the power supply signal DS from the voltage Vccp to the voltage Vini at the timing t23 (refer to the part (B) in FIG. 15). Thus, the sub-pixel 9 stops emitting light from the timing t23 onward.

Next, in the period from the timing t24 to the timing t27, the sub-pixel 9 performs the normal operation A2. More specifically, the drive section 30 generates the scanning signal WS and the power supply signal DS in a period from the timing t24 to the timing t26 in a way similar to that in a period from the timing t21 to the timing t23. Accordingly, as with the normal operation A1, the sub-pixel 9 performs the initialization operation in a period from the timing t24 to the timing t25 (the initialization period P1), and after that, the sub-pixel 9 performs the Vth correction, the writing operation, the μ correction, and the light emission operation. Then, the drive section 30 changes the voltage of the power supply signal DS from the voltage Vccp to the voltage Vext at the timing t26 (refer to the part (B) in FIG. 15). Thus, the sub-pixel 9 stops emitting light from the timing t26 onward.

Next, in the period from the timing t27 to the timing t31, the sub-pixel 9 performs the before-stop operation B1. More specifically, first, as with a case in FIG. 13, the drive section 30 generates the scanning signal WS in one horizontal period from the timing t27 (refer to the part (A) in FIG. 15). Moreover, the drive section 30 changes the power supply signal DS from the voltage Vext to the voltage Vini at the timing t28 in the one horizontal period, and as with the normal operations A1 and A2, the drive section 30 changes the power supply signal DS from the voltage Vini to the voltage Vccp at the timing t29 in the one horizontal period (refer to the part (B) in FIG. 15). Accordingly, the sub-pixel 9 performs the initialization operation in a shorter period (from the timing t28 to the timing t29) than that in the normal operations A1 and A2, and after that, the sub-pixel 9 performs the Vth correction, the writing operation, the μ correction, and the light emission operation. Then, the drive section 30 changes the voltage of the power supply signal DS from the voltage Vccp to the voltage Vext at the timing t30 (refer to the part (B) in FIG. 15). Thus, the sub-pixel 9 stops emitting light from the timing t30 onward.

Next, in the period from the timing t31 to the timing t34, the sub-pixel 9 performs the writing stop operation B2. More specifically, first, the drive section 30 maintains the voltage (at the low level) of the scanning signal WS in one horizontal period from the timing t31 onward, and at the timing t32 in the one horizontal period, the drive section30 changes the power supply signal DS from the voltage Vext to the voltage Vccp (refer to the part (B) in FIG. 15). Accordingly, the sub-pixel 9 performs the light emission operation from the timing t32 onward. Then, the drive section 30 changes the voltage of the power supply signal DS from the voltage Vccp to the Vext at the timing t33 (refer to the part (B) in FIG. 15). Thus, the sub-pixel 9 stops emitting light from the timing t33 onward.

Next, in the period from the timing t34 to the timing t38, the sub-pixel 9 performs the refresh operation B3. In this example, the refresh operation B3 is similar to the before-stop operation B1 (from the timing t34 to the timing t37).

Thus, in the display unit 1, the before-stop operation B1 is performed between the normal operations A1 and A2 and the writing stop operation B2, and the initialization operation is performed only in a short period (from the timing t28 to the timing t29); therefore, the possibility of deterioration in image quality is allowed to be reduced. In other words, while the power supply signal DS is changed from the voltage Vini to the voltage Vccp at the timing t25 in the normal operations A1 and A2, the power supply voltage DS is changed from the voltage Vext to the voltage Vccp at the timing t32 in the writing stop operation B2. In short, since the initial value of the power supply signal DS differs between the normal operations A1 and A2 and the writing stop operation B2, light emission characteristics may differ. More specifically, for example, a rising time of luminance when changing from a light extinction state to a light emission state and luminance in the light emission state may differ between the normal operations A1 and A2 and the writing stop operation B2. In the display unit 1, the before-stop operation B1 is performed between the normal operations A1 and A2 and the writing stop operation B2, and the initialization operation is performed by setting the power supply signal DS to the voltage Vini only in a short period (from the timing t28 to the timing t29) before changing the power supply signal DS from the voltage Vini to the voltage Vccp at the timing t29. Accordingly, in the before-stop operation B1, light emission characteristics intermediate between light emission characteristics in the normal operations A1 and A2 and light emission characteristics in the writing stop operation B2 are allowed to be achieved, and a possibility that the light emission characteristics abruptly change is allowed to be reduced; therefore, the possibility of deterioration in image quality is allowed to be reduced.

Moreover, in a case where there is a difference in light emission characteristics between the normal operations A1 and A2 and the writing stop operation B2 in such a manner, the difference in light emission characteristics may be reduced by adjusting the light-emission duty ratio DUTY or the voltage Vccp of the power supply signal DS in the following manner instead of performing the before-stop operation B1.

Figure 16A:
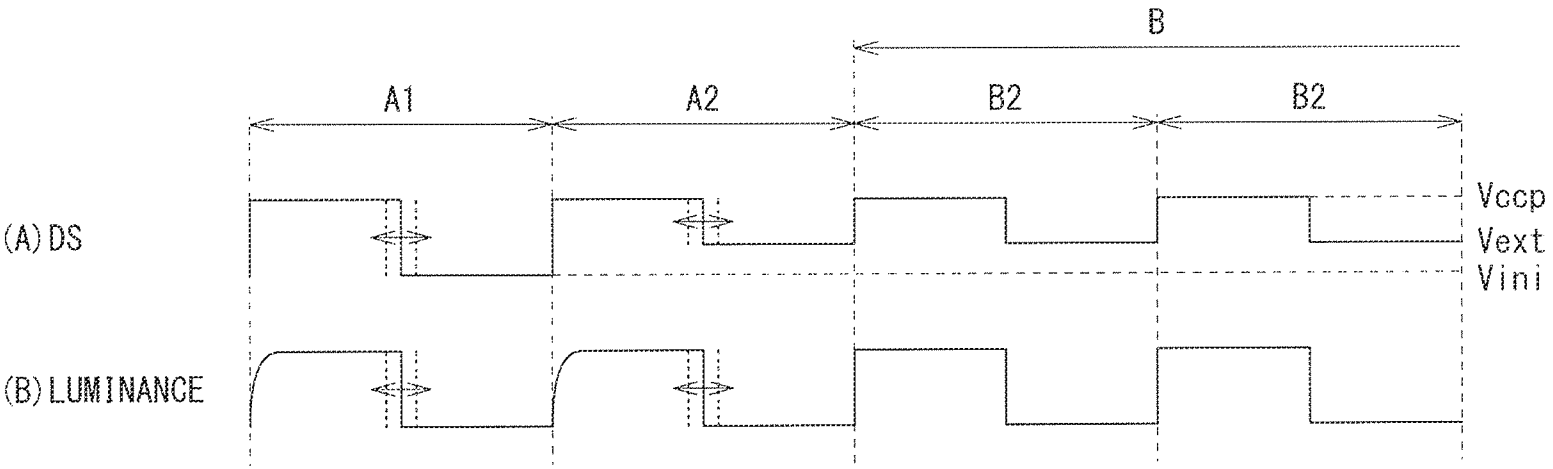
FIG. 16A is a timing waveform diagram illustrating an operation example of the drive section and the display section illustrated in FIG. 2.
Figure 16B:
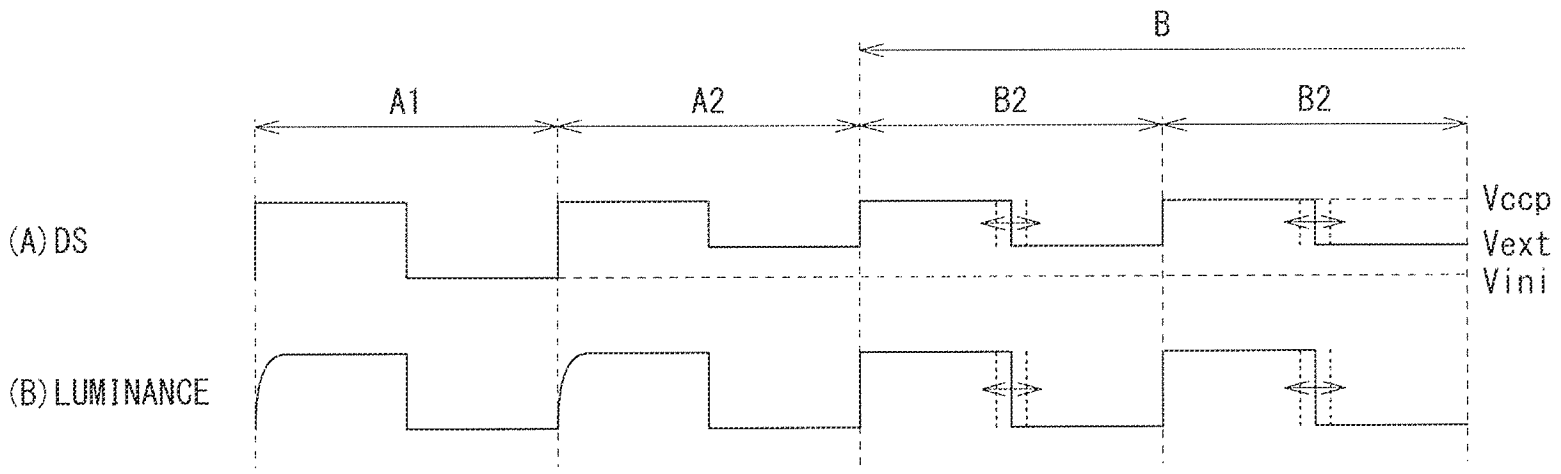
FIG. 16B is a timing waveform diagram illustrating another operation example of the drive section and the display section illustrated in FIG. 2.

FIGS. 16A and 16B illustrate an operation in a case where the light-emission duty ratio DUTY is adjusted. In FIGS. 16A and 16B, a part (A) indicates a waveform of the power supply signal DS, a part (B) indicates luminance of the sub-pixel 9 to which the power supply signal DS in the part (A) is supplied. In an example in FIG. 16A, the light-emission duty ratio DUTY in the normal operations A1 and A2 is adjusted, and in an example in FIG. 16B, the light-emission duty ratio DUTY in the intermittent writing operation B is adjusted.

Figure 17A:
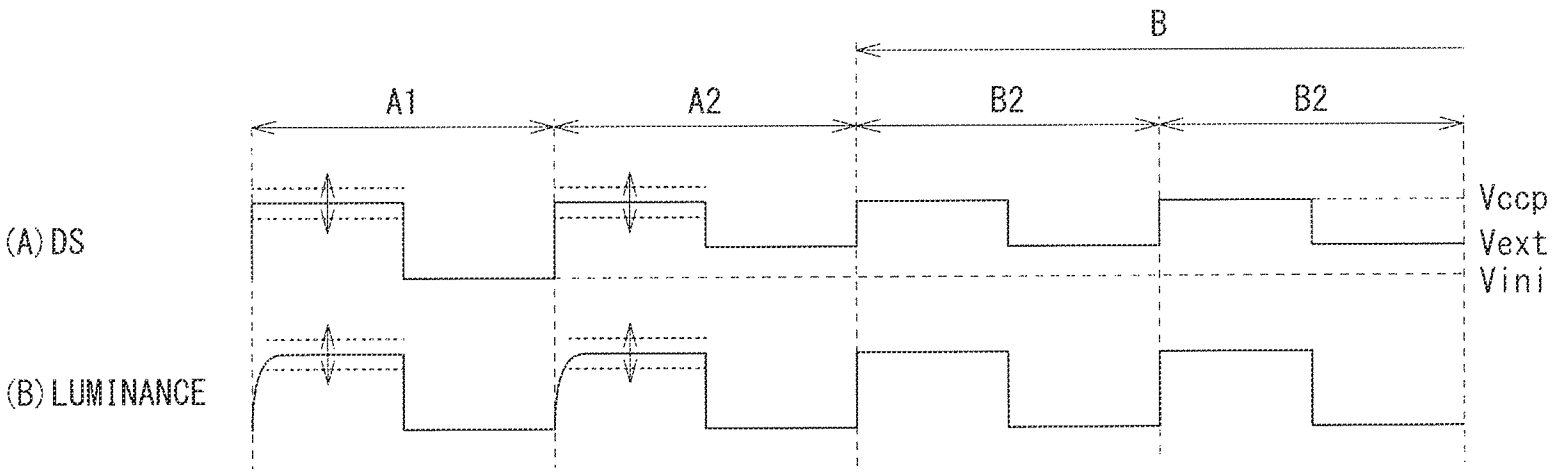
FIG. 17A is a timing waveform diagram illustrating another operation example of the drive section and the display section illustrated in FIG. 2.
Figure 17B:
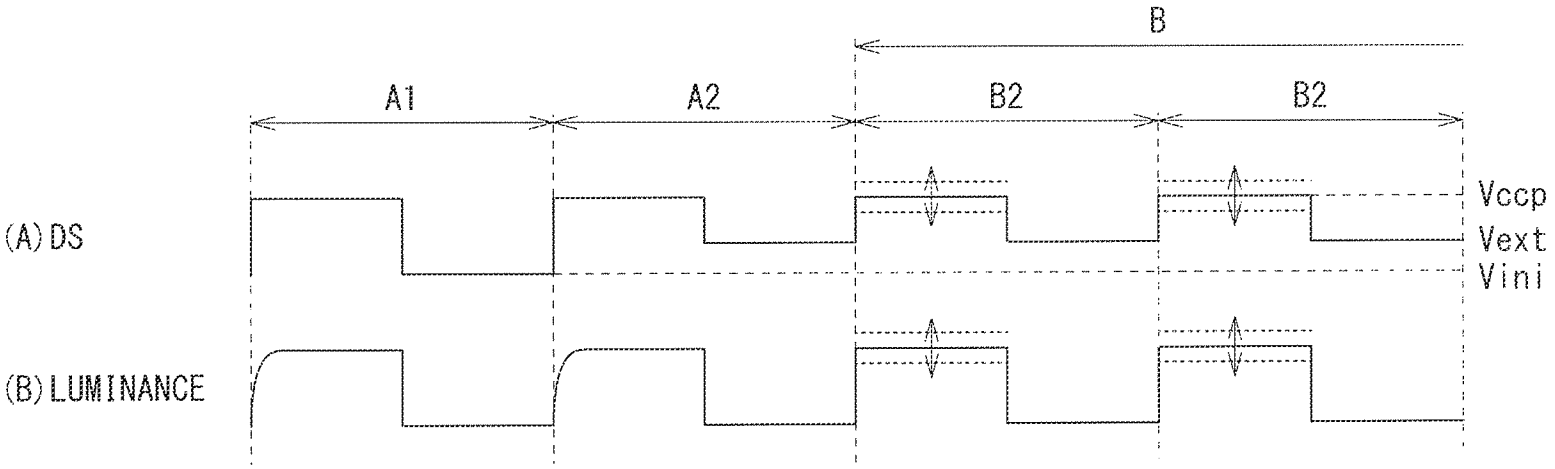
FIG. 17B is a timing waveform diagram illustrating another operation example of the drive section and the display section illustrated in FIG. 2.

FIGS. 17A and 17B illustrate an operation in a case where the voltage Vccp of the power supply signal DS is adjusted. In FIGS. 17A and 17B, a part (A) indicates a waveform of the power supply signal DS and a part (BI indicates luminance of the sub-pixel 9 to which the power supply signal DS in the part (A) is supplied. In an example in FIG. 17A, the voltage Vccp in the normal operations A1 and A2 is adjusted, and in an example in FIG. 17B, the voltage Vccp in the intermittent writing operation B is adjusted.

Moreover, in the intermittent writing operation B, the stationary level LS is high; therefore, there is a possibility that the user perceives so-called flicker in an image. In such a case, as will be described below, for example, a plurality of light emission periods P4 may be provided to one frame period.

Figure 18:
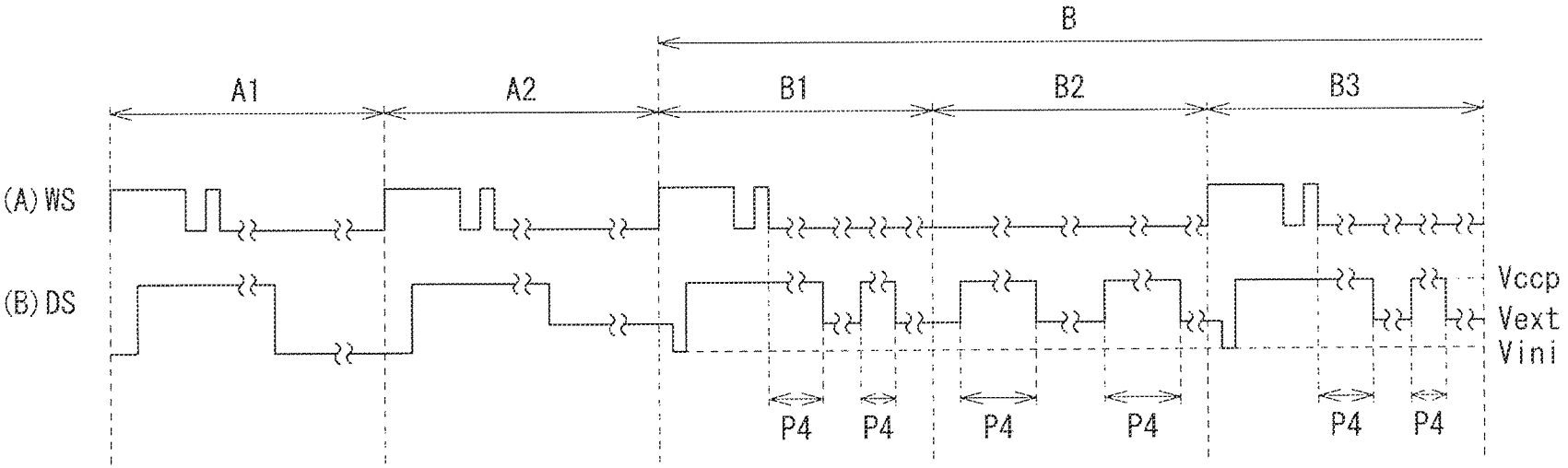
FIG. 18 is a timing waveform diagram illustrating another operation example of the display section illustrated in FIG. 2.

FIG. 18 illustrates an operation in a case where a plurality of light emission periods P4 are provided in one frame period in the intermittent writing operation B. In this example, two light emission periods P4 are provided in each of the before-stop operation B1, the writing stop operation B2, and the refresh operation B3. At this time, respective time lengths of the light emission periods P4 are so set as to maintain an average value of luminance per frame period. At this time, the time lengths of the two light emission periods P4 may be equal to or different from each other.

It is to be noted that, in this example, two light emission periods P4 are provided to each writing stop operation B2; however, the number of the light emission periods P4 is not limited thereto. Alternatively, three or more light emission periods P4 may be provided. More specifically, the frequency of light emission may preferably be a frequency at which the user is less likely to perceive flicker (for example, 70 times per second).

Moreover, the image signal processing section 18 gradually sets the values of the luminance information IR, IG, and IB included in the image signal Sdisp to a low value in the refresh operation B3, and performs processing (so-called orbit processing) in which a frame image is gradually moved in the display region of the display section 40. This operation will be described in detail below.

Figure 19:
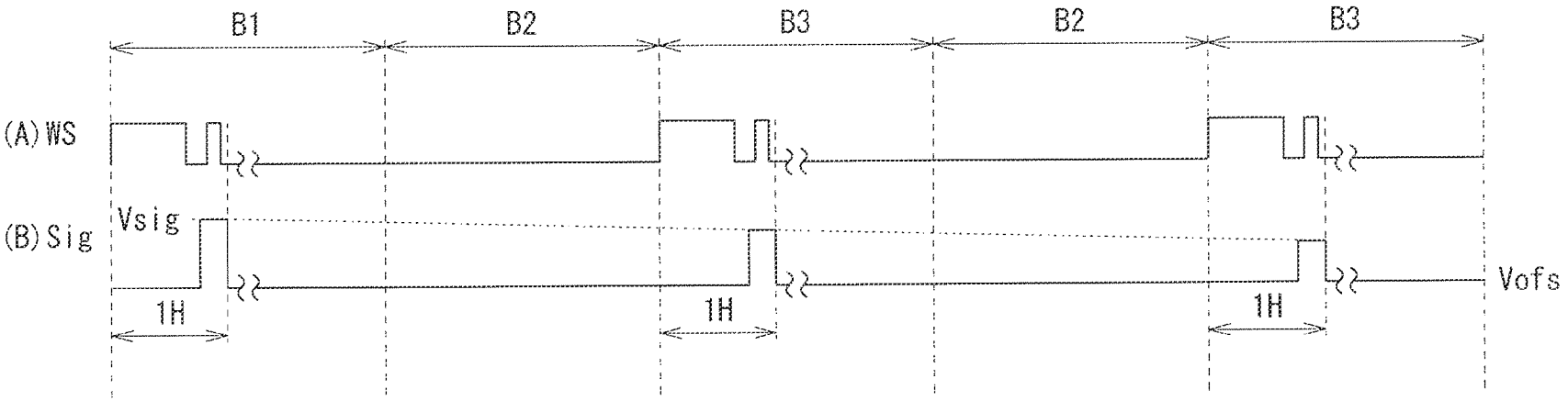
FIG. 19 is a timing waveform diagram illustrating another operation example of the drive section illustrated in FIG. 2.

FIG. 19 illustrates an operation of changing the luminance information IR, IG, and IB in the image signal processing section 18, where a part (A) indicates a waveform of the scanning signal WS, and a part (B) indicates a waveform of the signal Sig. In this example, in the before-stop operation B1, the data line drive section 33 of the drive section 30 generates the pixel voltage Vsig, based on the luminance information IR, IG, and IB. Then, in a first refresh operation B3 after that, the image signal processing section 18 changes the values of the luminance information IR, IG, and IB included in the image signal Sdisp to a slightly lower value, and the data line drive section 33 generates the pixel voltage Vsig, based on the changed luminance information IR, IG, and IB. Then, in the next refresh operation B3, the image signal processing section 18 changes the values of the luminance information IR, IG, and IB included in the image signal Sdisp to a further lower value, and the data line drive section 33 generates the pixel voltage Vsig, based on the changed luminance information IR, IG, and IB. Thus, the image signal processing section 18 gradually sets the values of the luminance information IR, IG, and IB included in the image signal Sdisp to a lower value in every refresh operation B3. At this time, the image signal processing section 18 changes the values of the luminance information IR, IG, and IB within a range in which change in the values is not visible by the user. Then, the image signal processing section 18 decreases the values of the luminance information IR, IG, and IB to a predetermined value, and then maintains the values.

Thus, in the display unit 1, the values of the luminance information IR, IG, and IB are gradually set to a lower value in every refresh operation B3 in the intermittent writing operation B; therefore, while a possibility that the user feels discomfort is reduced, a possibility of occurrence of burn-in is allowed to be reduced. In other words, in the intermittent writing operation B, the stationary level LS is high, and there is the possibility of occurrence of burn-in; therefore, for example, the possibility of occurrence of burn-in may be preferably reduced by decreasing the pixel voltage Vsig. At this time, for example, when the pixel voltage Vsig is abruptly decreased, the user may feel discomfort. In the display unit 1, the image signal processing section 18 gradually sets the values of the luminance information IR, IG, and IB to a lower value in every refresh operation B3; therefore, while the possibility that the user feels discomfort is reduced, the possibility of occurrence of burn-in is allowed to be reduced.

Figure 20:
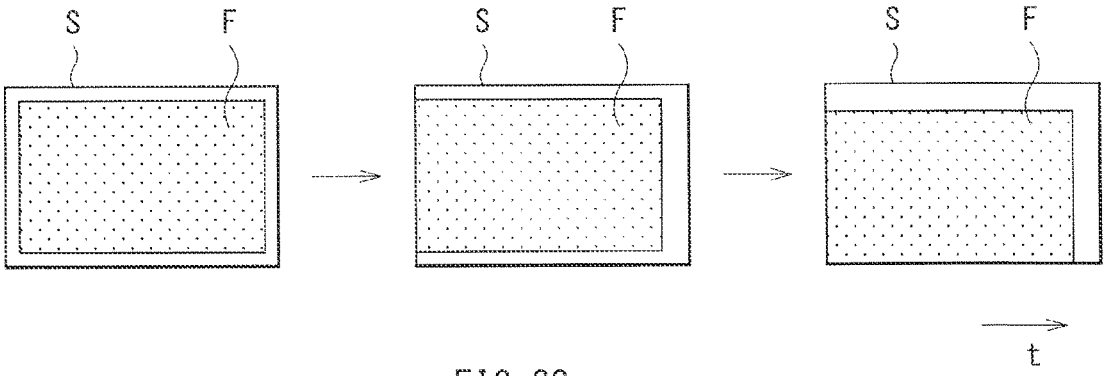
FIG. 20 is an explanatory diagram illustrating an operation example of an image signal processing section illustrated in FIG. 1.

FIG. 20 schematically illustrates the orbit processing in the image signal processing section 18. As illustrated in FIG. 20, the image signal processing section 18 gradually moves a frame image F in the display region S of the display section 40 in the refresh operation B3. This processing may be performed in every refresh operation B3, or a timer dedicated to this processing may be provided to perform this processing in every plurality of refresh operations B3. Therefore, in the display unit 1, the possibility of occurrence of burn-in is allowed to be reduced. In other words, in the intermittent writing operation B, the stationary level LS is high; therefore, in a case where such orbit processing is not performed, the sub-pixel 9 continues to intermittently emit light with same luminance, and burn-in may occur accordingly. On the other hand, in the display unit 1, in the refresh operation B3, the frame image F is gradually moved in the display region S of the display section 40 in such a manner; therefore, a possibility that some of the sub-pixels P continues to emit light with high luminance is allowed to be reduced; therefore, the possibility of occurrence of burn-in is allowed to be reduced.

In the display unit 1, in each of the plurality of segment regions RD, the stationary level LS is determined, and the writing drive is selectively performed on each of the segment regions RD; therefore, while the possibility of deterioration in image quality is reduced, power consumption is allowed to be reduced. In other words, for example, in a case where the stationary level LS is determined in the entire display region of the display section, and the writing drive on the entire display region is controlled, based on the stationary level LS, image quality mat be deteriorated, or power consumption may be increased. More specifically, when the stationary level LS is determined to be high in a case where only an image in a part of the display region has motion, the writing drive on the entire display region stops; therefore, the image in the part that has motion may be disturbed to cause deterioration in image quality. Moreover, when the stationary level LS is determined to be sufficiently low in a case where only an image in a portion of the display region has motion, the writing drive is performed on the entire display region; therefore, power consumption may be increased. On the other hand, in the display unit 1, the stationary level LS is determined in each of the plurality of segment regions RD, and the writing drive is performed on each of the segment regions RD. Therefore, the writing drive on the segment region RD in which the stationary level LS is high is allowed to stop, and the writing drive is allowed to be performed on the segment region RD in which the stationary level LS is low; therefore, while the possibility of deterioration in image quality is reduced, power consumption is allowed to be reduced.

[Effects]

As described above, in this embodiment, the intermittent writing operation is performed, and the before-stop operation is performed between the normal operation and the writing stop operation; therefore, while the possibility of deterioration in image quality is reduced, power consumption is allowed to be reduced.

In this embodiment, in the before-stop operation, the initialization operation is performed only in a short period; therefore, the possibility of deterioration in image quality is allowed to be reduced.

In this embodiment, the stationary level is determined in each of the plurality of segment regions, and the writing drive is selectively performed in each of the segment regions; therefore, while the possibility of deterioration in image quality is reduced, power consumption is allowed to be reduced.

[Modification Example 1-1]

In the above-described embodiment, as illustrated in FIG. 3, the display region of the display section 40 is partitioned into four segment regions RD; however, the number of the segment regions RD is not limited thereto. This modification example will be described in detail below referring to some examples.

Figure 21:
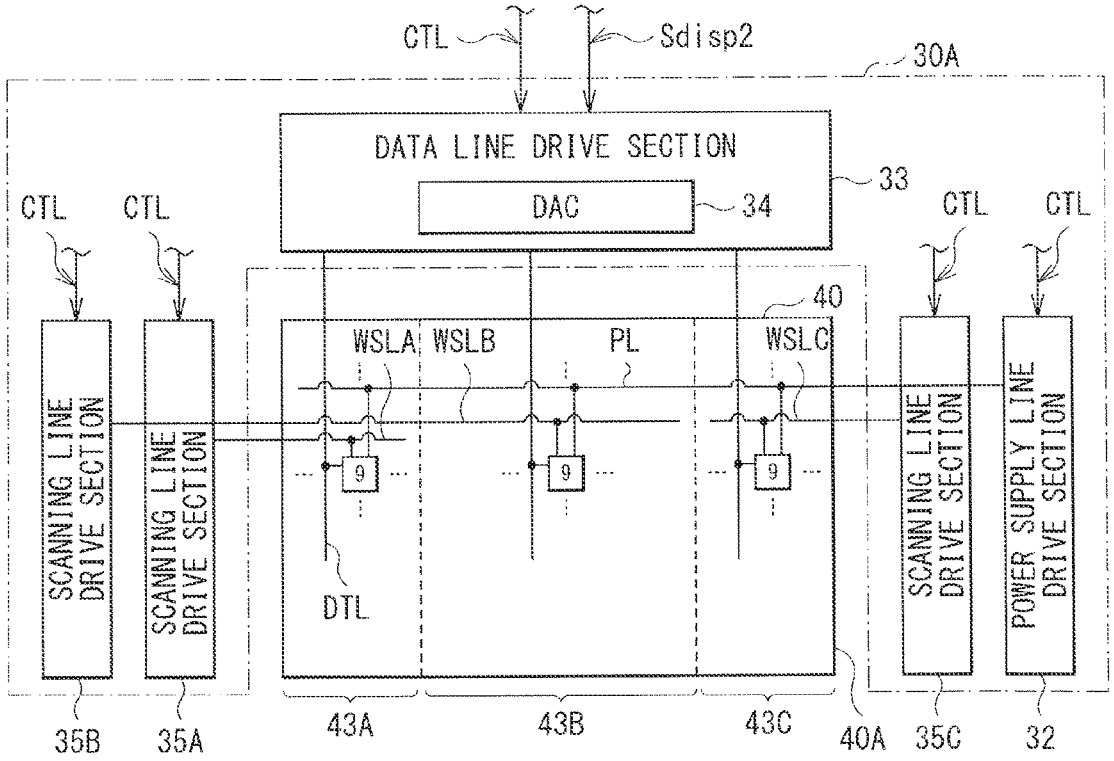
FIG. 21 is a block diagram illustrating a configuration example of a drive section and a display section according to a modification example of the first embodiment.
Figure 22:
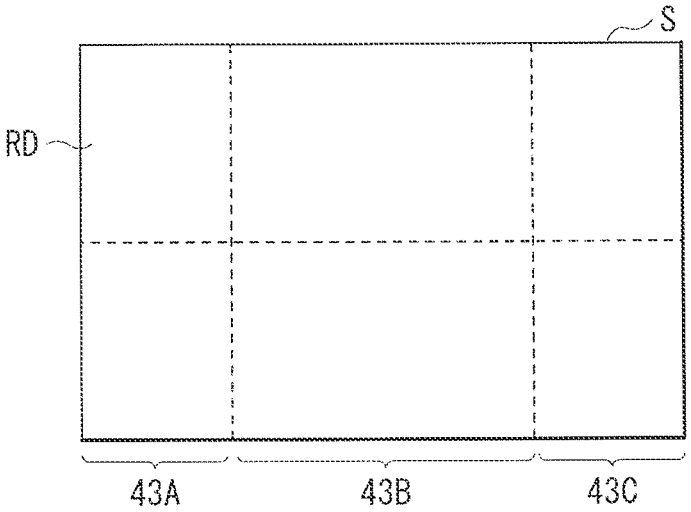
FIG. 22 is an explanatory diagram illustrating segment regions in the display section illustrated in FIG. 21.

FIG. 21 illustrates a configuration example of a display section 40A and a drive section 30A according to this modification example. FIG. 22 illustrates segment regions RD of the display section 40A. The display region of the display section 40A is partitioned into three regions 43A, 43B, and 43C along a row direction. In this example, the three regions 43A, 43B, and 43C are provided in this order from the left to the right in the display region of the display section 40A. The display section 40A includes a plurality of scanning lines WSLA extending along the row direction in the region 43A, a plurality of scanning lines WSLB extending along the row direction in the region 43B, a plurality of scanning WSLC extending along the row direction in the region 43C, a plurality of power supply lines PL extending along the row direction in the regions 43A, 43B, and 43C, and a plurality of data lines DTL extending along a column direction. The drive section 30A includes scanning line drive sections 35A, 35B, and 35C. First ends of the scanning lines WSLA are connected to the scanning line drive section 35A, first ends of the scanning lines WSLB are connected to the scanning line drive section 35B, and first ends of the scanning lines WSLC are connected to the scanning line drive section 35C. Six segment regions RD are provided to a display region S of the display section 40A. More specifically, two segment regions RD are provided in a top half and a bottom half of the region 43A of the display region S, two segment regions RD are provided in a top half and a bottom half of the region 43B of the display region S, and two segment regions RD are provided in a top half and a bottom half of the region 43C of the display region S.

In the display section 40A according to this modification example, the display region is partitioned into three regions 43A, 43B, and 43C along the row direction; however, the number of the regions is not limited thereto, and alternatively, the display region may be partitioned into, for example, four or more regions. Moreover, like a display section 40B that will be described below, the display region S may not be partitioned along the row direction.

Figure 23:
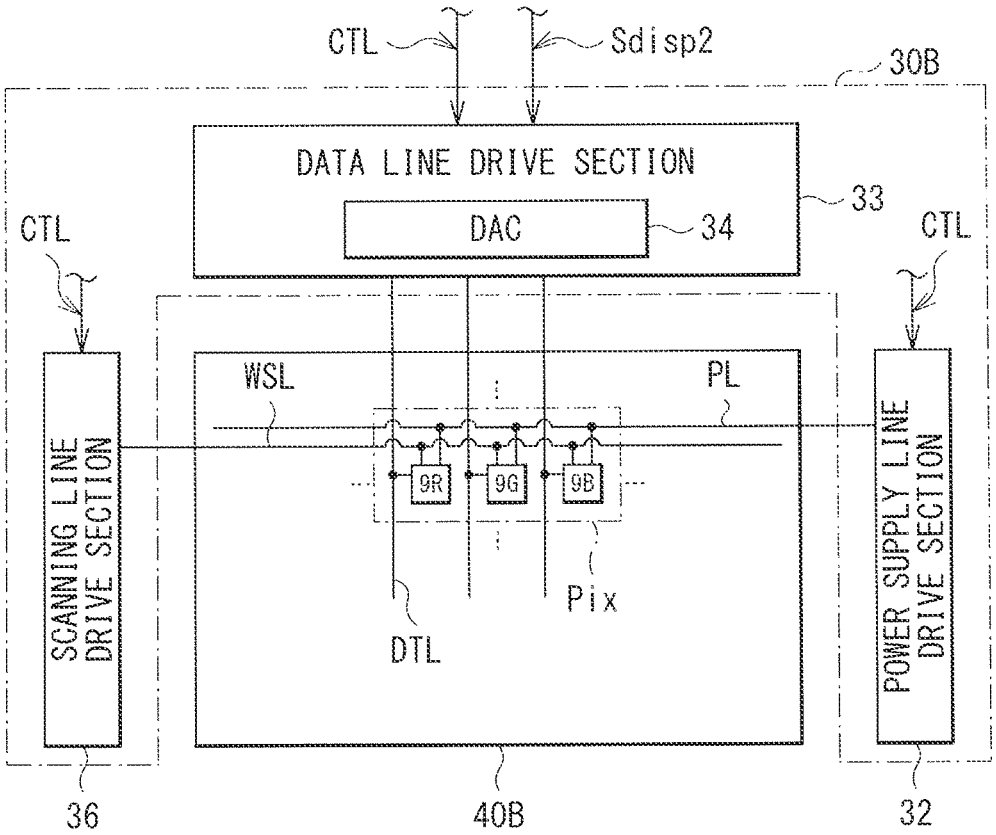
FIG. 23 is a block diagram illustrating a configuration example of a drive section and a display section according to another modification example of the first embodiment.
Figure 24:
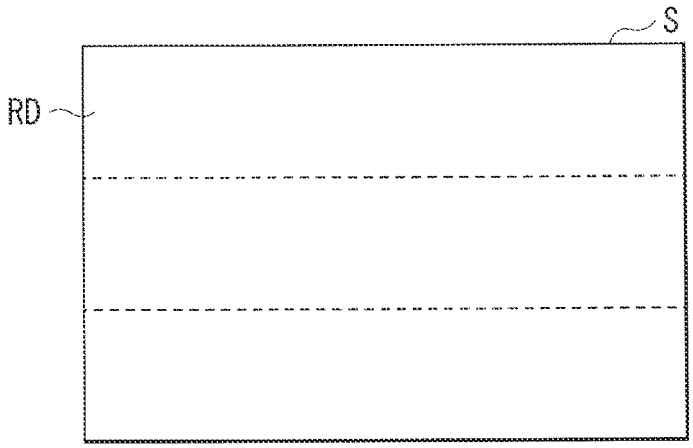
FIG. 24 is an explanatory diagram illustrating segment regions in the display section illustrated in FIG. 23.

FIG. 23 illustrates a configuration example of a display section 40B and a drive section 30B according to this modification example. FIG. 24 illustrates segment regions RD of the display section 40B. The display section 40B includes a plurality of scanning lines WSL extending along a row direction, a plurality of power supply lines extending along the row direction, and a plurality of data lines DTL extending along a column direction. The drive section 30B includes a scanning line drive section 36. First ends of the scanning lines WSL are connected to the scanning line drive section 36. Three segment regions RD are arranged side by side along the column direction in the display region S of the display section 40B.

In the above examples, the scanning lines WSLs and the like and the power supply lines PL extending along a horizontal direction in the diagrams and the data lines DTL extending along a vertical direction in the diagrams are provided; however, this modification example is not limited thereto. Alternatively, like a drive section 30C that will be described below, for example, the scanning lines WSL and the power supply lines PL extending along a vertical direction in a diagram and the data lines DTL extending along a horizontal direction in the diagram may be provided.

Figure 25:
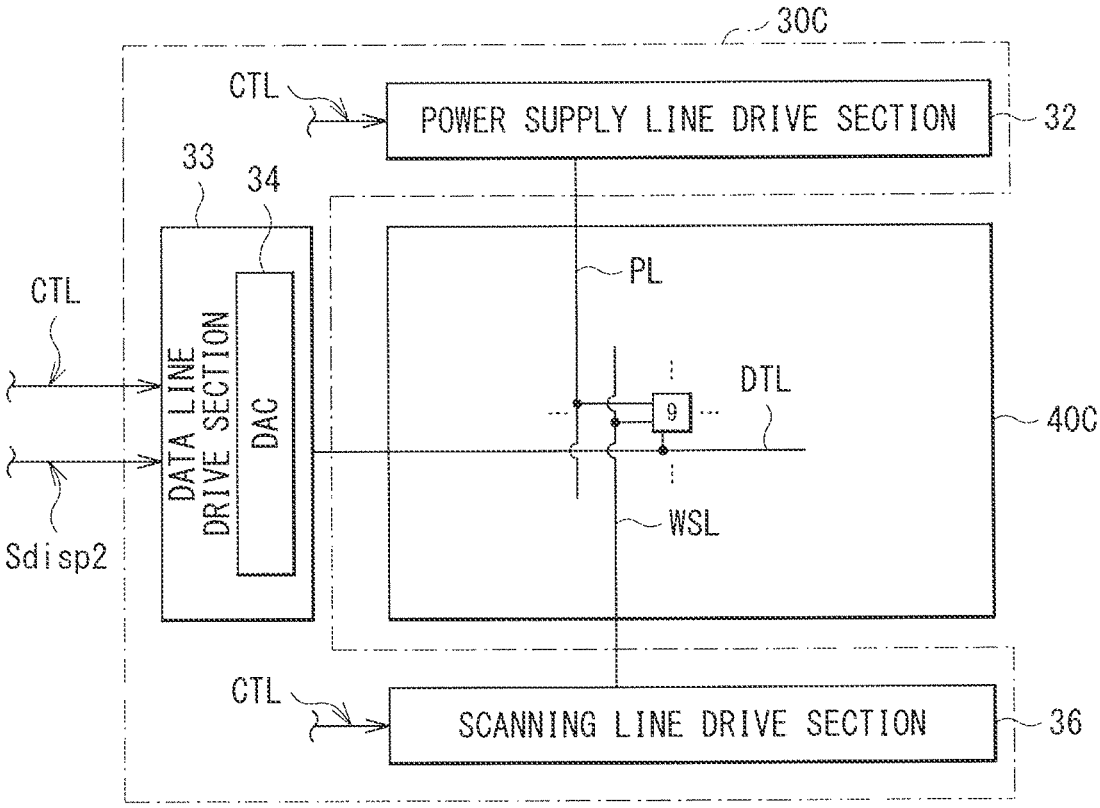
FIG. 25 is a block diagram illustrating a configuration example of a drive section and a display section according to another modification example of the first embodiment.
Figure 26:
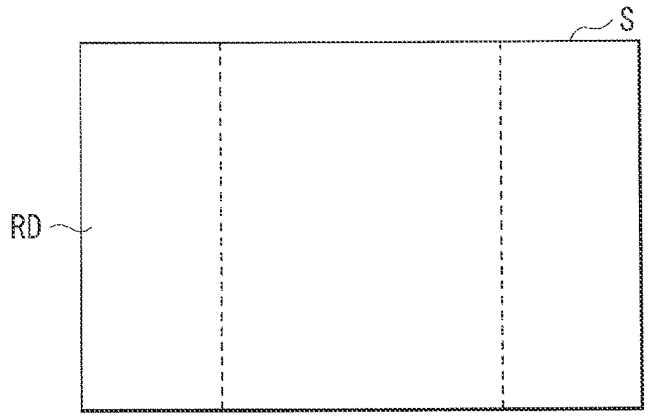
FIG. 26 is an explanatory diagram illustrating segment regions in the display section illustrated in FIG. 25.

FIG. 25 illustrates a configuration example of a display section 40C and the drive section 30C according to this modification example. FIG. 26 illustrates the segment regions RD of the display section 40C. The display section 40C includes a plurality of scanning lines WSL extending along a column direction (a vertical direction), a plurality of power supply lines PL extending along the column direction, and a plurality of data lines DTL extending along a row direction (a horizontal direction). Three segment regions RD are arranged side by side along the row direction in the display region S of the display section 40C.

[Modification Example 1-2]

In the above-described embodiment, the stationary level LS of each segment region RD is determined; however, this embodiment is not limited thereto. This modification example will be described in detail below referring to some examples.

A display unit 1D according to this modification example includes a stationary level calculation section 22D, a control section 17D, and the drive section 30B, and the display section 40B illustrated in FIG. 23. The stationary level calculation section 22D is configured to determine the stationary level LS in the entire display region of the display section 40B. The stationary level calculation section 22D may preferably calculate the stationary level LS, based on, for example, three or more frame images F. As with the control section 17 according to the above-described embodiment, the control section 17D is configured to determine the writing stop frame number NF, based on the stationary level LS and the frame rate FR, as illustrated in FIG. 6. At this time, the control section 17D determines the writing stop frame number NF in the entire display region of the display section 40B. Then, the control section 17D sets the segment regions RD, based on the writing stop frame number NF to control the writing drive on the entire display region.

Figure 27A:
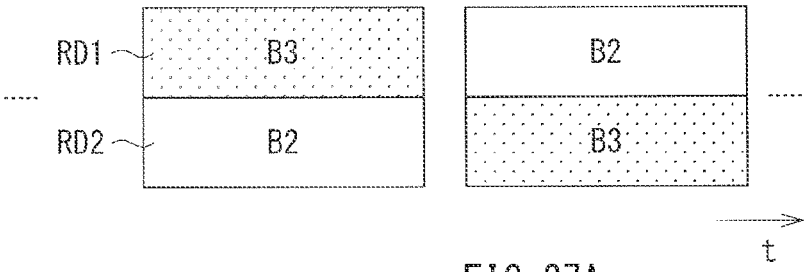
FIG. 27A is an explanatory diagram illustrating an operation example of a display unit according to another modification example of the first embodiment.
Figure 27B:
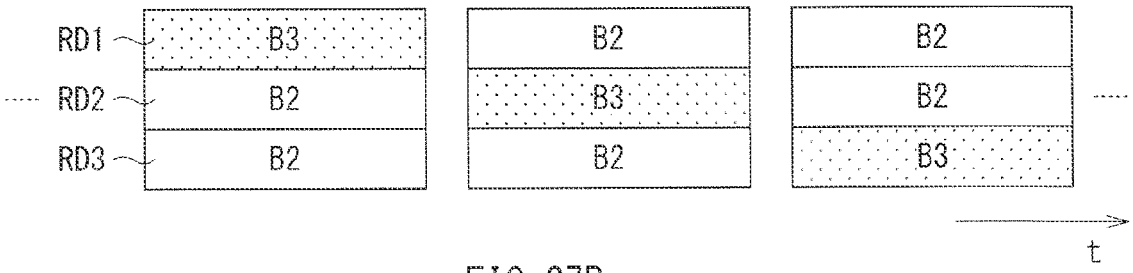
FIG. 27B is an explanatory diagram illustrating another operation example of a display unit according to another modification example of the first embodiment.

FIG. 27A illustrates an operation example of the display unit 1D in a case where the writing stop frame number NF is "1". FIG. 27B illustrates an operation example of the display unit 1D in a case where the writing stop frame number NF is "2".

In the case where the writing stop frame number NF is "1", as illustrated in FIG. 27A, the control section 17D sets two segment regions RD1 and RD2. In this case, the segment region RD1 is a top-half region in the display region S of the display section 40B, and the segment region RD2 is a bottom-half region in the display region S of the display section 40B. Then, in a certain frame period, the drive section 30B of the display unit 1D performs the writing drive on the segment region RD1, based on the luminance information IR, IG, and IB configuring a frame image F(n), and stops the writing drive on the segment region RD2. Accordingly, in this frame period, the sub-pixels 9 belonging to the segment region RD1 perform the refresh operation B3, and the sub-pixels 9 belonging to the segment region RD2 perform the writing stop operation B2. Then, in the next frame period, the drive section 30B of the display unit 1D stops the writing drive on the segment region RD1, and performs the writing drive on the segment region RD2, based on the luminance information IR, IG, and IB configuring the next frame image F(n+1). Accordingly, in this frame period, the sub-pixels 9 belonging to the segment region RD1 perform the writing stop operation B2, and the sub-pixels 9 belonging to the segment region RD2 perform the refresh operation B3. After that, the display unit 1D repeats the above operation. Thus, respective sub-pixels 9 in the segment regions RD1 and RD2 alternately repeat the writing operation (the refresh operation B3) and the writing stop operation B2 for one frame period. Therefore, the display unit 1D so operates as to allow the writing stop frame number NF to be "1" in such a manner.

In the case where the writing stop frame number NF is "2", as illustrated in FIG. 27B, the control section 17D sets three segment regions RD1 to RD3. In this case, the segment region RD1 is an upper one-third region of the display region S of the display section 40B, the segment region RD2 is a middle one-third region of the display region S of the display section 40B, and the segment region RD3 is a lower one-third region of the display region S of the display section 40B. Then, in a certain frame period, the drive section 30B of the display unit 1D performs the writing drive on the segment region RD1, based on the luminance information IR, IG, and IB configuring the frame image F(n), and stops the writing drive on the segment regions RD2 and RD3. Accordingly, in this frame period, the sub-pixels 9 belonging to the segment region RD1 perform the refresh operation B3, and the sub-pixels 9 belonging to the segment regions RD2 and RD3 perform the writing stop operation B2. Then, in the next frame period, the drive section 30B of the display unit 1D stops the writing drive on the segment regions RD1 and RD3, and performs the writing drive on the segment region RD2, based on the luminance information IR, IG, and IB configuring the next frame image F(n+1). Accordingly, in this frame period, the sub-pixels 9 belonging to the segment regions RD1 and RD3 perform the writing stop operation B2, and the sub-pixels 9 belonging to the segment region RD2 perform the refresh operation B3. Then, in a frame period after the next frame period, the drive section 30B of the display unit 1D stops the writing drive on the segment regions RD1 and RD2, and performs the writing drive on the segment region RD3, based on the luminance information IR, IG, and IB configuring the next frame image F(n+2). Thus, in this frame period, the sub-pixels 9 belonging to the segment regions RD1 and RD2 perform the writing stop operation B2, the sub-pixels 9 belonging to the segment region RD3 perform the refresh operation B3. After that, the display unit 1D repeats the above operation. Thus, respective sub-pixels 9 in the segment regions RD1 to RD3 alternately repeat the writing operation (the refresh operation B3) and the writing stop operation B2 for two frame periods. Therefore, the display unit 1D so operates as to allow the writing stop frame number NF to be "2".

Figure 28:
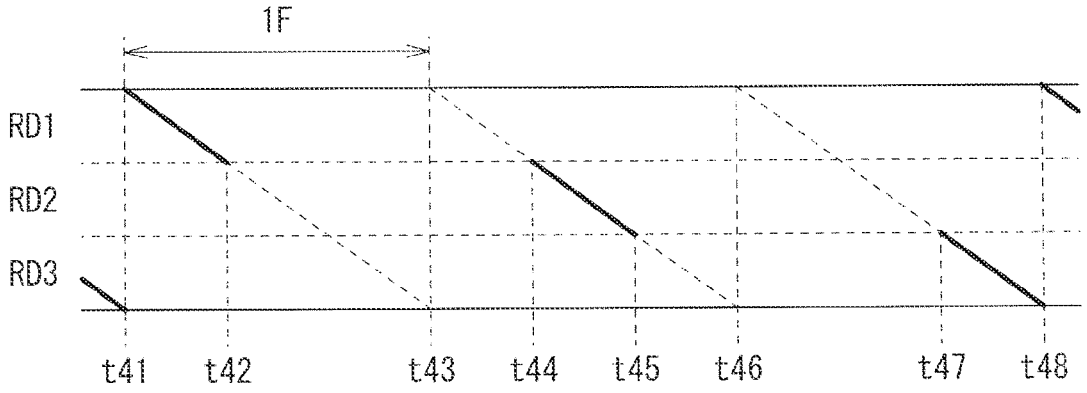
FIG. 28 is a timing chart illustrating an operation example of a display unit according to another modification example of the first embodiment.

FIG. 28 illustrates an operation example of scanning in the display unit 1D in the case where the writing stop frame number NF is "2". The scanning drive section 36 of the drive section 30B sequentially scans the sub-pixels 9 in the segment region RD1 in a period from a timing t41 to a timing t42 of a period (one frame period) from the timing t41 to a timing t43, and the power supply line drive section 32 of the drive section 30B sequentially scans the sub-pixels 9 in the segment regions RD1 to RD3 in the period (the one frame period) from the timing t41 to the timing t43. Accordingly, the sub-pixels 9 belonging to the segment region RD1 start the refresh operation B3, and the sub-pixels 9 belonging to the segment regions RD2 and RD3 start the writing stop operation B2. Next, the scanning drive section 36 of the drive section 30B sequentially scans the sub-pixels 9 in the segment region RD2 in a period from a timing t44 to a timing t45 of a period (one frame period) from the timing t43 to a timing t46, and the power supply line drive section 32 of the drive section 30B sequentially scans the sub-pixels 9 in the segment regions RD1 to RD3 in the period (one frame period) from the timing t43 to the timing t46. Accordingly, the sub-pixels 9 belonging to the segment regions RD1 and RD3 start the writing stop operation B2, and the sub-pixels 9 belonging to the segment region RD2 start the refresh operation B3. Next, the scanning drive section 36 of the drive section 30B sequentially scans the sub-pixels 9 in the segment region RD3 in a period from a timing t47 to a timing t48 of a period (one frame period) from the timing t46 to the timing t48, and the power supply line drive section 32 of the drive section 30B sequentially scans the sub-pixels 9 in the segment regions RD1 to RD3 in the period (one frame period) from the timing t46 to the timing t48. Thus, the sub-pixels 9 belonging to the segment regions RD1 and RD2 start the writing stop operation B2, and the sub-pixels 9 belonging to the segment region RD3 start the refresh operation B3.

Figure 29:
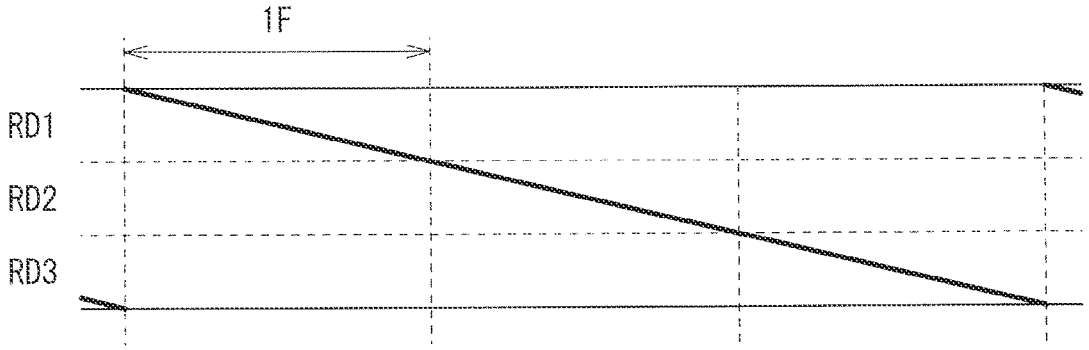
FIG. 29 is a timing chart illustrating an operation example of a display section according to another modification example of the first embodiment.

Even if the display unit is configured in such a manner, effects similar to those in the display unit 1 according to the above-described embodiment are allowed to be obtained. It is to be noted that, in the display unit 1D, for example, in about one-third of one frame period, one segment region RD is scanned; however, this modification example is not limited thereto. Alternatively, for example, as illustrated in FIG. 29, one segment region RD may be scanned in one frame period.

Next, another display unit 1E according to this modification example will be described below. The display unit 1E includes a stationary level calculation section 22E, a control section 17E, and the drive section 30B and the display section 40B illustrated in FIG. 23. The stationary level calculation section 22E is configured to determine the stationary level LS in the display region of the display section 40B. For example, in a case where the stationary level LS is smaller than a predetermined value, the control section 17E performs the writing drive on all of the sub-pixels 9 of the display section 40B. Accordingly, the respective sub-pixels 9 perform the normal operations A1 and A2. Moreover, for example, in a case where the stationary level LS is equal to or larger than the predetermined value, the control section 17E sets the sub-pixels 9 belonging to each row as one segment region RD, and as will be described below, like a so-called interlace operation, respective segment regions RD are driven.

Figure 30:
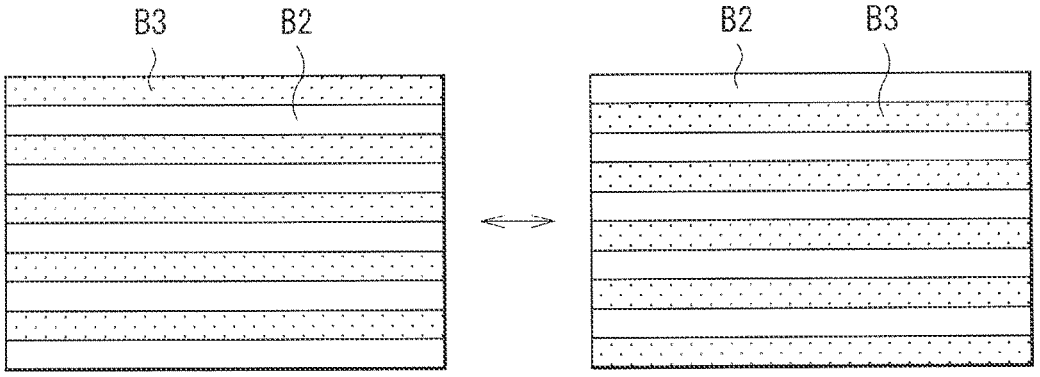
FIG. 30 is an explanatory diagram illustrating an operation example of a display unit according to another modification example of the first embodiment.

FIG. 30 illustrates an operation example of the display unit 1E in a case where the stationary level LS is equal to or larger than a predetermined value. In a certain frame period, the drive section 30B of the display unit 1E performs the writing drive on the sub-pixels 9 belonging to odd-numberth lines, based on the luminance information IR, IG, and IB configuring the frame image F(n), and stops the writing drive on the sub-pixels 9 belonging to even-numberth lines. Accordingly, in this frame period, the sub-pixels 9 belonging to the odd-numberth lines perform the refresh operation B3, and the sub-pixels 9 belonging to the even-numberth lines perform the writing stop operation B2. Then, in the next frame period, the drive section 30B stops the writing drive on the sub-pixels 9 belonging to the odd-numberth lines, and performs the writing drive on the sub-pixels 9 belonging to the even-numberth lines, based on the luminance information IR, IG, and IB configuring the next frame image F(n+1). Accordingly, in this frame period, the sub-pixels 9 belonging to the odd-numberth lines perform the writing stop operation B2, and the sub-pixels 9 belonging to the even-nubmerth lines perform the refresh operation B3. After that, the display unit 1E repeats the above operation.

Even if the display unit is configured in such a manner, effects similar to those in the display unit 1 according to the above-described embodiment are allowed to be obtained.

[Modification Example 1-3]

Figure 31:
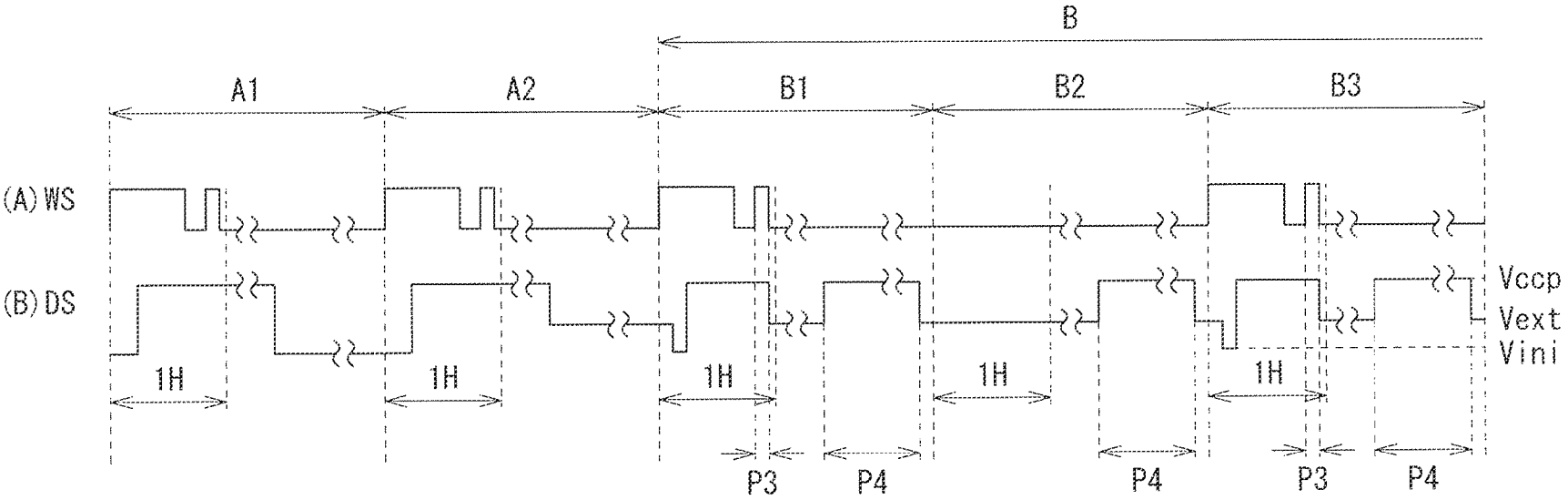
FIG. 31 is a timing waveform diagram illustrating an operation example of a drive section according to another modification example of the first embodiment.

In the above-described embodiment, as illustrated in FIG. 13, in the before-stop operation B1 and the refresh operation B3, the light emission period P4 is provided immediately after the writing•μ correction period P3; however, this embodiment is not limited thereto. Alternatively, like a display unit 1F illustrated in FIG. 31, the light emission period P4 may be provided after some time after the writing•μ correction period P3. In this example, the drive section 30F of the display unit 1F changes the power supply signal DS from the voltage Vccp to the voltage Vext at the end of the writing•μ correction period P3. Then, after some time, the drive section 30F changes the power supply signal DS from the voltage Vext to the voltage Vccp to start the light emission period P4. In other words, as with the writing stop operation B2 (refer to FIG. 14), the drive section 30F changes the power supply signal DS from the voltage Vext to the voltage Vccp in the before-stop operation B1 and the refresh operation B3 to start the light emission period P4. Accordingly, in the display unit 1F, in the before-stop operation B1 and the refresh operation B3, light emission characteristics intermediate between the light emission characteristics in the normal operations A1 and A2 and the light emission characteristics in the writing stop operation B2 are allowed to be achieved, and the possibility that light emission characteristics abruptly change is allowed to be reduced; therefore, the possibility of deterioration in image quality is allowed to be reduced.

[Modification Example 1-4]

Figure 32:
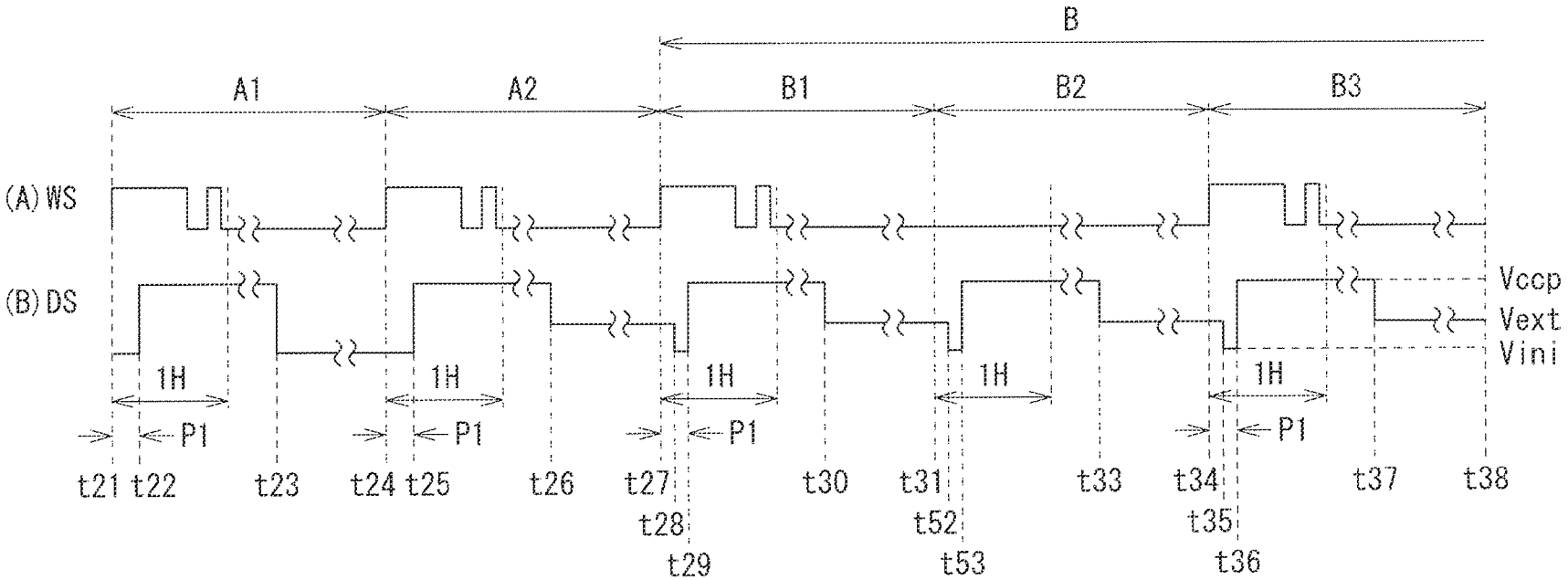
FIG. 32 is a timing waveform diagram illustrating an operation example of a drive section according to another modification example of the first embodiment.

In the above-described embodiment, as illustrated in FIG. 15, in the writing stop operation B2, the drive section 30 changes the power supply signal WS from the voltage Vext to the voltage Vccp to start the light emission operation; however, this embodiment is not limited thereto. Alternatively, like a display unit 1G illustrated in FIG. 32, after the power supply signal DS is temporarily changed from the voltage Vext to the voltage Vini at a timing t52, at a timing t53, the power supply signal DS may be changed from the voltage Vini to the voltage Vccp to start the light emission operation. It is to be noted that, at this time, the scanning signal WS is maintained at the low level (refer to a part (A) in FIG. 32); therefore, the sub-pixels 9 do not perform the initialization operation. Accordingly, in the display unit 1G, light emission characteristics in the writing stop operation B2 are allowed to be brought close to the light emission characteristics in the normal operations A1 and A2, the before-stop operation B1, and the refresh operation B3; therefore, the possibility of deterioration in image quality is allowed to be reduced.

[Modification Example 1-5]

In the above-described embodiment, in each of the segment regions RD, the writing stop frame number NF is dynamically set, based on the stationary level LS; however, this embodiment is not limited thereto. Alternatively, the writing stop frame number NF may be dynamically set only in a predetermined segment region RD of a plurality of segment regions RD, based on the stationary level LS. A display unit 1H according to this modification example will be described in detail below.

Figure 33:
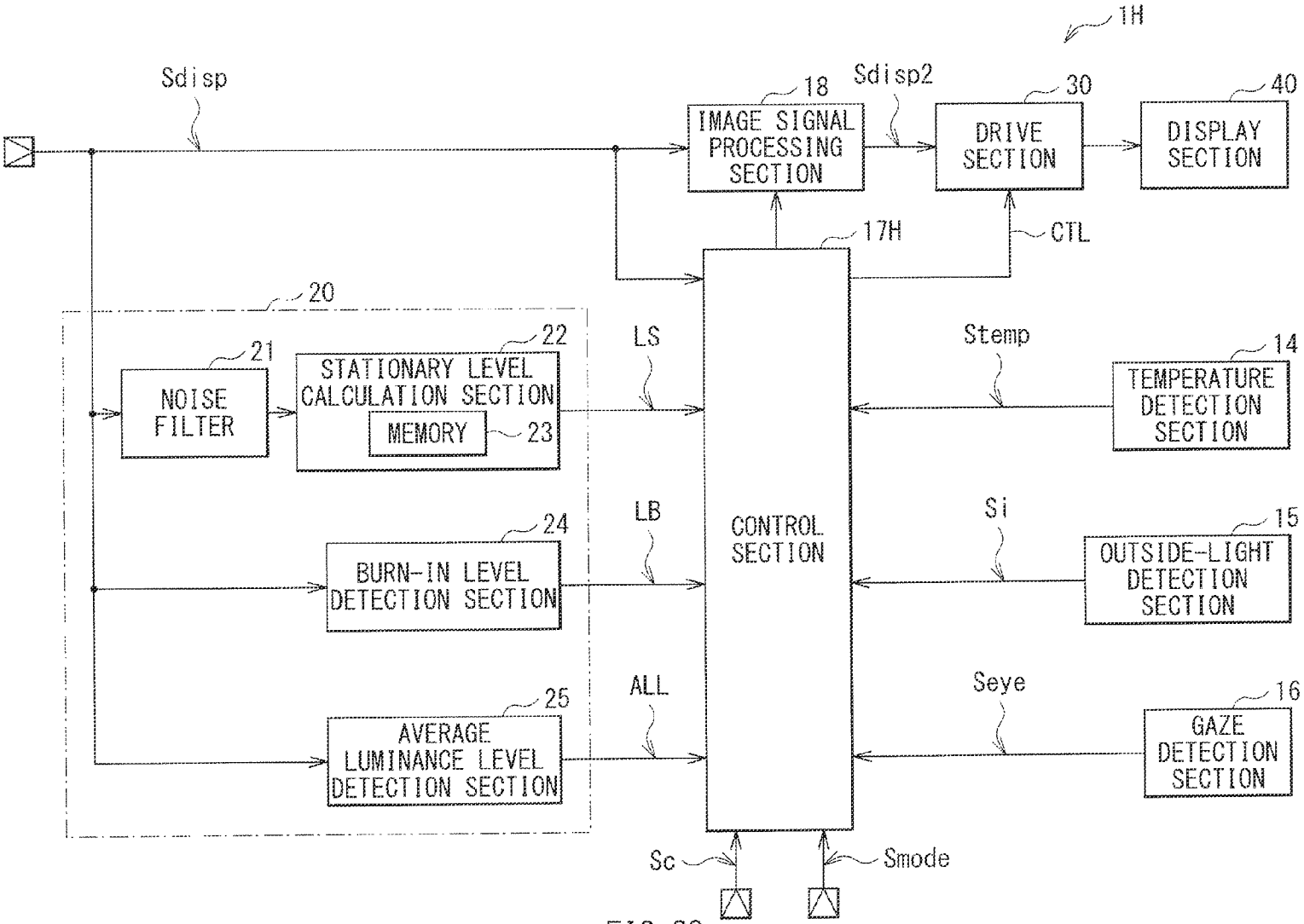
FIG. 33 is a block diagram illustrating a configuration example of a display unit according to another modification example of the first embodiment.

FIG. 33 illustrates a configuration example of the display unit 1H. The display unit 1H includes a gaze detection section 16 and a control section 17H. The gaze detection section 16 is configured to detect which region of the display screen of the display section 40 the user gazes. Then, the gaze detection section 16 supplies information about such a user's gaze (gaze information Seye) to the control section 17H. As with the control section 17 according to the above-described embodiment, the control section 17H is configured to control the image signal processing section 18 and the drive section 30. At this time, the control section 17H controls the image signal processing section 18 and the drive section 30, based on the gaze information Seye and content information Sc. In this case, for example, the content information Sc may be supplied from another circuit, and indicates kinds of image contents indicated by the image signal Sdisp (for example, a cinema, data broadcasting, and the like).

Figure 34:
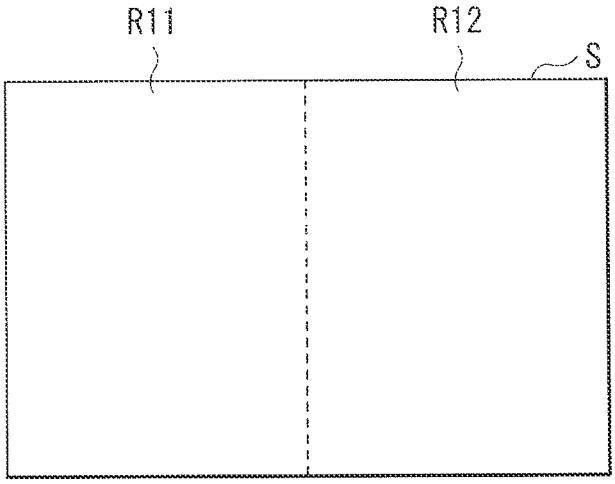
FIG. 34 is an explanatory diagram illustrating an operation example of the display unit illustrated in FIG. 33.

FIG. 34 illustrates an operation, based on the gaze information Seye of the control section 17H. For example, when the user gazes a left region R11 of the display region S of the display section 40, the control section 17H dynamically sets the writing stop frame number NF in the left region R11, based on the stationary level LS, and sets the writing stop frame number NF in a right region R12 to a predetermined writing stop frame number NF that is slightly large. Accordingly, in the left region R11, power consumption is allowed to be reduced while reducing the possibility of deterioration in image quality, and in the right region R12, power consumption is allowed to be reduced. Moreover, for example, when the user gazes the right region R12 of the display region S of the display section 40, the control section 17H dynamically sets the writing stop frame number NF in the right region R12, based on the stationary level LS, and sets the writing stop frame number NF in the left region R11 to a predetermined writing stop frame number NF that is slightly large. Accordingly, in the right region R12, power consumption is allowed to be reduced while reducing the possibility of deterioration in image quality, and in the left region R11, power consumption is allowed to be reduced.

Figure 35A:
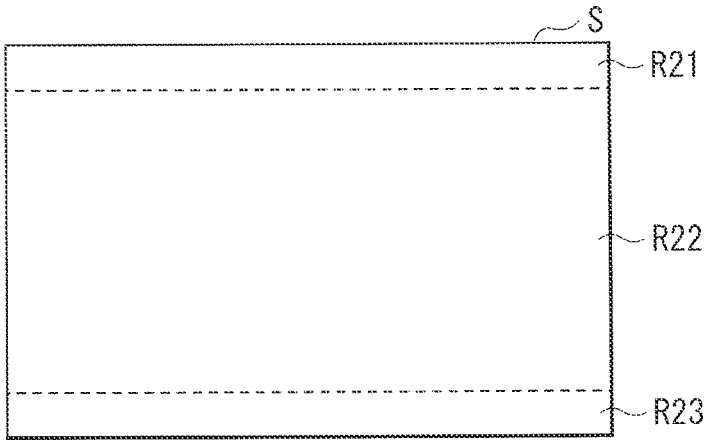
FIG. 35A is an explanatory diagram illustrating another operation example of the display unit illustrated in FIG. 33.
Figure 35B:
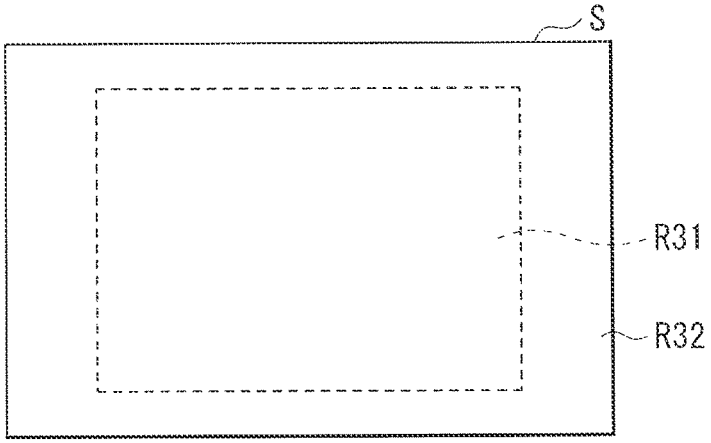
FIG. 35B is an explanatory diagram illustrating another operation example of the display unit illustrated in FIG. 33.

FIGS. 35A and 35B illustrate an operation, based on the content information Sc of the control section 17H. For example, in a case where image contents are a cinema, based on the content information Sc, the control section 17H dynamically sets the writing stop frame number NF in a middle region R22, based on the stationary level LS, and stops the writing drive in upper and lower black-belt regions R21 and R23. Accordingly, in the region R22, power consumption is allowed to be reduced while reducing the possibility of deterioration in image quality, and in the black-belt regions R21 and R23, power consumption is allowed to be reduced. Moreover, for example, in a case where the image contents are data broadcasting, based on the content information Sc, the control section 17H dynamically sets the writing stop frame number NF in a middle region R31 in which an image has large motion, based on the stationary level LS, and sets the writing stop frame number NF in a peripheral region R32 in which the image has small motion to a predetermined writing stop frame number NF that is slightly large. Accordingly, in the region R31, power consumption is allowed to be reduced while reducing the possibility of deterioration in image quality, and in the peripheral region R32, power consumption is allowed to be reduced.

Modification Example 1-6

Figure 36:
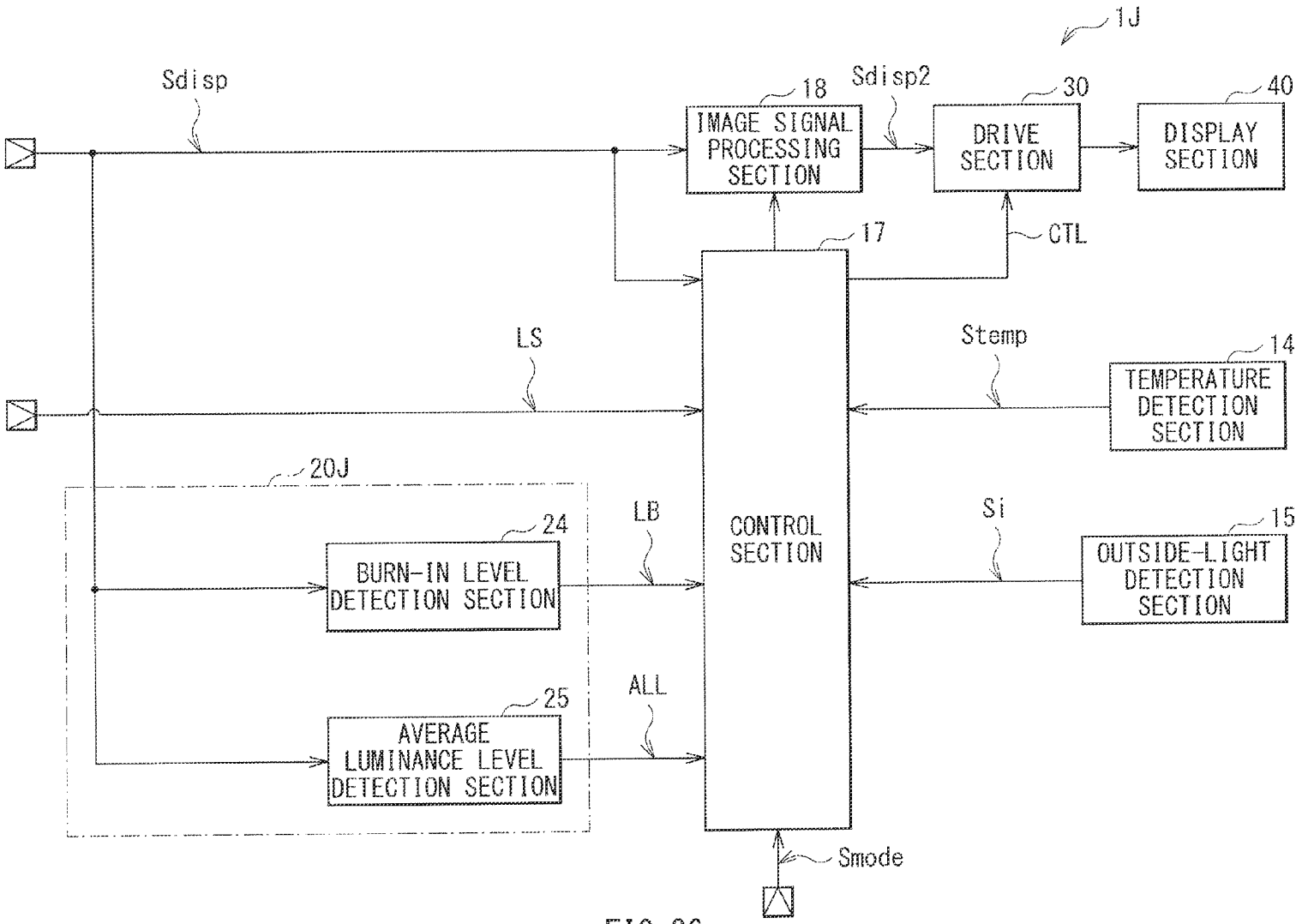
FIG. 36 is a block diagram illustrating a configuration example of a display unit according to another modification example of the first embodiment.

In the above-described embodiment, the stationary level LS is determined, based on the image signal Sdisp; however, this embodiment is not limited thereto. Alternatively, for example, like a display unit 1J illustrated in FIG. 36, the stationary level LS may be supplied from an external device. The display unit 1J includes a detection section 20J. The detection section 20J is the detection section 20 according to the above-described embodiment without the noise filter 21 and the stationary level calculation section 22. Then, the stationary level LS is supplied from the external device to the control section 17. The stationary level LS may be generated in, for example, a circuit in a previous stage. Examples of the circuit in the previous stage may include a MPEG (Moving Picture Experts Group) decoder and a frame rate conversion circuit.

[Modification Example 1-7]

Figure 37:
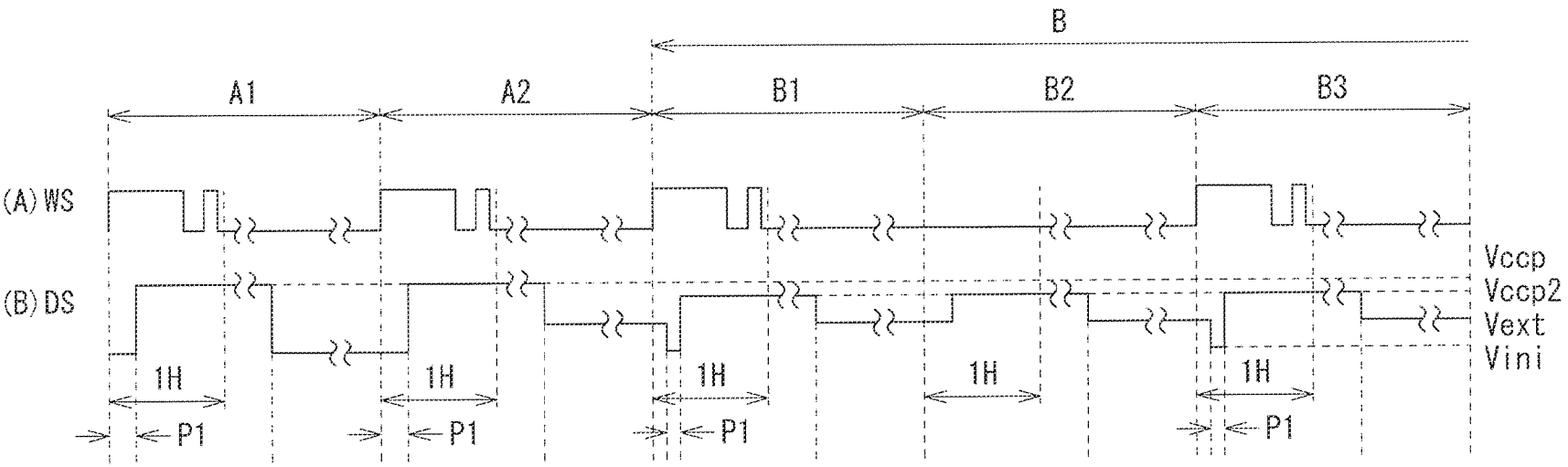
FIG. 37 is a timing waveform diagram illustrating an operation example of a drive section according to another modification example of the first embodiment.

In the above-described embodiment, the power supply signal DS is changed among three voltages Vccp, Vext, and Vini; however, this embodiment is not limited thereto. Alternatively, for example, like a display unit 1K illustrated in FIG. 37, in the intermittent writing operation B, the voltage Vccp may be a voltage Vccp2 that is lower than the voltage Vccp. The voltage Vccp corresponds to a specific example of "second voltage" in an embodiment of the present disclosure, and the voltage Vccp2 corresponds to a specific example of "third voltage" in an embodiment of the present disclosure. Accordingly, in the display unit 1K, in the intermittent writing operation B, while the possibility of deterioration in image quality is reduced, power consumption is allowed to be reduced. In other words, in the intermittent writing operation B, as illustrated in FIG. 8, while the light-emission duty ratio DUTY is increased, the pixel voltage Vsig is decreased. Accordingly, the gate voltage of the driving transistor DRTr in the light emission period P4 is also decreased; therefore, even if the voltage Vccp is changed to the voltage Vccp2 that is lower than the voltage Vccp, the driving transistor DRTr is allowed to maintain an operation in the saturation region and to reduce the possibility of deterioration in image quality. Thus, in the display unit 1K, power consumption is allowed to be reduced while reducing the possibility of deterioration in image quality by changing the voltage Vccp to the voltage Vccp2 lower than the voltage Vccp in the intermittent writing operation B. It is to be noted that, in a case where gamma characteristics of the display section 40 are thereby changed, setting of gamma correction may be preferably changed.

[Modification Example 1-8]

Figure 38:
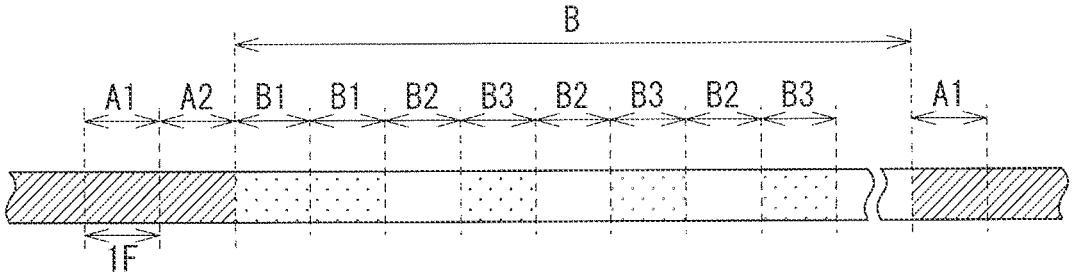
FIG. 38 is a schematic view illustrating an operation example of a sub-pixel according to another modification example of the first embodiment.

In the above-described embodiment, the before-stop operation B1 is performed only once between the normal operations A1 and A2 and the writing stop operation B2; however, this embodiment is not limited thereto. Alternatively, for example, like a display unit 1L illustrated in FIG. 38, the before-stop operation B1 may be performed a plurality of times (in this example, twice).

[Modification Example 1-9]

In the above-described embodiment, the sub-pixel 9 is configured with use of two transistors (the writing transistor WSTr and the driving transistor DRTr) and one capacitor device Cs; however, this embodiment is not limited thereto. A display unit 1M according to this modification example will be described in detail below.

Figure 39:
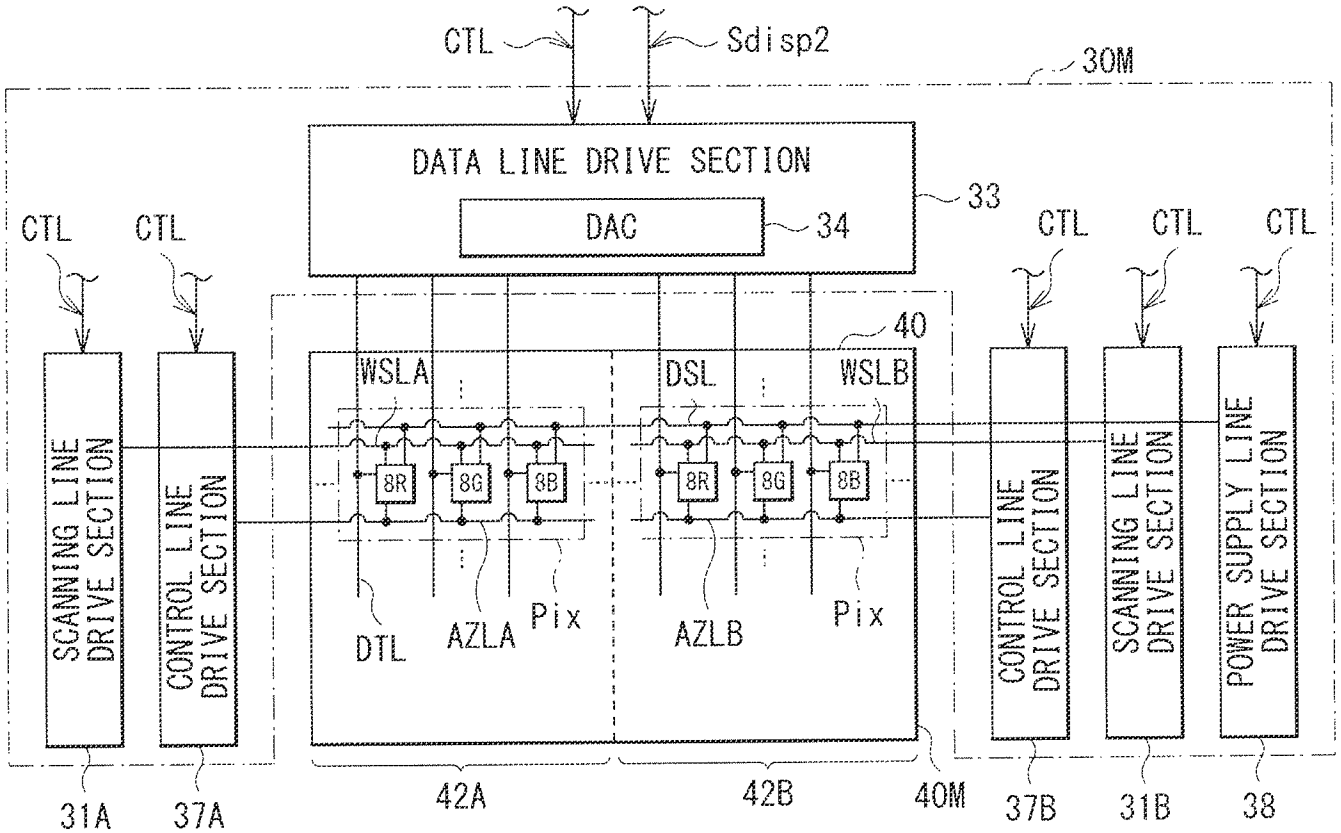
FIG. 39 is a block diagram illustrating a configuration example of a drive section and a display section according to another modification example of the first embodiment.

FIG. 39 illustrates a configuration example of a display section 40M and a drive section 30M of the display unit 1M. Each pixel Pix includes a red (R) sub-pixel 8R, a green (G) sub-pixel 8G, and a blue (B) sub-pixel 8B. It is to be noted that hereinafter any one of the sub-pixels 8R, 8G, and 8B is referred to as "sub-pixel 8" as appropriate. The display section 40M includes a plurality of scanning lines WSLA and a plurality of control lines AZLA extending along the row direction in the region 42A, a plurality of scanning lines WSLB and a plurality of control lines AZLB extending along the row direction in the region 42B, a plurality of power supply control lines DSL extending along the row direction in the regions 42A and 42B, and a plurality of data lines DTL extending along the column direction. First ends of the scanning lines WSLA and WSLB, the control lines AZLA and AZLB, the power supply control lines DSL, and the data lines DTL are connected to the drive section 30M.

Figure 40:
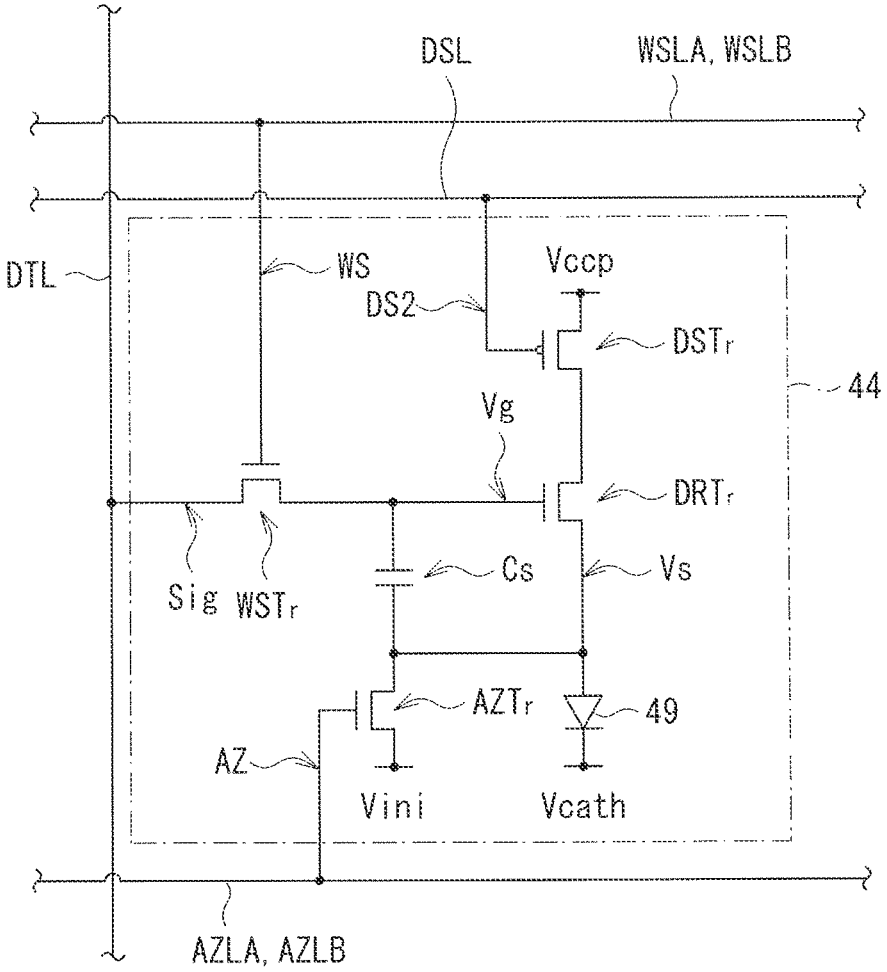
FIG. 40 is a circuit diagram illustrating a configuration example of a sub-pixel illustrated in FIG. 39.

FIG. 40 illustrates an example of a circuit configuration of the sub-pixel 8. The sub-pixel 8 includes a power supply transistor DSTr and a control transistor AZTr. In other words, in this example, the sub-pixel 8 has a so-called "4Tr1C" configuration configured with use of four transistors (the writing transistor WSTr, the driving transistor DRTr, the power supply transistor DSTr, and the control transistor AZTr) and one capacitor device Cs. The power supply transistor DSTr is configured of a P-channel MOS type TFT. In the power supply transistor DSTr, a gate thereof is connected to the power supply control line DSL, the voltage Vccp is supplied to a source thereof by the drive section 30M, and a drain thereof is connected to the drain of the driving transistor DRTr. The control transistor AZTr is configured of an N-channel MOS type TFT. In the control transistor AZTr, a gate thereof is connected to the control line AZL, a drain thereof is connected to the source of the driving transistor DRTr, the second end of the capacitor device Cs, and the anode of the light-emitting device 49, and the voltage Vini is supplied to a source thereof by the drive section 30M.

As illustrated in FIG. 39, the drive section 30M includes control line drive sections 37A and 37B and a power supply control line drive section 38. The control line drive section 37A is configured to control an initialization operation of the sub-pixels 8 in the region 42A by sequentially applying a control signal AZ to the plurality of the control lines AZLA, based on the control signal CTL supplied from the control section 17. As with the control line drive section 37A, the control line drive section 37B is configured to control the initialization operation of the sub-pixels 8 in the region 42B by sequentially applying the control signal AZ to the plurality of the control lines AZLB, based on the control signal CTL supplied from the control section 17. The power supply control line drive section 38 is configured to control an light emission operation and a light extinguish operation of the sub-pixels 8 by sequentially applying a power supply control signal DS2 to the plurality of power supply control lines DSL, based on the control signal CTL supplied from the control section 17.

Figure 41:
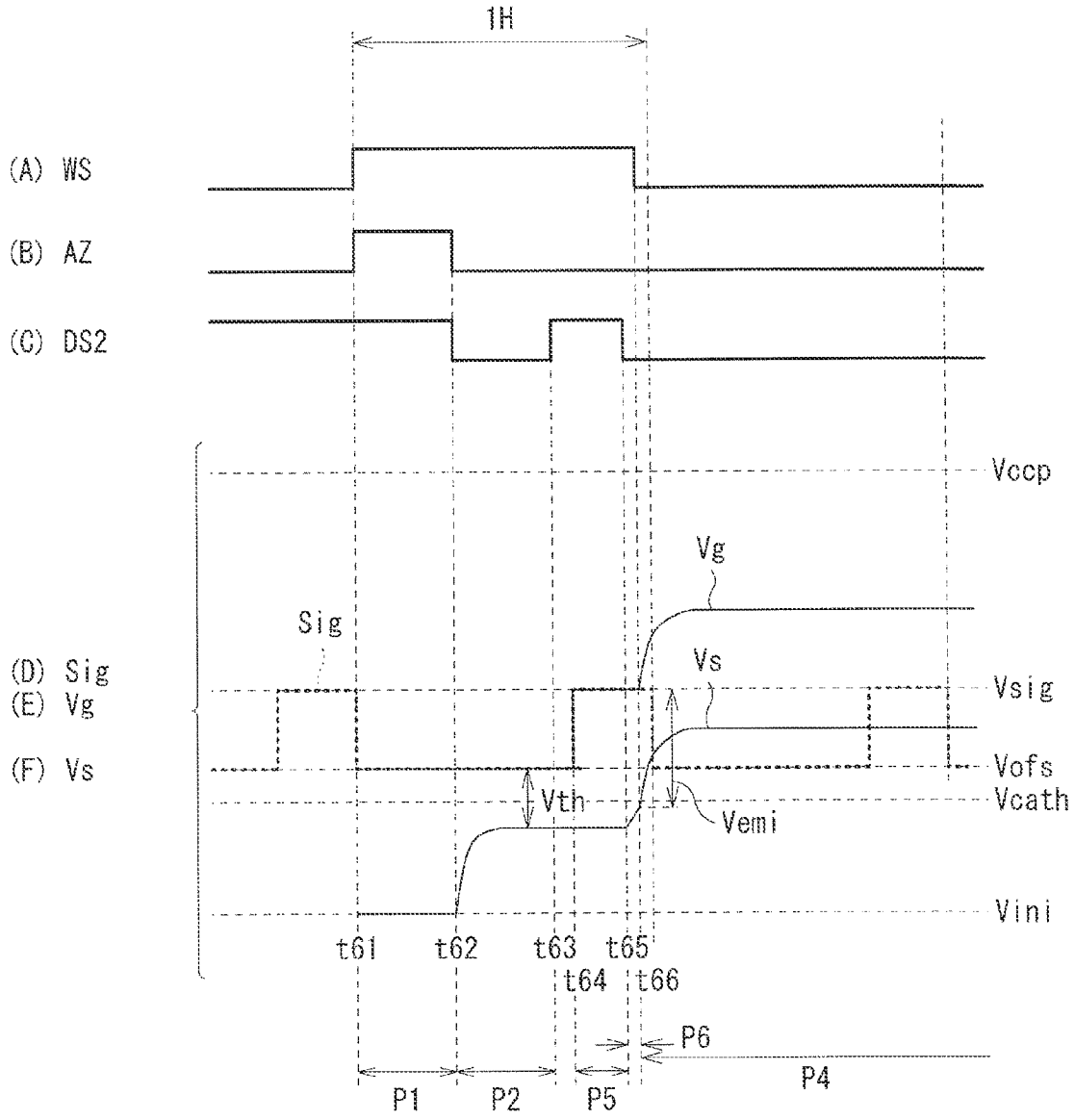
FIG. 41 is a timing waveform diagram illustrating an operation example of the sub-pixel illustrated in FIG. 40.

FIG. 41 illustrates a timing chart of the normal operation A of the sub-pixel 8, where a part (A) indicates a waveform of the scanning signal WS, a part (B) indicates a waveform of the control signal AZ, a part (C) indicates a waveform of the power supply control signal DS2, a part (D) indicates a waveform of the signal Sig, a part (E) indicates a waveform of the gate voltage Vg of the driving transistor DRTr, and a part (F) indicates a waveform of the source voltage Vs of the driving transistor DRTr. It is to be noted that before-stop operation B1 and the refresh operation B3 are similar to the normal operation A, and will not be described.

First, the power supply control line drive section 38 sets the power supply signal DS2 to the high level before the initialization period P1 (refer to the part (C) in FIG. 41).

Next, the drive section 30M initializes the sub-pixel 8 in a period from a timing t61 to a timing t62 (the initialization period P1). More specifically, first, at the timing t61, the data line drive section 33 sets the signal Sig to the voltage Vofs (refer to the part (D) in FIG. 41), and the scanning line drive sections 31A and 31B change the voltage of the scanning signal WS from the low level to the high level (refer to the part (A) in FIG. 41). Moreover, concurrently with this, the control line drive sections 37A and 37B change the voltage of the control signal AZ from the low level to the high level (refer to the part (B) in FIG. 41). Accordingly, the gate voltage Vg of the driving transistor DRTr is set to the voltage Vofs (refer to the part (E) in FIG. 41), the source voltage Vs of the driving transistor DRTr is set to the voltage Vini (refer to the part (F) in FIG. 41), and the sub-pixel 8 is initialized.

Next, the drive section 30M performs Vth correction in a period from the timing t62 to a timing t63 (the Vth correction period P2). More specifically, the control line drive sections 37A and 37B change the voltage of the control signal AZ from the high level to the low level (refer to the part (B) in FIG. 41), and the power supply control line drive section 38 changes the voltage of the power supply control signal DS2 from the high level to the low level (refer to the part (C) in FIG. 41). Accordingly, while the control transistor AZTr is turned to the OFF state, the power supply transistor DSTr is turned to the ON state, and as with the above-described embodiment, the Vth correction is performed.

Next, the power supply control line drive section 38 changes the voltage of the power supply control signal DS2 from the low level to the high level at the timing t63 (refer to the part (C) in FIG. 41). Accordingly, the power supply transistor DSTr is turned to the OFF state.

Next, the drive section 30M performs writing of the pixel voltage Vsig on the sub-pixel 8 in a period from a timing t64 to a timing t65 (the writing period P5). More specifically, at the timing t64, the data line drive section 33 sets the signal Sig to the pixel voltage Vsig (refer to the part (D) in FIG. 41). Accordingly, the gate voltage Vg of the driving transistor DRTr increases from the voltage Vofs to the pixel voltage Vsig (refer to the part (E) in FIG. 41). As a result, the gate-source voltage Vgs of the driving transistor DRTr becomes larger than the threshold voltage Vth (Vgs>Vth).

Next, the drive section 30M performs μ correction in a period from the timing t65 to a timing t66 (the μ correction period P6). More specifically, at the timing t65, the power supply control line drive section 38 changes the voltage of the power supply control signal DS2 from the high level to the low level (refer to the part (C) in FIG. 41). Accordingly, the power supply transistor DSTr is turned to the ON state, and the current Ids flows from the drain to the source; therefore, the source voltage Vs of the driving transistor DRTr is increased (refer to the part (F) in FIG. 41). The μ correction is performed by the above operation.

Next, the drive section 30M allows the sub-pixel 8 to emit light in a period from the timing t66 onward (the light emission period P4). More specifically, at the timing t66, the scanning line drive sections 31A and 31B change the voltage of the scanning signal WS from the high level to the low level (refer to the part (A) in FIG. 41). Therefore, as with the light emission period P4 according to the light emission period P4, the gate voltage Vg and the source voltage Vs of the driving transistor DRTr are increased (refer to the parts (E) and (F) in FIG. 41), and the light-emitting device 49 emits light.

After that, after a lapse of a period corresponding to the light-emission duty ratio DUTY, the drive section 30M changes the voltage of the power supply control signal DS2 from the low level to the high level to stop the light emission period P4.

Figure 42:
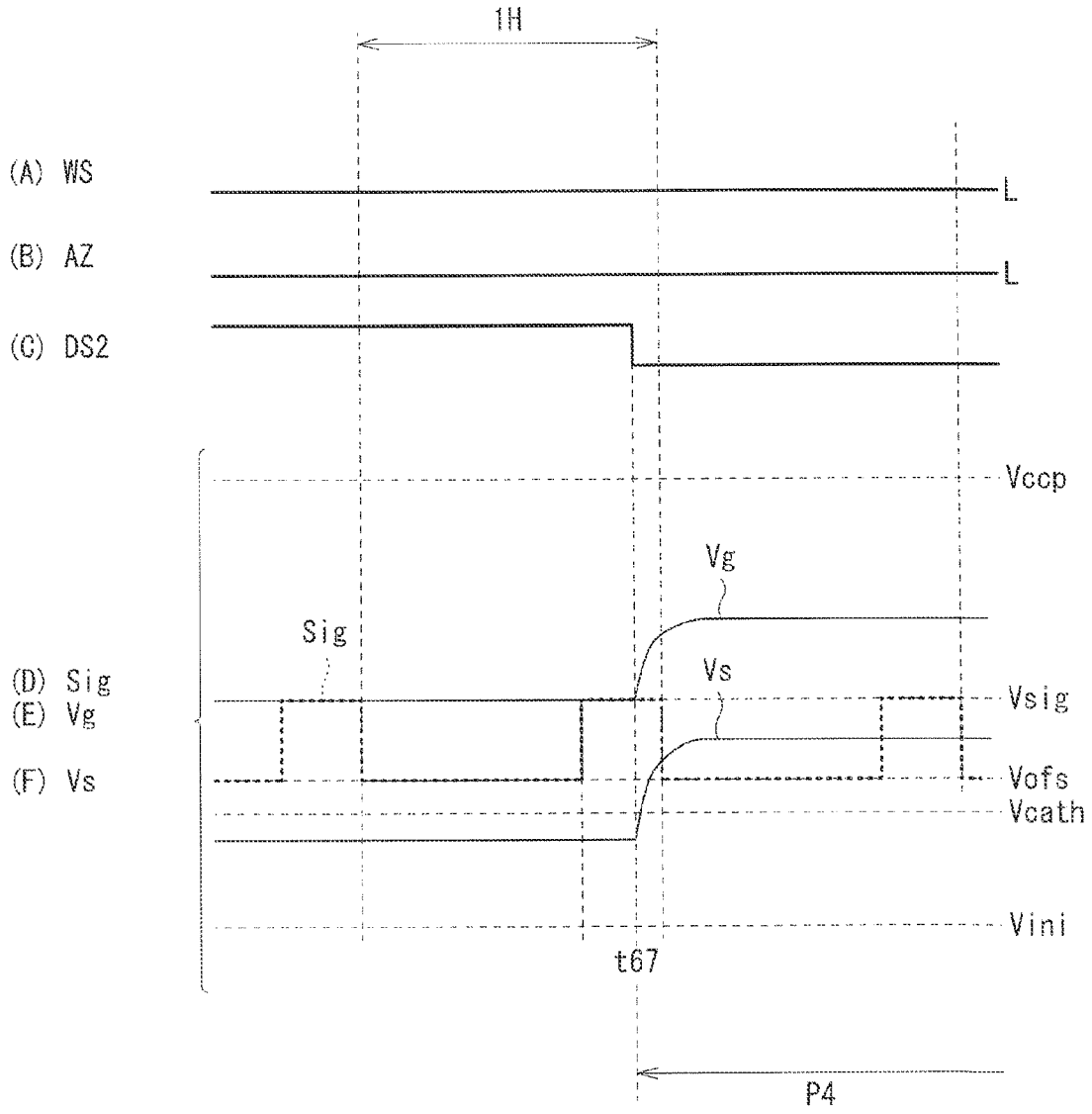
FIG. 42 is a timing waveform diagram illustrating another operation example of the sub-pixel illustrated in FIG. 40.

FIG. 42 illustrates a timing chart of the writing operation B2 of the sub-pixel 8, where a part (A) indicates a waveform of the scanning signal WS, a part (B) indicates a waveform of the control signal AZ, a part (C) indicates a waveform of the power supply control signal DS2, a part (D) indicates a waveform of the signal Sig, a part (E) indicates a waveform of the gate voltage Vg of the driving transistor DRTr, and a part (F) indicates a waveform of the source voltage Vs of the driving transistor DRTr.

In the writing stop operation B2, the voltage of the scanning signal WS and the voltage of the control signal AZ are constantly at the low level. Accordingly, the writing transistor WSTr and the control transistor AZTr are maintained in the OFF state; therefore, the gate-source voltage Vgs of the driving transistor DRTr is maintained at the voltage Vemi set in the writing period P5 and the μ correction period P6. It is to be noted that, for the sake of convenience, leakage from the capacitor device Cs is not considered.

First, the power supply control line drive section 38 sets the power supply signal DS2 to the high level (refer to the part (C) in FIG. 42).

Next, the drive section 30M allows the sub-pixel 9 to emit light in a period from the timing t13 onward (the light emission period P4). More specifically, the power supply control line drive section 38 changes the voltage of the power supply control signal DS2 from the high level to the low level at a timing t67 (refer to the part (C) in FIG. 42). Accordingly, as with the light emission period P4 according to the above-described embodiment, the gate voltage Vg and the source voltage Vs of the driving transistor DRTr are increased (refer to the parts (E) and (F) in FIG. 42), and the light-emitting device 49 emits light.

After that, after a lapse of a period corresponding to the light-emission duty ratio DUTY, the drive section 30M changes the voltage of the power supply control signal DS2 from the low level to the high level to finish the light emission period P4.

Figure 43:
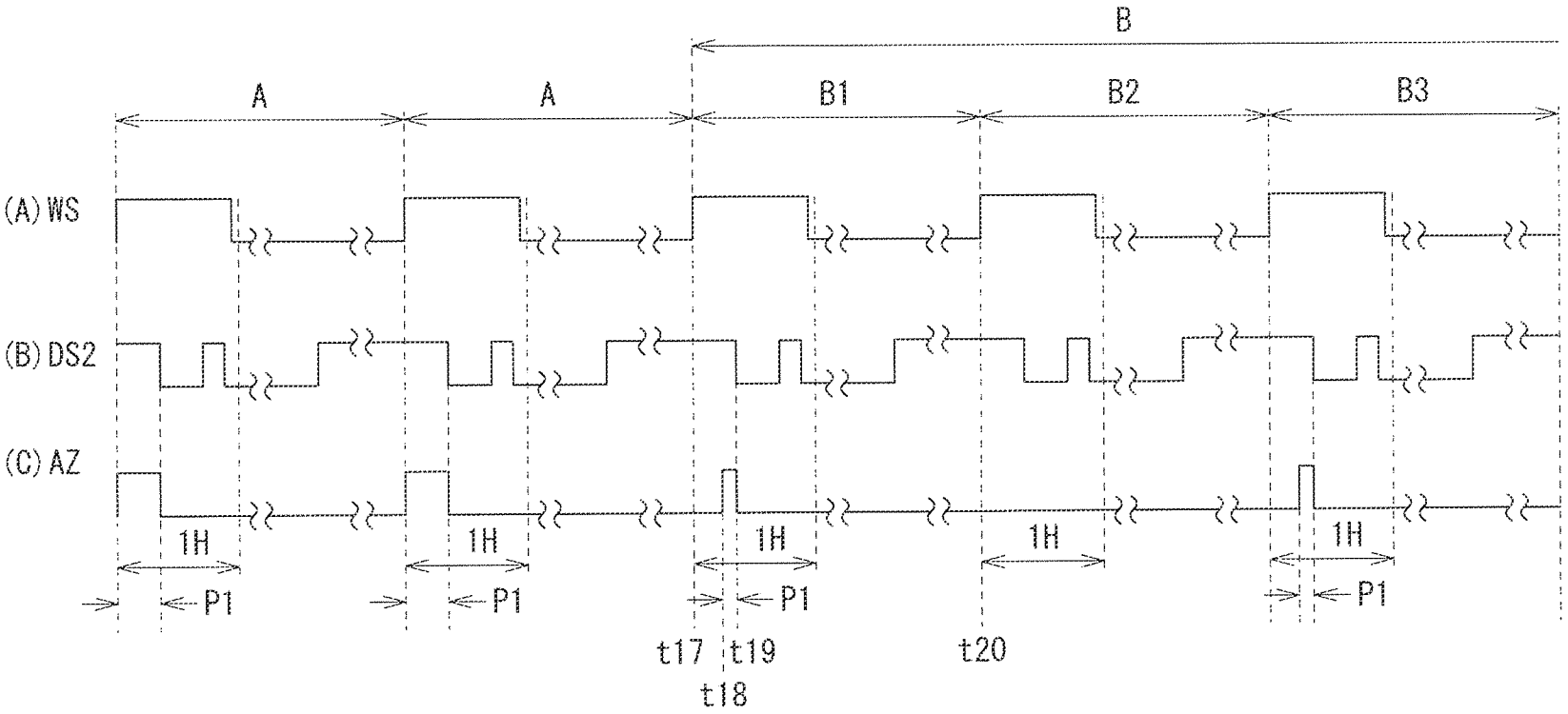
FIG. 43 is a timing waveform diagram illustrating an operation example of the drive section illustrated in FIG. 39.

FIG. 43 illustrates a timing chart of a driving operation of the drive section 30M, where a part (A) indicates a waveform of the scanning signal WS, a part (B) indicates a waveform of the power supply control signal DS2, and a part (C) indicates a waveform of the control signal AZ. In a period from a timing t17 to a timing t20, the sub-pixel 8 performs the before-stop operation B1. More specifically, first, as with a case in FIG. 41, in one horizontal period from the timing t17 onward, the drive section 30M generates the scanning signal WS (refer to the part (A) in FIG. 43). Moreover, the drive section 30M changes the voltage of the control signal AZ from the low level to the high level at a timing t18 in the one horizontal period, and at the timing t19, the drive section 30M changes the voltage of the control signal AZ from the high level to the low level, and changes the voltage of the power supply control signal DS2 from the high level to the low level (refer to the parts (B) and (C) in FIG. 43). Accordingly, the sub-pixel 8 performs the initialization operation in a shorter period (from the timing t18 to the timing t19) than that of the normal operation A, and after that, the Vth correction, the writing operation, the μ correction, and the light emission operation are performed. Accordingly, in the display unit 1M, in the before-stop operation B1, light emission characteristics intermediate between the light emission characteristics in the normal operation A and the light emission characteristics in the writing stop operation B2 are allowed to be achieved, and the possibility that light emission characteristics abruptly change is allowed to be reduced; therefore, the possibility of deterioration in image quality is allowed to be reduced.

Figure 44:
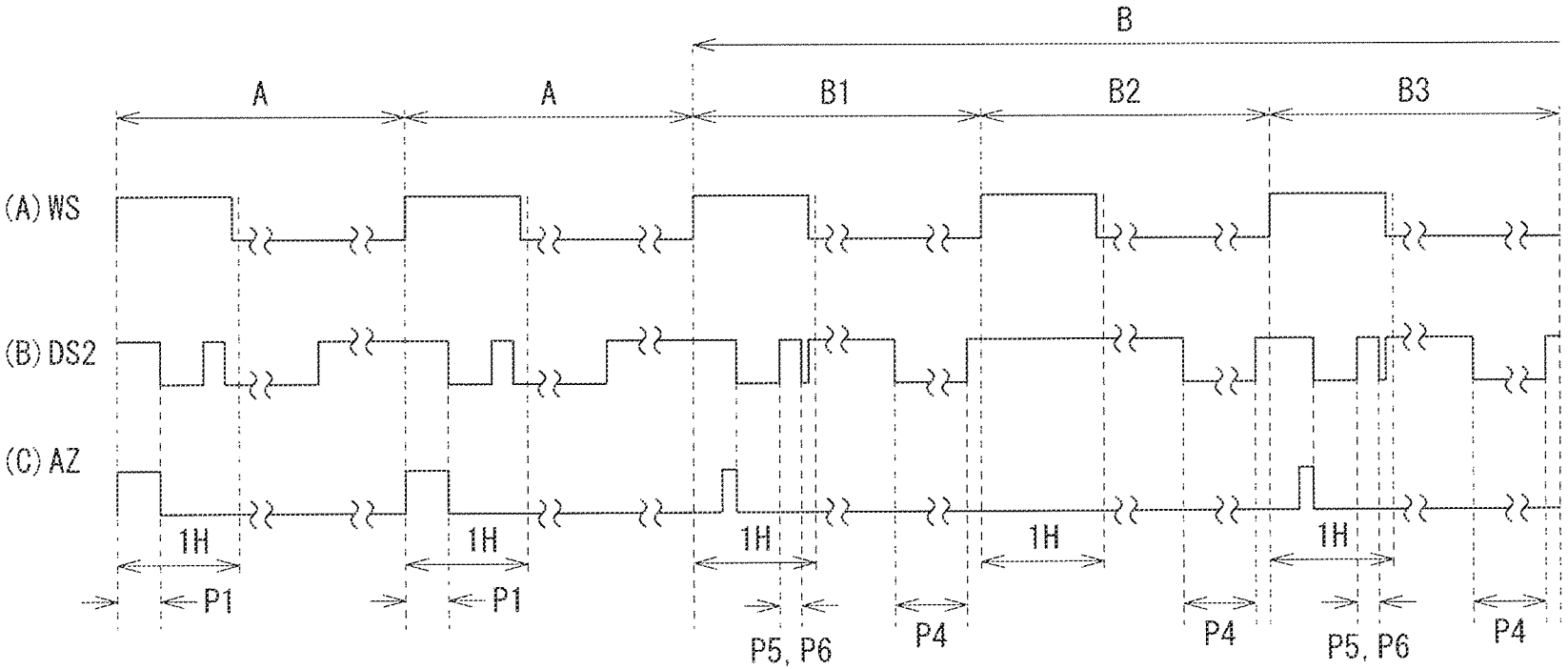
FIG. 44 is a timing waveform diagram illustrating an operation example of the drive section according to another modification example of the first embodiment.

In this example, in the before-stop operation B1 and the refresh operation B3, the light emission period P4 is provided immediately after the writing period P5 and the μ correction period P6; however, this modification example is not limited thereto. Alternatively, as with Modification Example 1-3, as illustrated in FIG. 44, the light emission period P4 may be provided after some time after the writing period P5 and the μ correction period P6.

[Modification Example 1-10]

Figure 45:
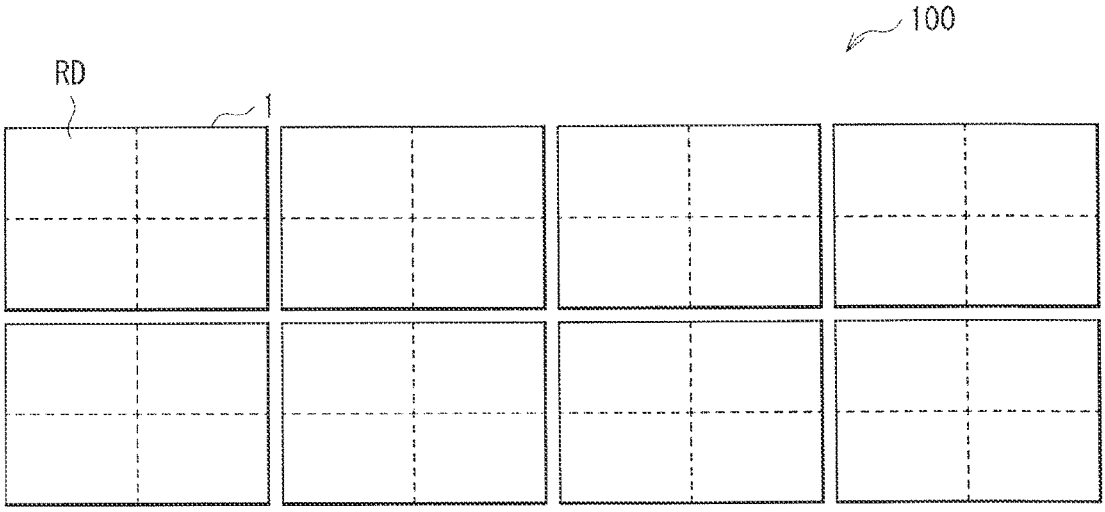
FIG. 45 is an explanatory diagram illustrating a configuration example of a display system according to another modification example of the first embodiment.
Figure 46:
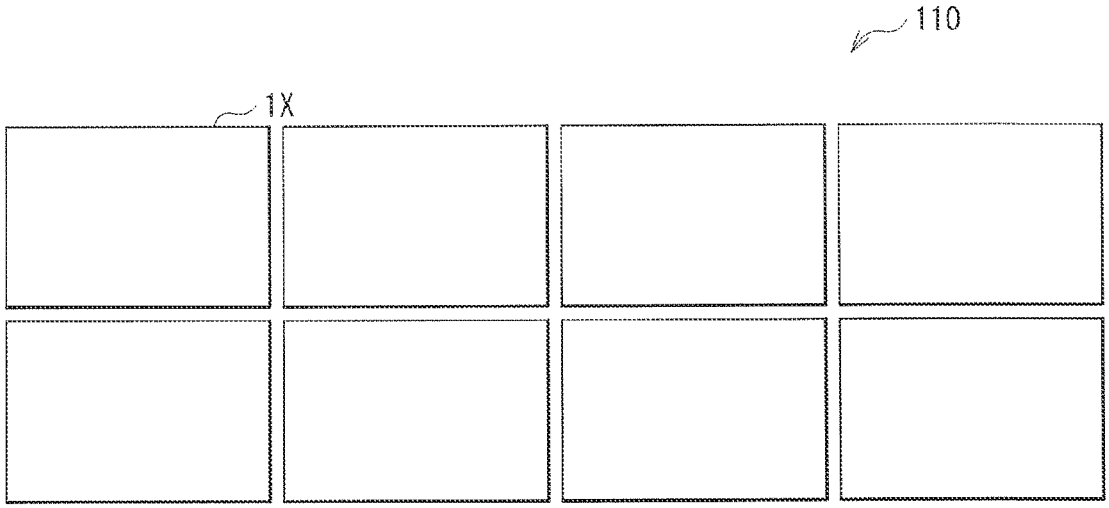
FIG. 46 is an explanatory diagram illustrating a configuration example of a display system according to another modification example of the first embodiment.

Moreover, a tiling panel may be configured with use of a plurality of display units. FIG. 45 illustrates a display system 100 according to this modification example. The display system 100 is configured by arranging a plurality of (eight in this example) display units 1 side by side. In this display system 100, each of the display units 1 controls the writing operation in each segment region RD. It is to be noted that this modification example is not limited thereto, and alternatively, for example, like a display system 110 illustrated in FIG. 46, display units 1X each of which is not partitioned into a plurality of segment regions RD may be used. In this case, each display unit 1X determines the stationary level LS in each display region, and the writing operation of each display unit 1X is controlled, based on the stationary level LS.

[Another Modification Example]

Further, two or more selected from these modification examples may be combined.

(2. Second Embodiment)

Next, a display unit 2 according to a second embodiment will be described below. This embodiment is configured to allow a plurality of sub-pixels belonging to each pixel to independently perform the writing operation. It is to be noted that like components are denoted by like numerals as of the display unit 1 according to the above-described first embodiment and will not be further described.

[Configuration Example]

Figure 47:
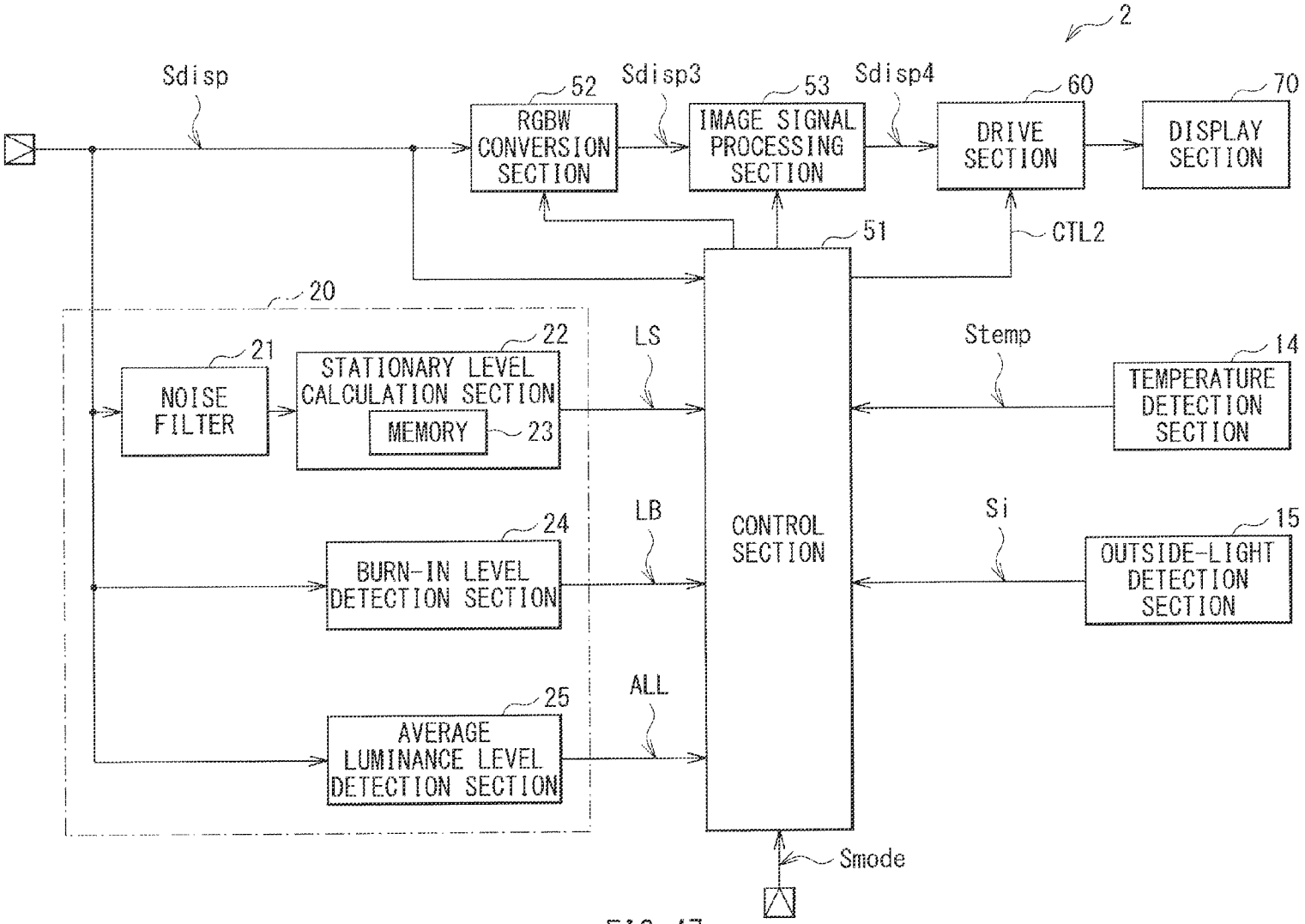
FIG. 47 is a block diagram illustrating a configuration example of a display unit according to a second embodiment.

FIG. 47 illustrates a configuration example of the display unit 2 according to this embodiment. The display unit 2 is configured to display an image, based on the image signal Sdisp. The display unit 2 includes a display section 70, a drive section 60, a control section 51, an RGBW conversion section 52, and an image signal processing section 53.

Figure 48:
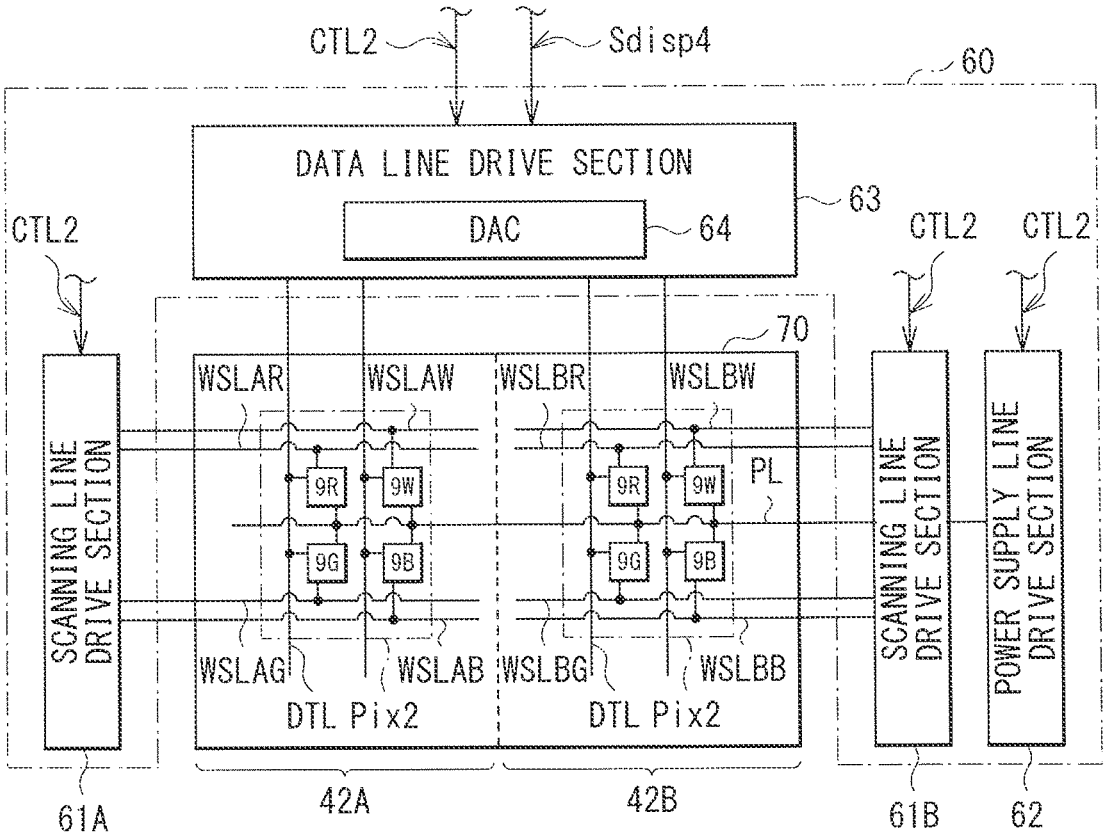
FIG. 48 is a block diagram illustrating a configuration example of a drive section and a display section illustrated in FIG. 47.

FIG. 48 illustrates a configuration example of the display section 70 and the drive section 60. The display section 70 includes a plurality of pixels Pix2 arranged in a matrix form. Each of the pixels Pix2 includes a red (R) sub-pixel 9R, a green (G) sub-pixel 9G, a blue (B) sub-pixel 9B, and a white (W) sub-pixel 9W. It is to be noted that hereinafter any one of the sub-pixels 9R, 9G, 9B, and 9W is referred to as "sub-pixel 9" as appropriate. Accordingly, in the display unit 2, for example, when the pixel Pix2 displays white, for example, instead of three sub-pixels 9R, 9G, and 9B, the white (W) sub-pixel 9W may mainly emit light; therefore, power consumption is allowed to be reduced. The display section 70 includes a plurality of scanning lines WSLAR, WSLAG, WSLAB, and WSLAW extending along the row direction in the region 42A and a plurality of scanning lines WSLBR, WSLBG, WSLBB, and WSLBW extending along the row direction in the region 42B, a plurality of power supply lines PL extending along the row direction, and a plurality of data lines DTL extending along the column direction. First ends of the scanning lines WSLAR, WSLAG, WSLAB, WSLAW, WSLBR, WSLBG, WSLBB, and WSLBW, the power supply lines PL, and the data lines DTL are connected to the drive section 60. In this example, as with the display section 40 according to the above-described first embodiment (refer to FIG. 3), the display section 70 is partitioned into four segment regions RD.

Figure 49:
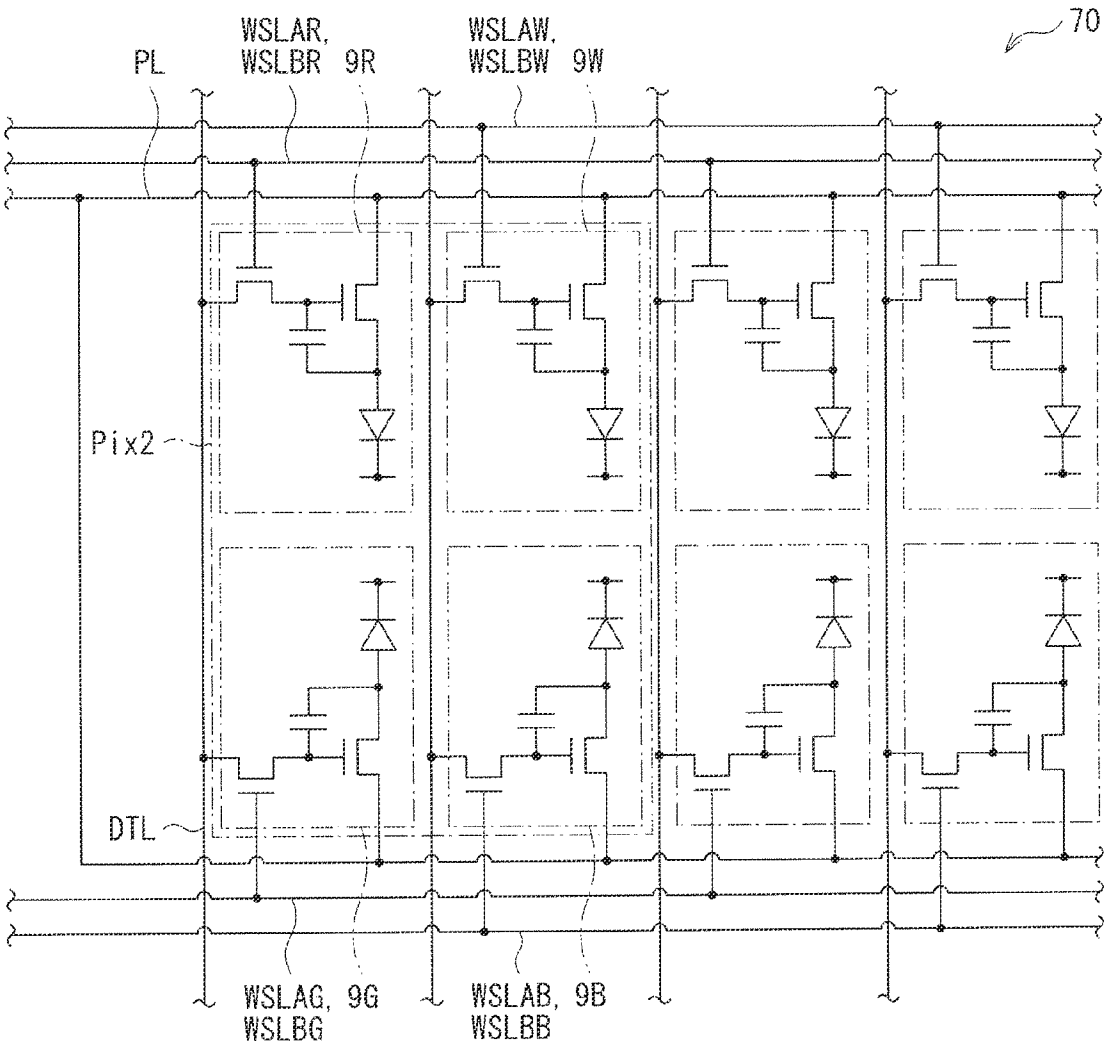
FIG. 49 is a circuit diagram illustrating a configuration example of the display section illustrated in FIG. 48.

FIG. 49 illustrates a configuration example of the display section 70. In this example, the four sub-pixels 9R, 9G, 9B, and 9W are arranged in an array of two rows by two columns in the pixel Pix2. More specifically, in the pixel Pix2, the sub-pixel 9R is arranged at the upper left, the sub-pixel 9W is arranged at the upper right, the sub-pixel 9G is arranged at the lower left, and the sub-pixel 9B is arranged at the lower right. In this example, the four sub-pixels 9R, 9G, 9B, and 9W belonging to one pixel Pix2 are connected to a same power supply line PL. Moreover, in this example, four sub-pixels 9R, 9G, 9B, and 9W belonging to one pixel Pix2 in the region 42A are connected to the scanning lines WSLAR, WSLAG, WSLAB, and WSLAW that are different from one another, respectively, and four sub-pixels 9R, 9G, 9B, and 9W belonging to one pixel Pix2 in the region 42B are connected to the scanning lines WSLBR, WSLBG, WSLBB, and WSLBW that are different from one another, respectively. Further, the sub-pixel 9R and the sub-pixel 9G belonging to one pixel Pix2 are connected to a same data line DTL, and the sub-pixel 9W and the sub-pixel 9B belonging to one pixel Pix2 are connected to a same data line DTL in a similar manner.

The drive section 60 is configured to drive the display section 70, based on an image signal Sdisp4 supplied from the image signal processing section 53 and a control signal CTL2 supplied from the control section 51. The drive section 60 is allowed to selectively perform the writing drive on each of the segment regions RD, and is allowed to selectively perform the writing drive on each of the sub-pixels 9R, 9G, 9B, and 9W. The drive section 60 includes a scanning line drive section 61A, a scanning line drive section 61B, a power supply line drive section 62, and a data line drive section 63.

Based on the control signal CTL2 supplied from the control section 51, the scanning line drive section 61A sequentially selects the sub-pixels 9R in the region 42A by sequentially applying the scanning signal WS to the plurality of scanning lines WSLAR, sequentially selects the sub-pixels 9G in the region 42A by sequentially applying the scanning signal WS to the plurality of scanning lines WSLAG, sequentially selects the sub-pixels 9B in the region 42A by sequentially applying the scanning signal WS to the plurality of scanning lines WSLAB, and sequentially selects the sub-pixels 9W in the region 42A by sequentially applying the scanning signal WS to the plurality of scanning lines WSLAW. As with the scanning drive section 61A, based on the control signal CTL2 supplied from the control section 51, the scanning line drive section 61B sequentially selects the sub-pixels 9R in the region 42B by sequentially applying the scanning signal WS to the plurality of scanning lines WSLBR, sequentially selects the sub-pixels 9G in the region 42B by sequentially applying the scanning signal WS to the plurality of scanning lines WSLBG, sequentially selects the sub-pixels 9B in the region 42B by sequentially applying the scanning signal WS to the plurality of scanning lines WSLBB, and sequentially selects the sub-pixels 9W in the region 42B by sequentially applying the scanning signal WS to the plurality of scanning lines WSLBW.

As with the power supply line drive section 32 according to the above-described first embodiment, the power supply line drive section 62 is configured to control a light emission operation and a light extinction operation of the sub-pixels 9 by sequentially applying the power supply signal DS to the plurality of power supply lines PL, based on the control signal CTL2 supplied from the control section 51.

As with the data line drive section 33 according to the above-described first embodiment, the data line drive section 63 is configured to generate the signal Sig, based on the image signal Sdisp4 supplied from the image signal processing section 53 and the control signal CTL2 supplied from the control section 51 and apply the signal Sig to each of the data lines DTL.

The control section 51 is configured to control the RGBW conversion section 52, the image signal processing section 53, and the drive section 60, based on the image signal Sdisp, the stationary level LS, the burn-in level LB, the average luminance level ALL, the temperature information Stemp, the outside-light information Si, and the mode information Smode.

More specifically, as with the control section 17 according to the above-described first embodiment, the control section 51 has a function of controlling whether or not to perform the writing drive on each of the segment regions RD of the display section 40, based on the stationary level LS and the luminance information IR, IG, and IB included in the image signal Sdisp. At this time, the control section 51 is configured to control whether or not to perform the writing drive on each of the sub-pixels 9R, 9G, 9B, and 9W in the segment region RD targeted for the writing drive.

Figure 50:
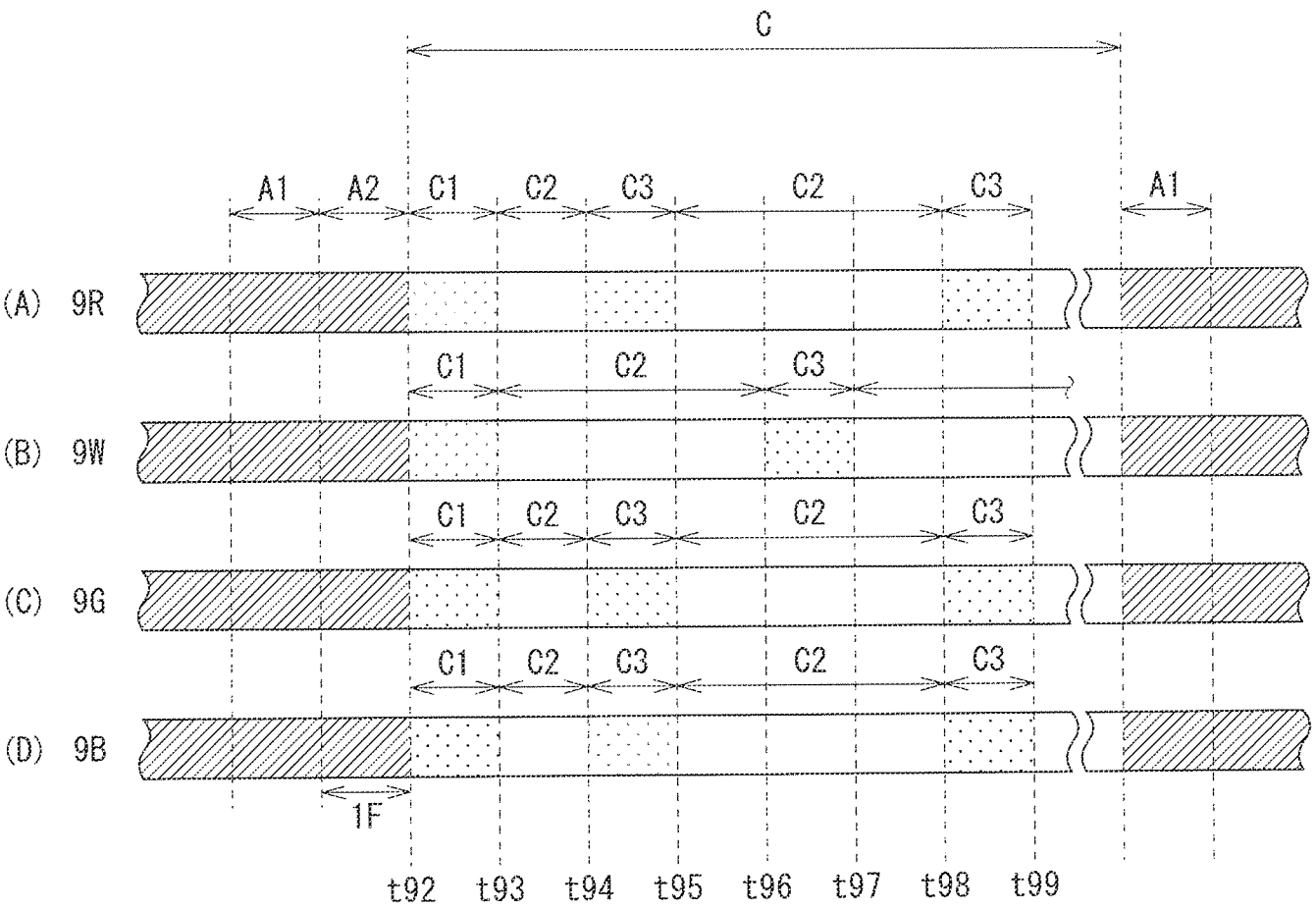
FIG. 50 is a schematic view illustrating an operation example of a sub-pixel illustrated in FIG. 48.

FIG. 50 schematically illustrates an operation in each sub-pixel 9 of the pixel Pix2, where a part (A) indicates an operation of the sub-pixel 9R, a part (B) indicates an operation of the sub-pixel 9W, a part (C) indicates an operation of the sub-pixel 9G, and a part (D) indicates an operation of the sub-pixel 9B.

In a case where the stationary level LS of one segment region RD is low, as with the first embodiment, the sub-pixels 9 belonging to the segment region RD perform the normal operation A1 in each frame period. Then, the sub-pixels 9 perform the normal operation A2 in one frame period immediately before a timing t92 at which the stationary level LS is changed to a high value.

Moreover, in a case where the stationary level LS of one segment region RD is high, the sub-pixels 9 belonging to the segment region RD perform the intermittent writing operation C. In the intermittent writing operation C, the sub-pixels 9 perform the writing operation (the before-stop operation C1) in a first frame period, and then intermittently perform the writing operation (the refresh operation C3). In this case, in the before-stop operation C1 and the refresh operation C3, the light emission operation is performed at a predetermined light-emission duty ration DUTY after the writing operation is performed. At this time, in the before-stop operation C1 and the refresh operation C3, as will be described later, a ratio of luminances of the sub-pixels 9R, 9G, 9B, and 9W is sequentially changed, or luminances of the sub-pixels 9R, 9G, 9B, and 9W are changed within a range in which change in the luminances is not visible by the user. Moreover, as with the writing stop operation B2 according to the above-described first embodiment, in the writing stop operation C2, the light emission operation is performed at the light-emission duty ration DUTY equal to that in the before-stop operation C1 and the refresh operation C3 without performing the writing operation.

In this example, four sub-pixels 9R, 9G, 9B, and 9W perform the writing operation (the before-stop operation C1) in a period from a timing t92 to a timing t93, and the four sub-pixels 9R, 9G, 9B, and 9W perform the writing stop operation C2 in the next period from the timing t93 to a timing t94. Moreover, in a period from the timing t94 to a timing t95, the sub-pixels 9R, 9G, and 9B perform the writing operation (the refresh operation C3), and the sub-pixel 9W performs the writing stop operation C2, and in the next period from the timing t95 to a timing t96, the four sub-pixels 9R, 9G, 9B, and 9W perform the writing stop operation C2. In a period from the timing t96 to a timing t97, the sub-pixel 9W performs the writing operation (the refresh operation C3), and the sub-pixels 9R, 9G, and 9B perform the writing stop operation C2, and in the next period from the timing t97 to a timing t98, the four sub-pixels 9R, 9G, 9B, and 9W perform the writing stop operation C2. Then, in a period from the timing t98 to a timing t99, the sub-pixels 9R, 9G, and 9B perform the writing operation (the refresh operation C3), and the sub-pixel 9W performs the writing stop operation C2.

It is to be noted that, in this example, the sub-pixels 9R, 9G, and 9B concurrently perform the refresh operation C3, and the sub-pixel 9W performs the refresh operation C3 in a frame period different from a frame period in which the sub-pixels 9R, 9G, and 9B perform the refresh operation C3; however, this embodiment is not limited thereto. Moreover, in this example, the writing stop frame number NF is "1" or "3"; however the writing stop frame number NF is not limited thereto.

Thus, the control section 51 controls whether or not to perform the writing drive on each of the sub-pixels 9R, 9G, 9B, and 9W.

Moreover, as will be described later, when the intermittent writing operation C is performed, the control section 51 instructs the RGBW conversion section 52 to sequentially change the ratio of the luminances of the sub-pixels 9R, 9G, 9B, and 9W. Further, as will be described later, the control section 51 also has a function of instructing the image signal processing section 53 to change the luminances of the sub-pixels 9R, 9G, 9B, and 9W within a range in which change in the luminances is not visible by the user when the intermittent writing operation C is performed.

Furthermore, the control section 51 also has a function of setting a gain G, based on the writing stop frame number NF, the burn-in level LB, the temperature information Stemp, and the outside-light information Si and instructing the image signal processing section 53 to correct luminance information IR2, IG2, IB2, and IW2 (that will be described later), based on the gain G.

Figure 51:
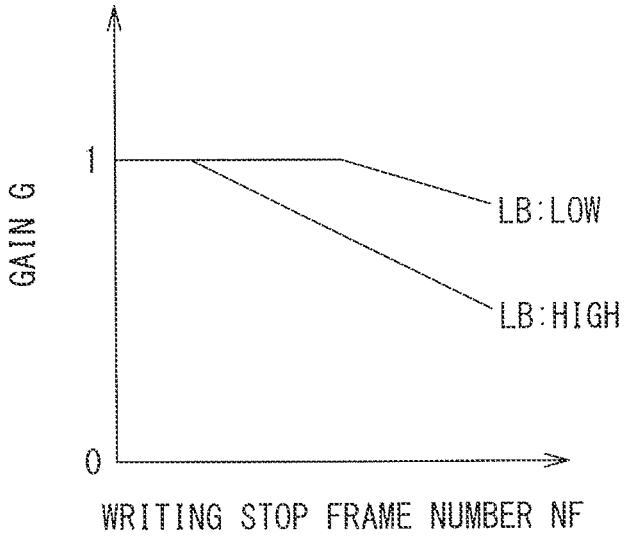
FIG. 51 is an explanatory diagram illustrating an operation example of a control section illustrated in FIG. 47.

FIG. 51 illustrates a relationship between the writing stop frame number NF and the burn-in level LB, and the gain G. In this example, the control section 51 sets the gain G to "1" in a case where the writing stop frame number NF is smaller than a predetermined number, and in a case where the writing stop frame number NF is larger than the predetermined number, the larger the writing stop frame number NF is, the more the control section 51 decreases the gain G. In other words, the larger the writing stop frame number NF is, the higher the stationary level LS becomes, and the more likely burn-in is to occur; therefore, the control section 51 sets the gain G to a small value. Moreover, in this example, as the burn-in level LB increases, the control section 51 allows the gain G to start changing at a smaller writing stop frame number NF, and increases the degree of change in the gain G. In other words, the higher the burn-in level LB is, the more likely burn-in is to occur; therefore, the control section 51 sets the gain G to a small value. Therefore, in the display unit 2, the possibility of occurrence of burn-in is allowed to be reduced by repeatedly displaying a same image.

Figure 52:
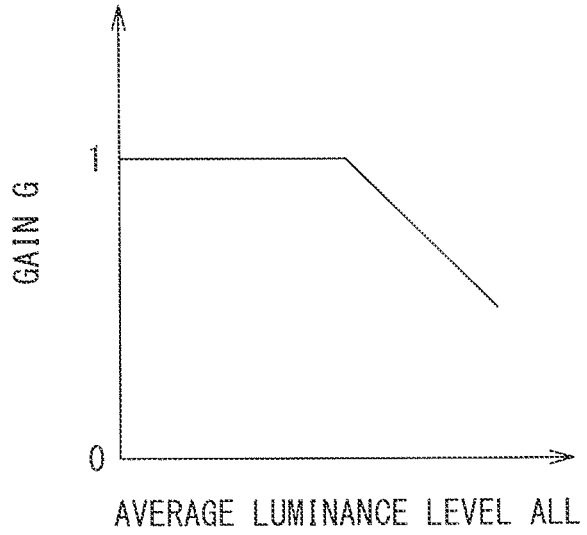
FIG. 52 is an explanatory diagram illustrating another operation example of the control section illustrated in FIG. 47.

FIG. 52 illustrates a relationship between the average luminance level ALL and the gain G. In this example, in a case where the average luminance level ALL is lower than a predetermined level, the control section 51 sets the gain G to "1", and in a case where the average luminance level ALL is higher than the predetermined level, the higher the average luminance level ALL is, the more the control section 51 decreases the gain G. In other words, an image with a high average luminance level ALL may impose a burden to eyes of a user. Therefore, in a case where the average luminance level ALL is high, the control section 51 so operates as to decrease the gain G, thereby decreasing an average value of luminance per frame period. Thus, in the display unit 2, the burden to the eyes of the user is allowed to be reduced.

Figure 53:
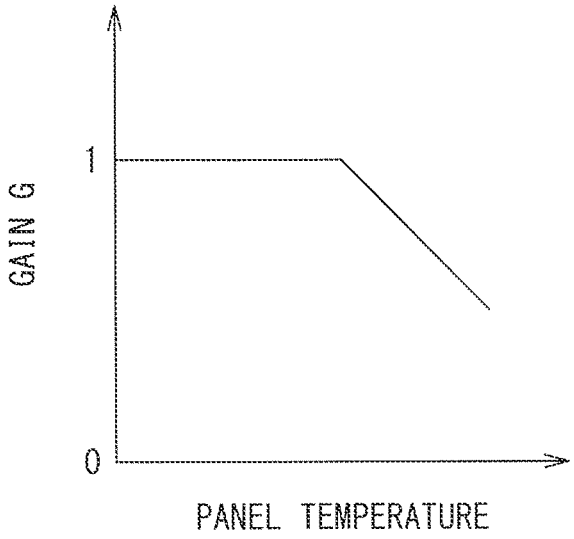
FIG. 53 is an explanatory diagram illustrating another operation example of the control section illustrated in FIG. 47.

FIG. 53 illustrates a relationship between a panel temperature indicated by the temperature information Stemp and the gain G. In this example, in a case where the panel temperature is lower than a predetermined temperature, the control section 51 sets the gain G to "1", and in a case where the panel temperature is higher than the predetermined temperature, the higher the panel temperature is, the more the control section 51 decreases the gain G. Therefore, in the display unit 2, an increase in the panel temperature is allowed to be reduced.

Figure 54:
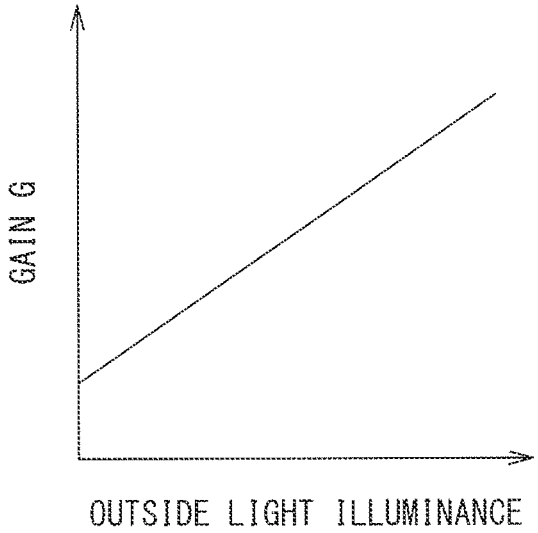
FIG. 54 is an explanatory diagram illustrating another operation example of the control section illustrated in FIG. 47.

FIG. 54 illustrates a relationship between outside-light illuminance indicated by the outside-light information Si and the gain G. In this example, the higher the outside-light illuminance is, the more the control section 51 increases the gain G. In other words, in a case where the outside-light illuminance is high, it may be difficult for the user to view a display image. Therefore, in a case where outside-light illuminance is high, the control section 51 increases the gain G to increase an average value of luminance per frame period. Thus, in the display unit 2, in a bright environment, visibility is allowed to be enhanced by performing display with high luminance, and in a dark environment, power consumption is allowed to be reduced by performing display with low luminance.

Moreover, as with the control section 17 according to the first embodiment, the control section 51 also has a function of setting the operation of the display unit 2, based on the operation mode information Smode.

The RGBW conversion section 52 is configured to generate the luminance information IR2, IG2, IB2, and IW2, based on the luminance information IR, IG, and IB included in the image signal Sdisp and an instruction from the control section 51 and output the luminance information IR2, IG2, IB2, and IW2 as an image signal Sdisp3. At this time, as will be described below, the RGBW conversion section 52 sequentially changes the ratio of the luminance information IR2, IG2, IB2, and IW2 in every refresh operation C3 when the intermittent writing operation C is performed.

Figure 55:
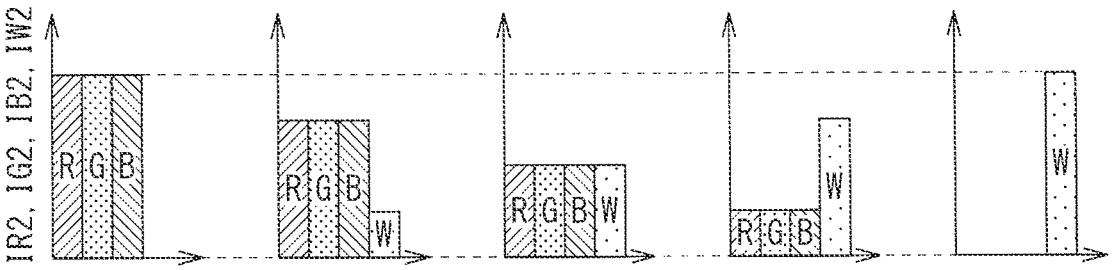
FIG. 55 is an explanatory diagram illustrating another operation example of the control section illustrated in FIG. 47.

FIG. 55 illustrates an operation of the RGBW conversion section 52. In this example, the luminance information IR2, IG2, IB2, and IW2 in the pixel Pix2 displaying white are illustrated. As illustrated in FIG. 55, the RGBW conversion section 52 sequentially changes the ratio of the luminance information IR2, IG2, IB2, and IW2 in every refresh operation C3. In other words, typically, when the luminance information IR2, IG2, IB2, and IW2 are generated, based on the luminance information IR, IG, and IB, there is flexibility in combination of values of the luminance information IR2, IG2, IB2, and IW2. More specifically, for example, the values of the luminance information IR2, IG2, and IB2 are allowed to be set to a low value, and the value of the luminance information IW2 is allowed to be set to a high value. On the contrary, the values of the luminance information IR2, IG2, and IB2 are allowed to be set to a high value, and the value of the luminance information IW2 is allowed to be set to a low value. Therefore, the RGBW conversion section 52 changes the ratio of the luminance information IR2, IG2, IB2, and IW2 in every refresh operation C3 in the intermittent writing operation C. At this time, the ratio of the luminance information IR2, IG2, IB2, and IW2 may be preferably so changed as to allow time average values of luminances in four sub-pixels 9R, 9G, 9B, and 9W to be equal to one another. Alternatively, the ratio may be randomly changed. Therefore, in the display unit 2, for example, a possibility that only some of the four sub-pixels 9R, 9G, 9B, and 9W continue emitting light with high luminance is allowed to be reduced, and a possibility that burn-in occurs unequally in some of the four sub-pixels 9R, 9G, 9B, and 9W is allowed to be reduced.

It is to be noted that, in this example, the ratio of the luminance information IR2, IG2, IB2, and IW2 is changed in every refresh operation C3; however, this embodiment is not limited thereto, and the ratio of the luminance information IR2, IG2, IB2, and IW2 may be changed in every plurality of refresh operations B3. Moreover, the image signal Sdisp is a RGB signal; however, in a case where the image signal Sdisp is a YUV signal, a HSV signal, or the like, after the image signal Sdisp is converted into the RGB signal temporarily, the RGBW conversion section 52 may preferably perform conversion, based on this RGB signal.

The image signal processing section 53 is configured to perform predetermined image signal processing on the image signal Sdisp3, based on an instruction from the control section 51 and output a result of the processing as the image signal Sdisp4. More specifically, the image signal processing section 53 has a function of changing the luminance information IR2, IG2, IB2, and IW2, based on an instruction (the gain G) from the control section 51.

Moreover, as will be described below, the image signal processing section 53 also has a function of changing the luminance information IR2, IG2, IB2, and IW2 within a range in which change in the luminance information IR2, IG2, IB2, and IW2 is not visible by the user when the intermittent writing operation C is performed.

Figure 56:
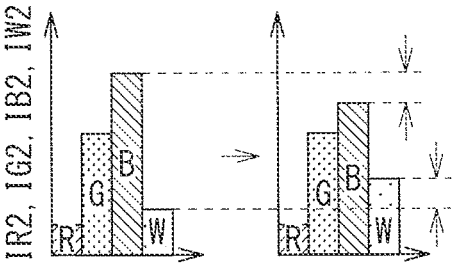
FIG. 56 is an explanatory diagram illustrating another operation example of the control section illustrated in FIG. 47.

FIG. 56 illustrates an operation of the image signal processing section 53. In this example, the image signal processing section 53 sets the blue (B) luminance information IB2 to a low value and sets the white (W) luminance information IW2 to a high value, thereby changing the values of the luminance information IR2, IG2, IB2, and IW2 to make the luminance of the pixel Pix2 substantially constant. In other words, typically, as human visual characteristics, human vision is sensitive to change in luminance but slightly insensitive to change in color, and in particular, a luminosity factor with respect to blue is low. Therefore, in this example, the image signal processing section 53 sets the blue (B) luminance information IB2 to a low value within a range in which change in the blue (B) luminance information IB2 is not visible by the user, and so sets the white (W) luminance information IW2 to a high value as not to cause change in luminance Therefore, in the display unit 2, while the possibility of deterioration in image quality is reduced, power consumption is allowed to be reduced.

Moreover, as will be described later, the image signal processing section 53 also has a function of correcting, by luminance of the sub-pixel 9W, luminance change caused by leakage from the sub-pixels 9R, 9G, and 9B in the writing stop operation C2, based on an instruction from the control section 51.

It is to be noted that, in this example, the image signal processing section 53 corrects the luminance information IR2, IG2, IB2, and IW2; however, this embodiment is not limited thereto, and alternatively, for example, the pixel voltage Vsig may be corrected by changing a reference voltage of the DAC 34 of the data line drive section 33.

The image signal processing section 53 may perform processing to enhance image quality in addition to such image signal processing. Examples of the processing to enhance image quality may include processing to enhance contrast.

[Operation and Functions]

Next, an operation and functions of the display unit 2 according to this embodiment will be described below.

(Specific Operation)

Figure 57:
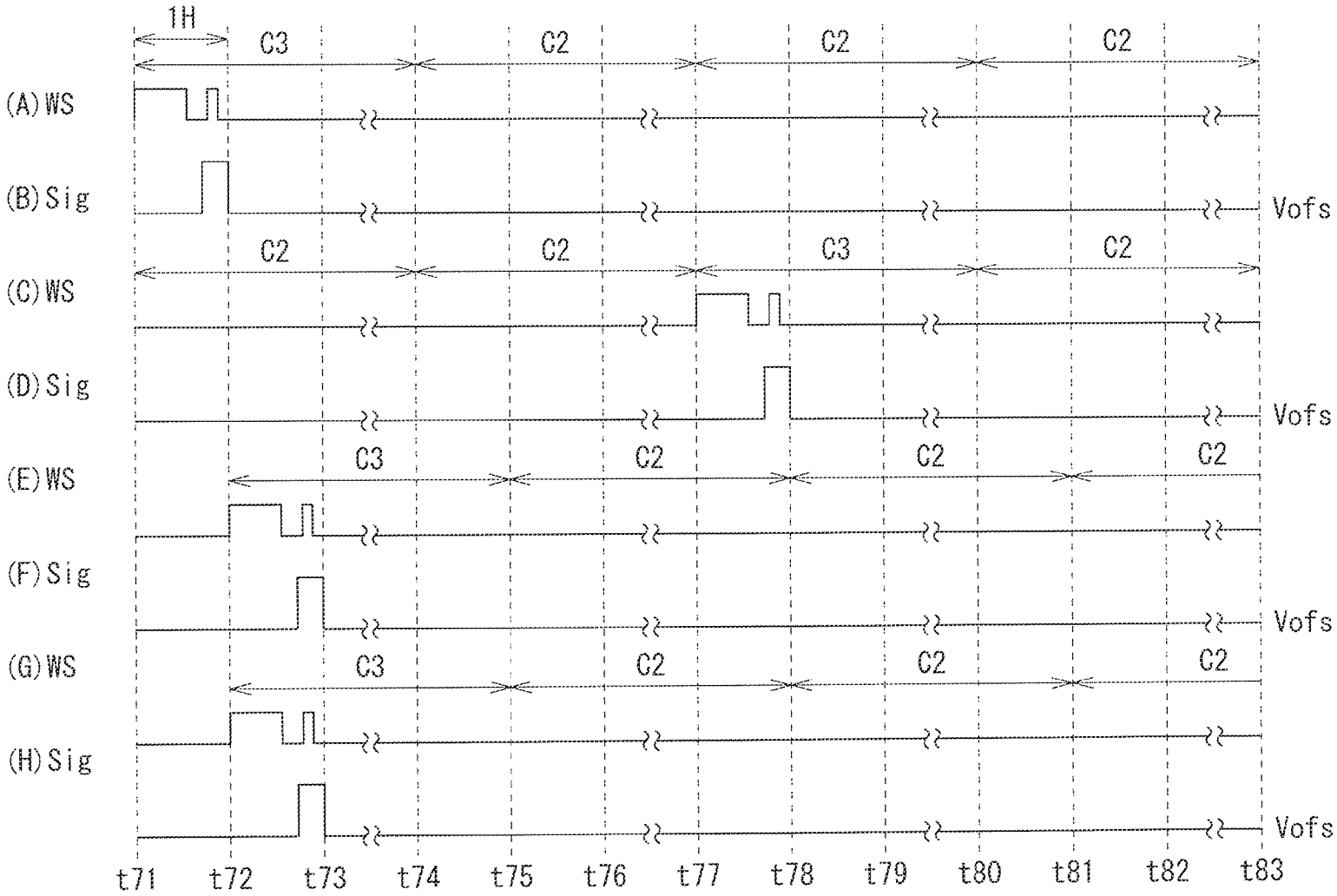
FIG. 57 is a timing waveform diagram illustrating an operation example of the drive section illustrated in FIG. 48.

FIG. 57 illustrates a timing chart of a driving operation of the drive section 60, where parts (A) and (B) indicate a driving operation on the sub-pixel 9R, parts (C) and (D) indicate a driving operation on the sub-pixel 9W, parts (E) and (F) indicate a driving operation on the sub-pixel 9G, and parts (G) and (H) indicate a driving operation on the sub-pixel 9B. In FIG. 57, each of the parts (A), (C), (E), and (G) indicates a waveform of the scanning signal WS, and each of the parts (B), (D), (F), and (H) indicates a waveform of the signal Sig.

First, in a period from a timing t71 to a timing t72, the drive section 60 starts the refresh operation C3 on the sub-pixel 9R, and starts the writing stop operation C2 on the sub-pixel 9W (refer to the parts (A) to (D) in FIG. 57). Next, in a period from a timing t72 to a timing t73, the drive section 60 starts the refresh operation C3 on the sub-pixels 9G and 9B (refer to the parts (E) to (H) in FIG. 57). In other words, in this example, as illustrated in FIG. 49, the sub-pixels 9R and 9W of the four sub-pixel 9R, 9G, 9B, and 9W are connected to data lines DTL different from each other, and the sub-pixels 9G and 9B are connected to the data lines DTL different from each other; therefore, the drive section 60 concurrently drives the sub-pixels 9R and 9W, and concurrently drives the sub-pixels 9G and 9B.

After that, in a period from a timing t74 to a timing t75, the drive section 60 starts the writing stop operation C2 on the sub-pixels 9R and 9W (refer to the parts (A) to (D) in FIG. 57). Next, in a period from the timing t75 to a timing t76, the drive section 60 starts the writing stop operation C2 on the sub-pixels 9G and 9B (refer to the parts (E) to (H) in FIG. 57).

After that, in a period from a timing t77 to a timing t78, the drive section 60 starts the writing stop operation C2 on the sub-pixel 9R and starts the refresh operation C3 on the sub-pixel 9W (refer to the parts (A) to (D) in FIG. 57). Next, in a period from the timing t78 to a timing t79 the drive section 60 starts the writing stop operation C2 on the sub-pixels 9G and 9B (refer to the parts (E) to (H) in FIG. 57).

After that, in a period from a timing t80 to a timing t81, the drive section 60 starts the writing stop operation C2 on the sub-pixels 9R and 9W (refer to the parts (A) to (D) in FIG. 57). Next, in a period from the timing t81 to a timing t82, the drive section 60 starts the writing stop operation C2 on the sub-pixels 9G and 9B (refer to the parts (E) to (H) in FIG. 57).

(Operation of Image Signal Processing Section 53)

The image signal processing section 53 is configured to correct, by the luminance of the sub-pixel 9W, luminance change caused by leakage from the sub-pixels 9R, 9G, and 9B in the writing stop operation C2. This operation will be described in detail below.

Figure 58:
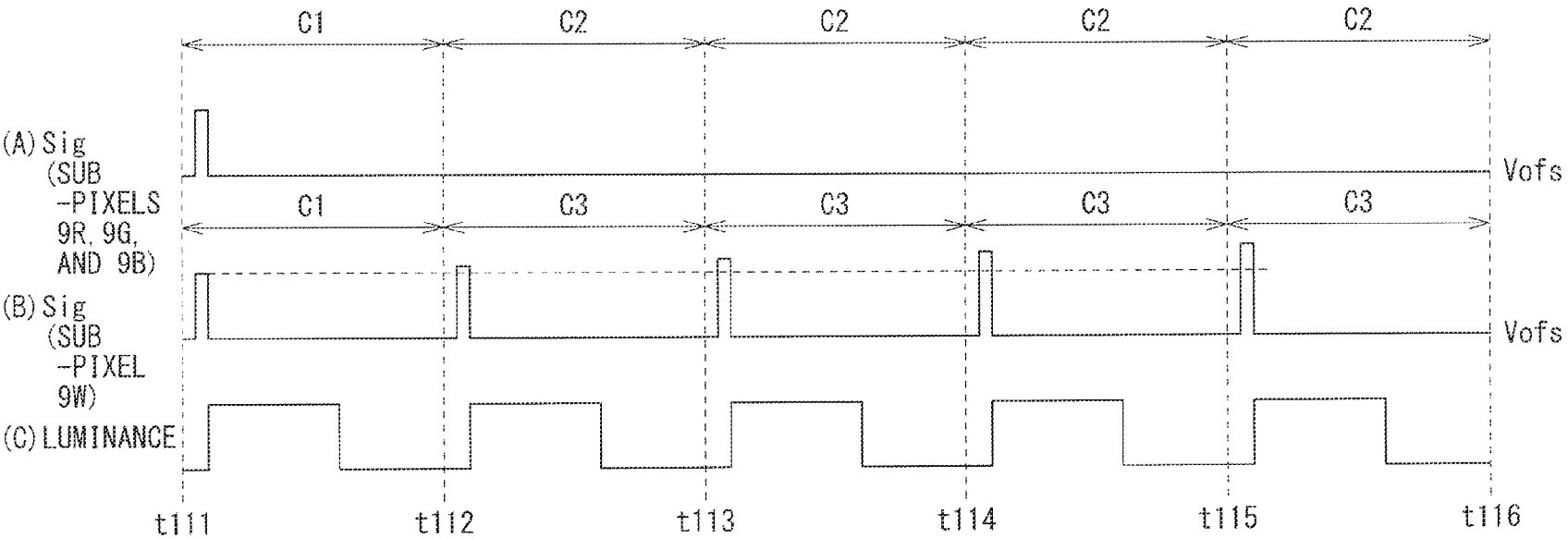
FIG. 58 is a timing waveform diagram illustrating another operation example of the drive section and the display section illustrated in FIG. 48.

FIG. 58 illustrates a timing chart of a driving operation of the drive section 60, where a part (A) indicates a waveform of the signal Sig supplied to the sub-pixels 9R, 9G, and 9B, a part (B) indicates a waveform of the signal Sig supplied to the sub-pixel 9W, and a part (C) indicates total luminance of four sub-pixels 9R, 9G, 9B, and 9W to which the signals Sig illustrated in the parts (A) and (B) are supplied. In this case, time lengths of a period from a timing t111 to a timing t112, a period from the timing t112 to a timing t113, a period from the timing t113 to a timing t114, and a period from the timing t114 to a timing t115, and a period from the timing t115 to a timing t116 are equal to that of time T of one frame period.

First, in the period from the timing t111 to the timing t112, the sub-pixels 9R, 9G, 9B, and 9W perform the before-stop operation C1. In other words, the drive section 60 writes the pixel voltage Vsig to each of the sub-pixels 9R, 9G, 9B, and 9W (refer to the parts (A) and (B) in FIG. 58), and each of the sub-pixels 9R, 9G, 9B, and 9W emits light with luminance according to the pixel voltage Vsig in a period corresponding to the light-emission duty ratio DUTY. Accordingly, the pixel Pix2 configured of four sub-pixels 9R, 9G, 9B, and 9W emits light as illustrated in the part (C) in FIG. 58.

Next, in the period from the timing t112 to the timing t113, the sub-pixels 9R, 9G, and 9B perform the writing stop operation C2, and the sub-pixel 9W performs the refresh operation C3. In other words, the drive section 60 writes the pixel voltage Vsig only to the sub-pixel 9W (refer to the part (B) in FIG. 58). At this time, the image signal processing section 53 corrects the value of the luminance information IW2 to a slightly high value, and the drive section 60 generates the pixel voltage Vsig, based on the corrected luminance information IW2, and writes the pixel voltage Vsig to the sub-pixel 9W. Then, the sub-pixel 9W emits light with luminance according to the pixel voltage Vsig in a period corresponding to the light-emission duty ratio DUTY, and each of the sub-pixels 9R, 9G, and 9B emits light with luminance according to the pixel voltage Vsig written in the period from the timing t111 to the timing t112 in a period corresponding to the light-emission duty ratio DUTY.

Next, in the period from the timing t113 to the timing t114, in a similar manner, the sub-pixels 9R, 9G, and 9B perform the writing stop operation C2 and the sub-pixel 9W performs the refresh operation C3. At this time, the image signal processing section 53 corrects the value of the luminance information IW2 to a slightly high value. The operation is similar in the period from the timing t114 to the timing t115 and the period from the timing t115 to the timing t116.

Thus, in the display unit 2, in a case where the sub-pixels 9R, 9G, and 9B perform the writing stop operation C2, the value of the luminance information IW2 is gradually corrected to a high value; therefore, the possibility of deterioration in image quality is allowed to be reduced. In other words, the luminances of the sub-pixels 9R, 9G, and 9B may be decreased by, for example, leakage from the capacitor device Cs or the like in the writing stop operation C2. Therefore, the image signal processing section 53 gradually corrects the value of the luminance information IW2 to a high value when the sub-pixels 9R, 9G, and 9B perform the writing stop operation C2. Therefore, in the display unit 2, luminance change caused by the leakage from the sub-pixels 9R, 9G, and 9B is allowed to be corrected by the luminance of the sub-pixel 9W, and deterioration in image quality is allowed to be reduced.

Figure 59:
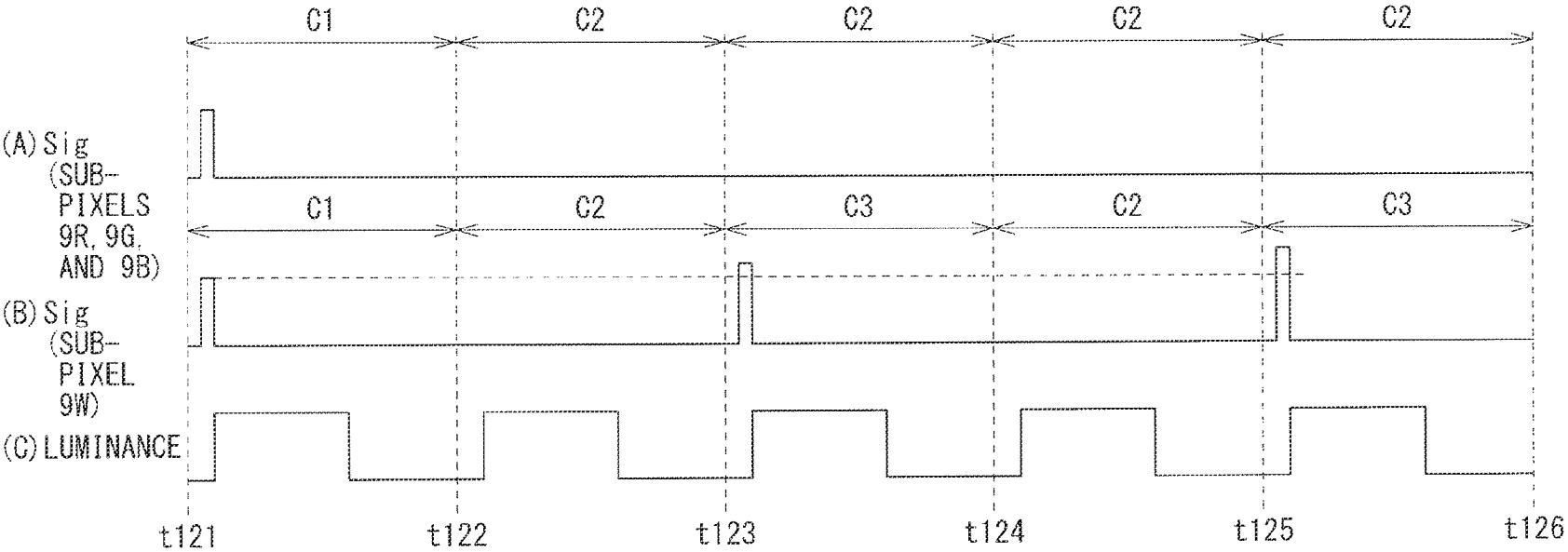
FIG. 59 is a timing waveform diagram illustrating another operation example of the drive section and the display section illustrated in FIG. 48.

In this example, the image signal processing section 53 corrects the luminance information IW2 in each frame period; however, this embodiment is not limited thereto. Alternatively, for example, as illustrated in FIG. 59, the luminance information IW2 may be corrected in every plurality of (two in this example) frame periods.

(About Power Consumption)

Thus, in the display unit 2, four sub-pixels 9R, 9G, 9B, and 9W are provided to the display section 70, and the writing drive is selectively performed on the respective sub-pixels 9R, 9G, 9B, and 9W; therefore, power consumption is allowed to be reduced. Moreover, in the display unit 2, when the intermittent writing operation C is performed, the luminances of the sub-pixels 9R, 9G, 9B, and 9W are changed within a range in which change in the luminances of the sub-pixels 9R, 9G, 9B, and 9W is not visible by the user; therefore, while the possibility of deterioration in image quality is reduced, power consumption is allowed to be reduced.

Further, the image signal processing section 53 may perform processing to enhance image quality with use of power consumption reduced in such a manner. Examples of the processing to enhance image quality include processing to enhance contrast. In this image signal processing, the values of the luminance information IR2, IG2, IB2, and IW2 are further increased in a portion where the values of the luminance information IR2, IG2, IB2, and IW2 are high of a frame image. Therefore, for example, when an image in which stars twinkle in the night sky is displayed, stars are allowed to be displayed brighter, and in a case where metal such as a coin is displayed, luster of the metal is allowed to be expressed.

Figure 60:
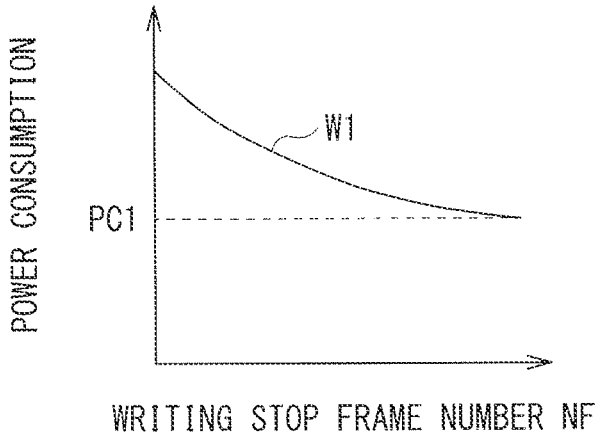
FIG. 60 is an explanatory diagram illustrating power consumption of the display unit illustrated in FIG. 47.

FIG. 60 schematically illustrates power consumption of the display unit 2 in a case where the processing to enhance image quality is performed. In a case where processing to further increase the values of the luminance information IR2, IG2, IB2, and IW2 is performed in such a manner, as illustrated by a characteristic W1, compared to a case where such processing is not performed (power consumption PC1), power consumption is larger. However, in the display unit 2, power consumption is allowed to be reduced by increasing the writing stop frame number NF, and in actuality, the processing to enhance image quality is allowed to be performed with power consumption nearly equal to power consumption P1.

[Effects]

As described above, in this embodiment, the writing drive is selectively performed on respective sub-pixels; therefore, power consumption is allowed to be reduced.

In this embodiment, when the intermittent writing operation is performed, luminance information is changed within a range in which change in the luminance information is not visible by the user; therefore, while the possibility of deterioration in image quality is reduced, power consumption is allowed to be reduced.

Other effects are similar to those in the above-described first embodiment.

[Modification Example 2-1]

Figure 61:
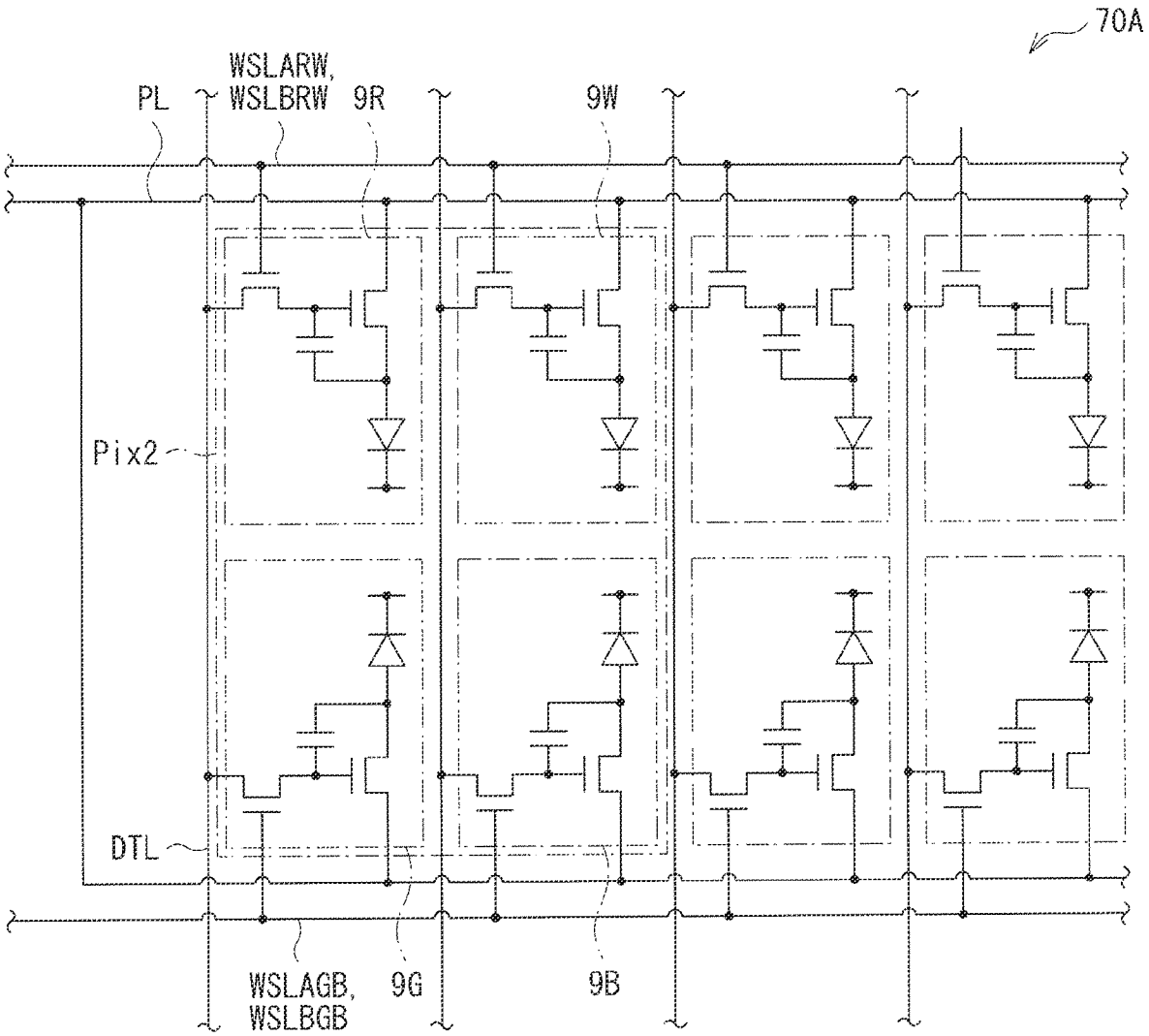
FIG. 61 is a circuit diagram illustrating a configuration example of a display section according to a modification example of the second embodiment.

In the above-described embodiment, four sub-pixels 9R, 9G, 9B, and 9W in the pixel Pix2 are connected to scanning lines different from one another; however, this embodiment is not limited thereto. Alternatively, for example, like a display section 70A illustrated in FIG. 61, the sub-pixels 9R and 9W may be connected to a same scanning line, and the sub-pixels 9G and 9B may be connected to a same scanning line. In this example, in one pixel Pix2 in the region 42A, the sub-pixels 9R and 9W are connected to a scanning line WSLARW, and the sub-pixels 9G and 9B are connected to a scanning line WSLAGB. Likewise, in one pixel Pix2 in the region 42B, the sub-pixels 9R and 9W are connected to a scanning line WSLBRW, and the sub-pixels 9G and 9B are connected to a scanning line WSLBGB.

[Modification Example 2-2]

Figure 62:
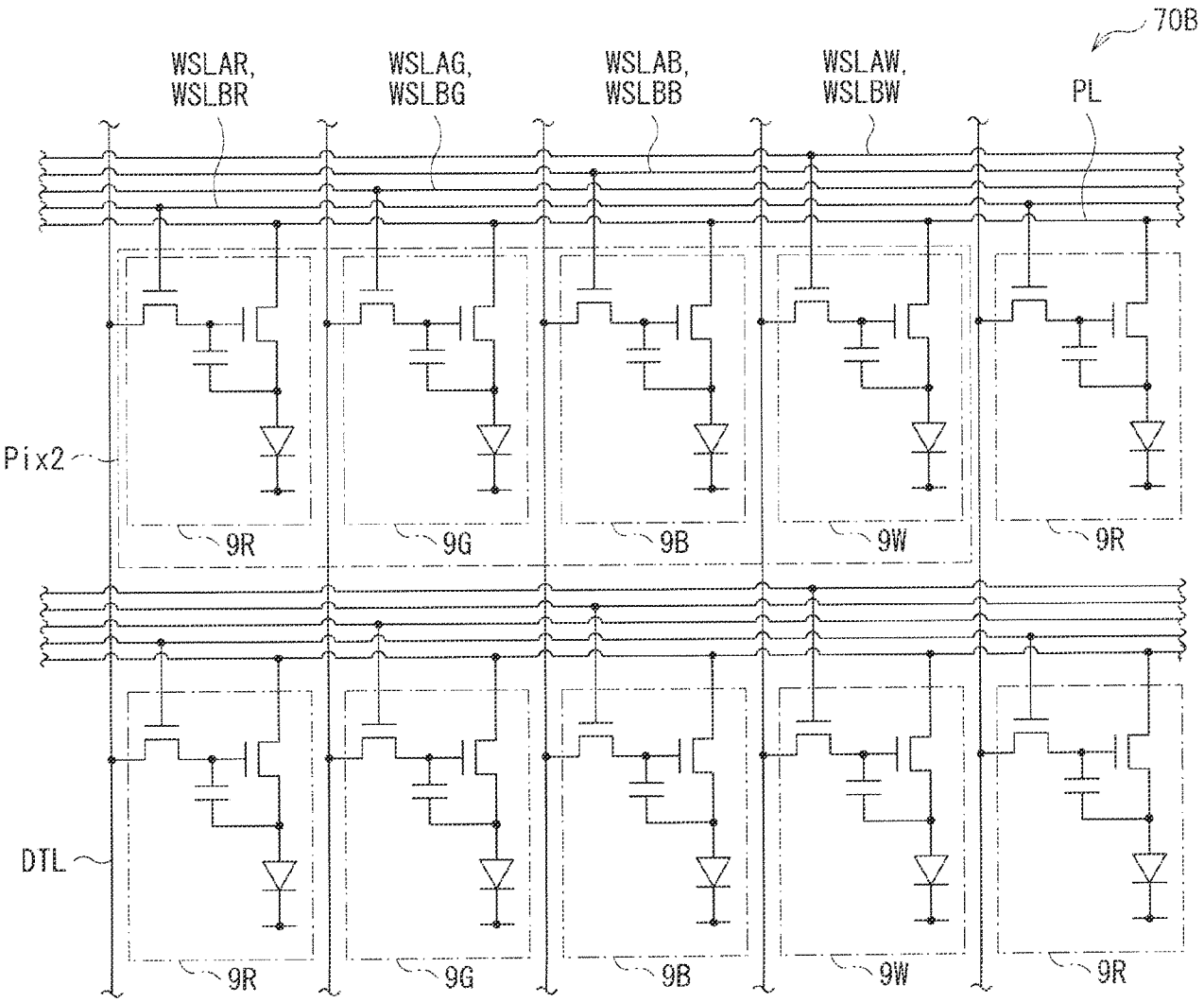
FIG. 62 is a circuit diagram illustrating a configuration example of a display section according to another modification example of the second embodiment.
Figure 63:
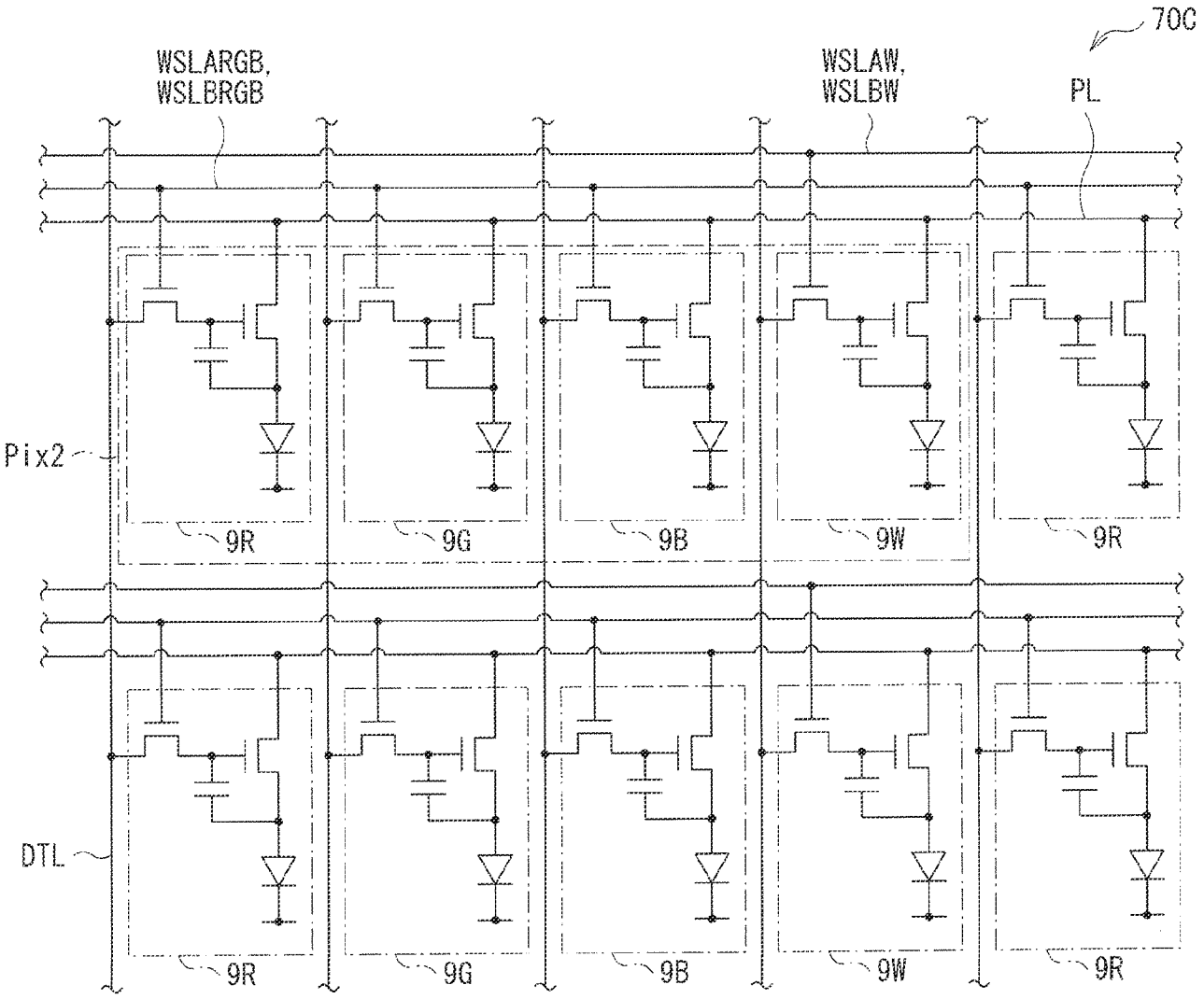
FIG. 63 is a circuit diagram illustrating a configuration example of a display section according to another modification example of the second embodiment.

In the above-described embodiment, the four sub-pixels 9R, 9G, 9B, and 9W are arranged in an array of two rows by two columns in the pixel Pix2; however, this embodiment is not limited thereto. Alternatively, for example, as illustrated in FIGS. 62 and 63, four sub-pixels 9R, 9G, 9B, and 9W may be arranged side by side along a predetermined direction. In a display section 70B illustrated in FIG. 62, four sub-pixels 9R, 9G, 9B, and 9W belonging to one pixel Pix2 in the region 42A are connected to the scanning lines WSLAR, WSLAG, WSLAB, and WSLAW that are different from one another, respectively, and four sub-pixels 9R, 9G, 9B, and 9W belonging to one pixel Pix2 in the region 42B are connected to the scanning lines WSLBR, WSLBG, WSLBB, and WSLBW that are different from one another, respectively. Moreover, in a display section 70C illustrated in FIG. 63, three sub-pixels 9R, 9G, and 9B belonging to one pixel Pix2 in the region 42A are connected to the scanning line WSLARGB, and the sub-pixel 9W is connected to the scanning line WSLAW. Moreover, three sub-pixels 9R, 9G, and 9B belonging to one pixel Pix2 in the region 42B are connected to a scanning line WSLBRGB, and the sub-pixel 9W is connected to the scanning line WSLBW.

[Modification Example 2-3]

In the above-described embodiment, the white (W) sub-pixel 9W is provided; however, this embodiment is not limited thereto. Alternatively, instead of the white (W) sub-pixel 9W, for example, a sub-pixel of another color such as yellow may be provided.

[Modification Example 2-4]

Figure 64:
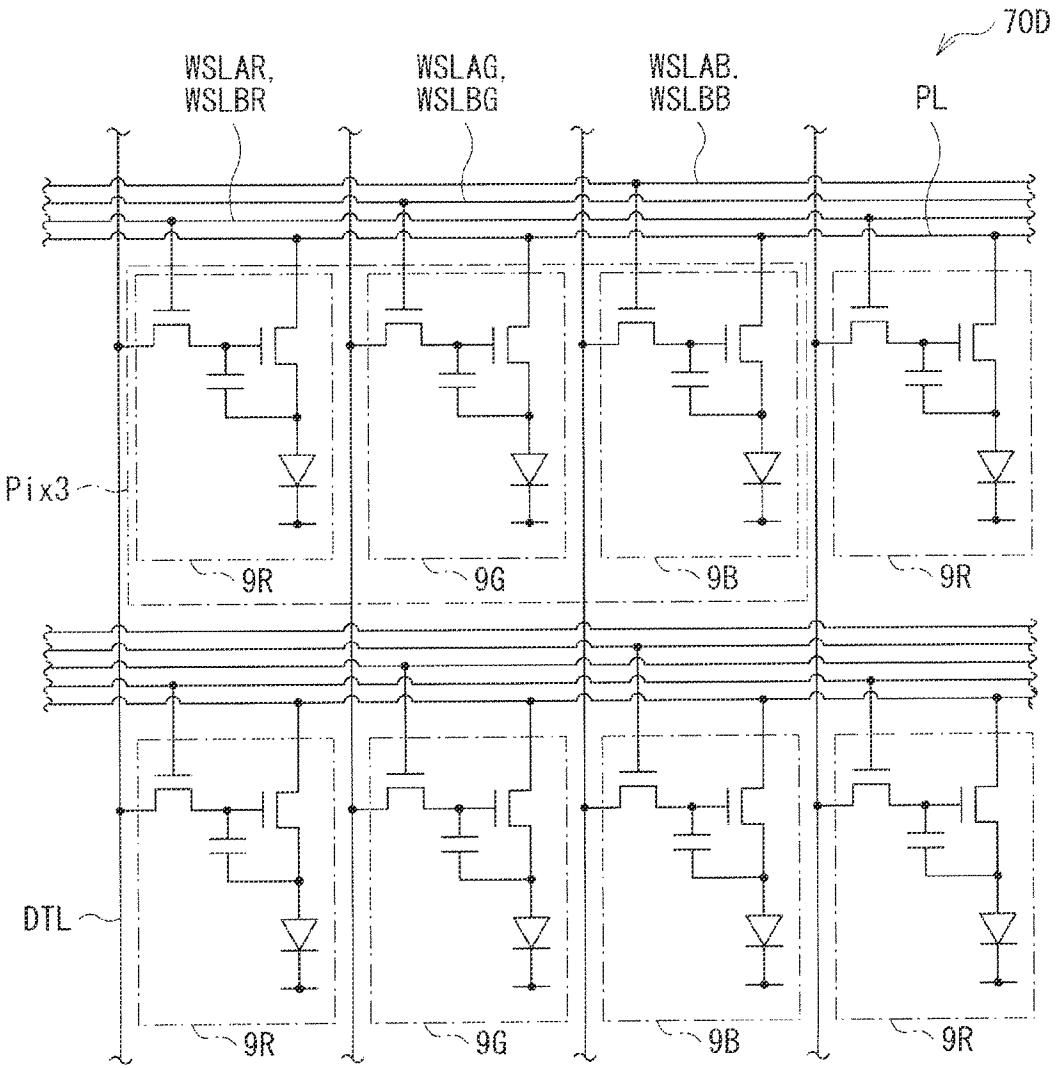
FIG. 64 is a circuit diagram illustrating a configuration example of a display section according to another modification example of the second embodiment.

In the above-described embodiment, four sub-pixels 9R, 9G, 9B, and 9W are provided; however, this embodiment is not limited thereto. Alternatively, for example, like a display section 70D illustrated in FIG. 64, three sub-pixels 9R, 9G, and 9B may be provided. In this example, three sub-pixels 9R, 9G, and 9B belonging to one pixel Pix3 in the region 42A are connected to the scanning lines WSLAR, WSLAG, and WSLAB that are different from one another, respectively, and three sub-pixels 9R, 9G, and 9B belonging to one pixel Pix3 in the region 42B are connected to scanning lines WSLBR, WSLBG, and WSLBB that are different from one another, respectively.

[Other Modification Examples]

Each of the modification examples of the above-described first embodiment may be applied to the display unit 2 according to the above-described second embodiment.

(3. Application Examples)

Next, application examples of the display units described in the above-described embodiments will be described below. The display units according to the above-described embodiments are applicable to display units of electronic apparatuses in any fields that display, as an image or a picture, an image signal input from an external device or an image signal produced inside, such as televisions, electronic books, smartphones, digital cameras, notebook personal computers, video cameras, and head mounted displays.

Figure 65:
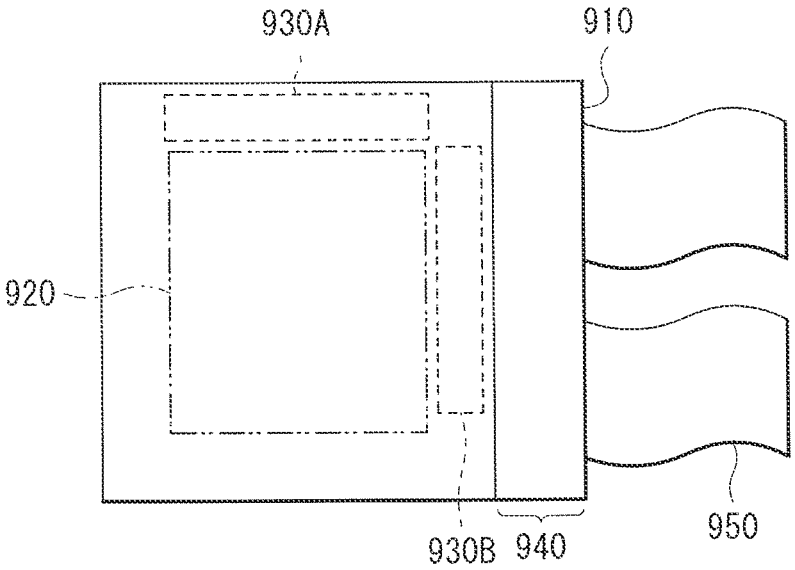

Any of the display units according to the above-described embodiments is incorporated as, for example, a module illustrated in FIG. 65 into various electronic apparatuses such as respective application examples that will be described later. This module may be configured, for example, by forming a display section 920 and drive circuits 930A and 930B on a substrate 910. An external connection terminal (not illustrated) for connection between the drive circuit 930 and an external device is formed in a region 940 located on one side of the substrate 910. In this example, a flexible printed circuit (FPC) 950 for signal input and output is connected to the external connection terminal. The display section 920 is configured by including the display section 40 and the like, and the drive circuit 930A is configured by including a whole or a part of the drive section 30 and the like.

(Application Example 1)

Figure 66:
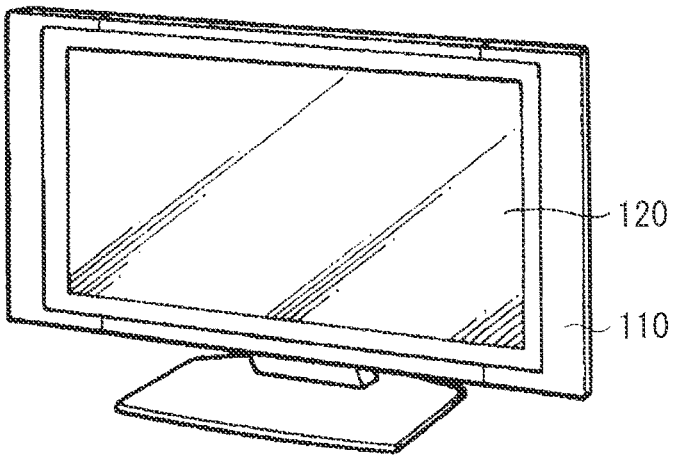

FIG. 66 illustrates an appearance of a television. The television may include, for example, a main body section 110 and a display section 120, and the display section 120 is configured of any one of the above-described display units.

(Application Example 2)

Figure 67:
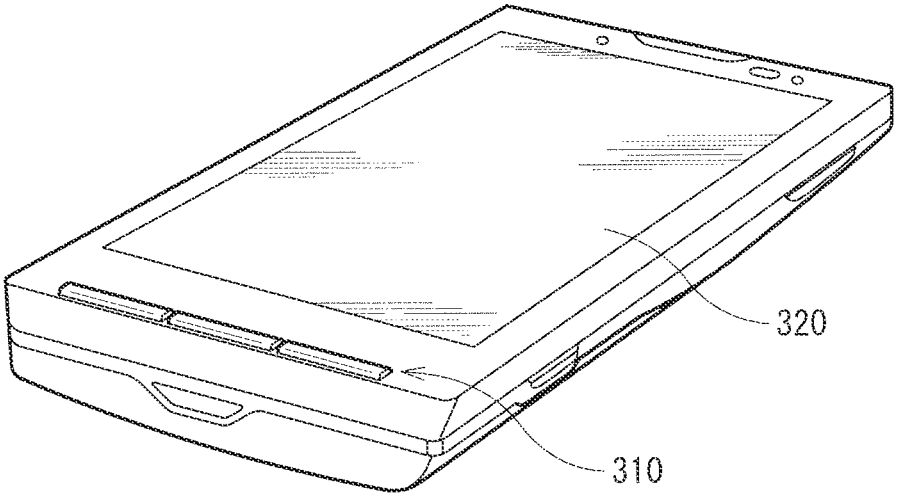

FIG. 67 illustrates an appearance of a smartphone. The smartphone may include, for example, a main body section 310 and a display section 320, and the display section 320 is configured of any one of the above-described display units.

Thus, the display units described in the above-described embodiments are applicable to various electronic apparatuses. By the present technology, power consumption is allowed to be reduced while reducing a possibility of deterioration in image quality of an image displayed on any of the electronic apparatuses. In particular, in portable electronic apparatuses, a battery run time is allowed to be increased by reduction in power consumption.

Although the present technology is described referring to the embodiments, the modification examples thereof, and the application examples thereof to electronic apparatuses, the present technology is not limited thereto, and may be variously modified.

Figure 68:
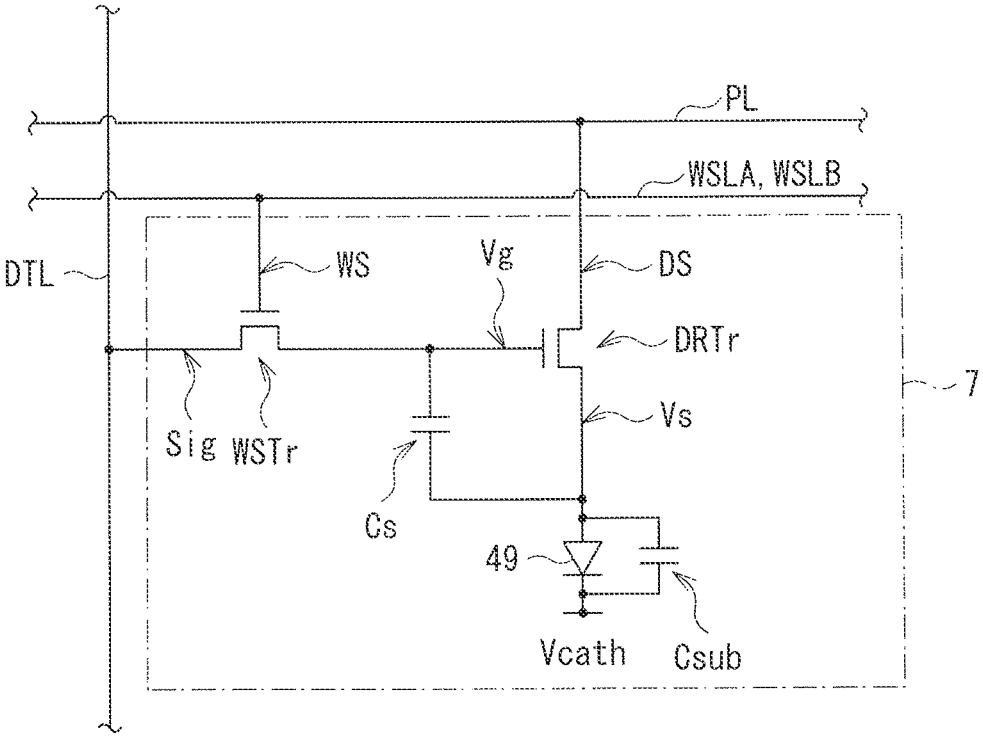
FIG. 68 is a circuit diagram illustrating a configuration example of a sub-pixel according to another modification example.

For example, in the above-described embodiments, one capacitor device CS is provided to each of the sub-pixels 9; however, the present technology is not limited thereto. Alternatively, for example, like a sub-pixel 7 illustrated in FIG. 68, a capacitor device Csub may be provided. A first end and a second end of the capacitor device Csub are connected to an anode and a cathode of the light-emitting device 49, respectively. In other words, the sub-pixel 7 has a so-called "2Tr2C" configuration configured with use of two transistors (the writing transistor WSTr and the driving transistor DRTr) and two capacitor devices Cs and Csub.

It is to be noted that the effects described in this description are merely examples; therefore, effects in the present technology are not limited thereto, and the present technology may have other effects.

It is to be noted that the present technology may have the following configurations.

(1) A display unit including:

a display section including a plurality of unit pixels; and a drive section configured to perform a first drive, a second drive, and a third drive on each of the unit pixels in this order, in which each of the first drive and the second drive includes an initialization drive, a writing drive of a pixel voltage, and a light emission drive based on the pixel voltage written by the writing drive, a part of a series of the initialization drive, the writing drive, and the light emission drive differs between the first drive and the second drive, and the third drive includes a light emission drive based on the pixel voltage written by the writing drive in the second drive.

(2) The display unit according to (1), in which a period in which the initialization drive is performed in the second drive is shorter than a period in which the initialization drive is performed in the first drive.

(3) The display unit according to (1) or (2), in which the drive section performs the light emission drive immediately after the writing drive in the first drive, and performs the light emission drive after a lapse of a predetermined time after the writing drive in the second drive.

(4) The display unit according to any one of (1) to (3), in which each of the unit pixels includes a display device, a first transistor including a drain, a gate, and a source, the source connected to the display device, a second transistor configured to set a gate voltage of the first transistor by being turned to an ON state, and a capacitor device inserted between the gate and the source.

(5) The display unit according to (4), in which the drive section applies a first voltage to the drain of the first transistor while turning the second transistor to the ON state in the initialization drives in the first drive and the second drive, and the third drive includes, before the light emission drive, a light emission preparation drive in which the first voltage is applied to the drain of the first transistor while turning the second transistor to an OFF state.

(6) The display unit according to (4) or (5), in which the drive section applies a second voltage to the drain of the first transistor while turning the second transistor to an OFF state in the light emission drive in the first drive, and the drive section applies a third voltage lower than the second voltage to the drain of the first transistor while turning the second transistor to the OFF state in the light emission drives in the second drive and the third drive.

(7) The display unit according to any one of (1) to (6), in which a period in which the light emission drive is performed in the second drive is longer than a period in which the light emission is performed in the first drive, and a luminance level indicated by the pixel voltage in the second drive is lower than a luminance level indicated by the pixel voltage in the first drive.

(8) The display unit according to any one of (1) to (7), in which a period in which the light emission drive is performed in the third drive is longer than the period in which the light emission drive is performed in the first drive, and a luminance level indicated by the pixel voltage in the third drive is lower than the luminance level indicated by the pixel voltage in the first drive.

(9) The display unit according to any one of (1) to (8), in which the drive section performs the light emission drive a plurality of times in each of the second drive and the third drive.

(10) The display unit according to any one of (1) to (9), further including a detection section configured to detect one or more of outside-light illuminance, temperature, and an average luminance level of a display image, in which the drive section determines a length of a period in which the light emission drive is performed, based on a detection result in the detection section in the third drive.

(11) The display unit according to any one of (1) to (10), in which the drive section alternately performs a predetermined number of the third drives and a fourth drive after the second drive, the fourth drive includes an initialization drive, a writing drive of a pixel voltage, and a light emission drive based on the pixel voltage written by the writing drive, and a part of a series of the initialization drive, the writing drive, and the light emission drive differs between the first drive and the fourth drive.

(12) The display unit according to (11), in which a display region of the display section is partitioned into a plurality of segment regions, and the drive section determines, based on a motion amount in each of the segment regions, the predetermined number for the unit pixels belonging to the segment region.

(13) The display unit according to (11), in which the drive section partitions, based on a motion amount in an entire display region of the display section, the display region of the display section into a plurality of segment regions, and circularly performs the fourth drive on the plurality of segment regions, the number of the segment regions corresponding to the motion amount.

(14) The display unit according to any one of (11) to (13), in which the drive section determines, based on the predetermined number and the pixel voltage, a length of a period in which the light emission drive is performed in the third drive and a length of a period in which the light emission is performed in the fourth drive.

(15) The display unit according to any one of (11) to (14), in which the drive section gradually decreases the pixel voltage in the fourth drive in every fourth drive or every plurality of fourth drives.

(16) The display unit according to any one of (11) to (15), in which the drive section determines the predetermined number for each of the unit pixels, based on contents displayed on the display section.

(17) The display unit according to any one of (11) to (16), further including a gaze detection section configured to detect a user's gaze, in which the drive section determines the predetermined number for each of the unit pixels, based on a detection result by the gaze detection section.

(18) The display unit according to any one of (11) to (17), in which the drive section changes a position of an image display region in the display section in every fourth drive or every plurality of fourth drives.

(19) The display unit according to (1), in which the display section includes a plurality of display pixels and a plurality of scanning lines configured to transmit a scanning signal, and each of the display pixels includes two or more unit pixels connected to scanning lines different from each other of the plurality of unit pixels.

(20) The display unit according to (19), in which the two or more unit pixels include three basic-color pixels emitting light of basic colors different from one another.

(21) The display unit according to (20), in which the drive section decreases a pixel voltage supplied to the basic-color pixel emitting light of a basic color with low visibility of the light of the basic colors in the second drive.

(22) The display unit according to (20) or (21), in which the two or more unit pixels further include a non-basic-color pixel emitting color light other than the light of the basic colors.

(23) The display unit according to (22), in which the drive section alternately performs a predetermined number of third drives and a fourth drive after the second drive, the fourth drive includes an initialization drive, a writing drive of a pixel voltage, and a light emission drive based on the pixel voltage written by the writing drive, and a part of a series of the initialization drive, the writing drive, and the light emission drive differs between the first drive and the fourth drive.

(24) The display unit according to (23), in which the drive section changes the pixel voltage supplied to the basic-color pixels and the non-basic-color pixel in every fourth drive or every plurality of fourth drives.

(25) The display unit according to (23) to (24), in which the predetermined number for the non-basic-color pixel is smaller than the predetermined number for the basic color pixels.

(26) The display unit according to (25), in which the drive section sequentially increases the pixel voltage supplied to the non-basic-color pixel in every fourth drive or every plurality of fourth drives.

(27) The display unit according to any one of (23) to (26), further including a detection section configured to detect one or more of outside-light illuminance, temperature and an average luminance level of a display image, in which the drive section changes the pixel voltage, based on a detection result in the detection section in the fourth drive.

(28) The display unit according to any one of (23) to (27), in which the drive section changes the pixel voltage, based on the predetermined number and the pixel voltage in the fourth drive.

(29) A driving method including:

preparing a plurality of unit pixels; and performing a first drive, a second drive, and a third drive on each of the plurality of unit pixels in this order, wherein each of the first drive and the second drive includes an initialization drive, a writing drive of a pixel voltage, and a light emission drive based on the pixel voltage written by the writing drive, a part of a series of the initialization drive, the writing drive, and the light emission drive differs between the first drive and the second drive, and the third drive includes a light emission drive based on the pixel voltage written by the writing drive in the second drive.

(30) An electronic apparatus provided with a display unit and a control section configured to perform operation control on the display unit, the display unit including:

a display section including a plurality of unit pixels; and a drive section configured to perform a first drive, a second drive, and a third drive on each of the unit pixels in this order, wherein each of the first drive and the second drive includes an initialization drive, a writing drive of a pixel voltage, and a light emission drive based on the pixel voltage written by the writing drive, a part of a series of the initialization drive, the writing drive, and the light emission drive differs between the first drive and the second drive, and the third drive includes a light emission drive based on the pixel voltage written by the writing drive in the second drive.

It should be understood by those skilled in the art that various modifications, combinations, sub-combinations, and alterations may occur depending on design requirements and other factors insofar as they are within the scope of the appended claims or the equivalents thereof.

What is claimed is:

1. A display unit comprising:

a display section including a plurality of unit pixels; and a drive section configured to perform a first drive, a second drive, and a third drive on each of the unit pixels in this order, wherein each of the first drive and the second drive includes an initialization drive, a writing drive of a pixel voltage, and a light emission drive based on the pixel voltage written by the writing drive, a part of a series of the initialization drive, the writing drive, and the light emission drive differs between the first drive and the second drive, and the third drive includes a light emission drive based on the pixel voltage written by the writing drive in the second drive.

2. The display unit according to claim 1, wherein a period in which the initialization drive is performed in the second drive is shorter than a period in which the initialization drive is performed in the first drive.

3. The display unit according to claim 1, wherein the drive section performs the light emission drive immediately after the writing drive in the first drive, and performs the light emission drive after a lapse of a predetermined time after the writing drive in the second drive.

4. The display unit according to claim 1, wherein each of the unit pixels includes a display device, a first transistor including a drain, a gate, and a source, the source connected to the display device, a second transistor configured to set a gate voltage of the first transistor by being turned to an ON state, and a capacitor device inserted between the gate and the source.

5. The display unit according to claim 4, wherein the drive section applies a first voltage to the drain of the first transistor while turning the second transistor to the ON state in the initialization drives in the first drive and the second drive, and the third drive includes, before the light emission drive, a light emission preparation drive in which the first voltage is applied to the drain of the first transistor while turning the second transistor to an OFF state.

6. The display unit according to claim 4, wherein the drive section applies a second voltage to the drain of the first transistor while turning the second transistor to an OFF state in the light emission drive in the first drive, and the drive section applies a third voltage lower than the second voltage to the drain of the first transistor while turning the second transistor to the OFF state in the light emission drives in the second drive and the third drive.

7. The display unit according to claim 1, wherein a period in which the light emission drive is performed in the second drive is longer than a period in which the light emission drive is performed in the first drive, and a luminance level indicated by the pixel voltage in the second drive is lower than a luminance level indicated by the pixel voltage in the first drive.

8. The display unit according to claim 7, wherein a period in which the light emission drive is performed in the third drive is longer than the period in which the light emission drive is performed in the first drive, and a luminance level indicated by the pixel voltage in the third drive is lower than the luminance level indicated by the pixel voltage in the first drive.

9. The display unit according to claim 1, wherein the drive section performs the light emission drive a plurality of times in each of the second drive and the third drive.

10. The display unit according to claim 1, further comprising a detection section configured to detect one or more of outside-light illuminance, temperature, and an average luminance level of a display image, wherein the drive section determines a length of a period in which the light emission drive is performed, based on a detection result in the detection section in the third drive.

11. The display unit according to claim 1, wherein the drive section alternately performs a predetermined number of the third drives and a fourth drive after the second drive, the fourth drive includes an initialization drive, a writing drive of a pixel voltage, and a light emission drive based on the pixel voltage written by the writing drive, and a part of a series of the initialization drive, the writing drive, and the light emission drive differs between the first drive and the fourth drive.

12. The display unit according to claim 11, wherein a display region of the display section is partitioned into a plurality of segment regions, and the drive section determines, based on a motion amount in each of the segment regions, the predetermined number for the unit pixels belonging to the segment region.

13. The display unit according to claim 11, wherein the drive section partitions, based on a motion amount in an entire display region of the display section, the display region of the display section into a plurality of segment regions, and circularly performs the fourth drive on the plurality of segment regions, the number of the segment regions corresponding to the motion amount.

14. The display unit according to claim 11, wherein the drive section determines, based on the predetermined number and the pixel voltage, a length of a period in which the light emission drive is performed in the third drive and a length of a period in which the light emission drive is performed in the fourth drive.

15. The display unit according to claim 11, wherein the drive section gradually decreases the pixel voltage in the fourth drive in every fourth drive or every plurality of fourth drives.

16. The display unit according to claim 11, wherein the drive section determines the predetermined number for each of the unit pixels, based on contents displayed on the display section.

17. The display unit according to claim 11, further comprising a gaze detection section configured to detect a user's gaze, wherein the drive section determines the predetermined number for each of the unit pixels, based on a detection result by the gaze detection section.

18. The display unit according to claim 11, wherein the drive section changes a position of an image display region in the display section in every fourth drive or every plurality of fourth drives.

19. The display unit according to claim 1, wherein the display section includes a plurality of display pixels and a plurality of scanning lines configured to transmit a scanning signal, and each of the display pixels includes two or more unit pixels connected to scanning lines different from each other of the plurality of unit pixels.

20. The display unit according to claim 19, wherein the two or more unit pixels include three basic-color pixels emitting light of basic colors different from one another.

21. The display unit according to claim 20, wherein the drive section decreases a pixel voltage supplied to the basic-color pixel emitting light of a basic color with low visibility of the light of the basic colors in the second drive.

22. The display unit according to claim 20, wherein the two or more unit pixels further include a non-basic-color pixel emitting color light other than the light of the basic colors.

23. The display unit according to claim 22, wherein the drive section alternately performs a predetermined number of third drives and a fourth drive after the second drive, the fourth drive includes an initialization drive, a writing drive of a pixel voltage, and a light emission drive based on the pixel voltage written by the writing drive, and a part of a series of the initialization drive, the writing drive, and the light emission drive differs between the first drive and the fourth drive.

24. The display unit according to claim 23, wherein the drive section changes the pixel voltage supplied to the basic-color pixels and the non-basic-color pixel in every fourth drive or every plurality of fourth drives.

25. The display unit according to claim 23, wherein the predetermined number for the non-basic-color pixel is smaller than the predetermined number for the basic color pixels.

26. The display unit according to claim 25, wherein the drive section sequentially increases the pixel voltage supplied to the non-basic-color pixel in every fourth drive or every plurality of fourth drives.

27. The display unit according to claim 23, further comprising a detection section configured to detect one or more of outside-light illuminance, temperature and an average luminance level of a display image, wherein the drive section changes the pixel voltage, based on a detection result in the detection section in the fourth drive.

28. The display unit according to claim 23, wherein the drive section changes the pixel voltage, based on the predetermined number of the third drive and the fouth drive, and the pixel voltage in the fourth drive.

29. A driving method comprising:

preparing a plurality of unit pixels; and performing a first drive, a second drive, and a third drive on each of the plurality of unit pixels in this order, wherein each of the first drive and the second drive includes an initialization drive, a writing drive of a pixel voltage, and a light emission drive based on the pixel voltage written by the writing drive, a part of a series of the initialization drive, the writing drive, and the light emission drive differs between the first drive and the second drive, and the third drive includes a light emission drive based on the pixel voltage written by the writing drive in the second drive.

30. An electronic apparatus provided with a display unit and a control section configured to perform operation control on the display unit, the display unit comprising:

a display section including a plurality of unit pixels; and a drive section configured to perform a first drive, a second drive, and a third drive on each of the unit pixels in this order, wherein each of the first drive and the second drive includes an initialization drive, a writing drive of a pixel voltage, and a light emission drive based on the pixel voltage written by the writing drive, a part of a series of the initialization drive, the writing drive, and the light emission drive differs between the first drive and the second drive, and the third drive includes a light emission drive based on the pixel voltage written by the writing drive in the second drive.

* * * * *